US006997535B2

(12) United States Patent
Mochizuki et al.

(10) Patent No.: US 6,997,535 B2
(45) **Date of Patent: *Feb. 14, 2006**

(54) INK TANK AND INK JET RECORDING APPARATUS PROVIDED WITH THE SAME

(75) Inventors: Muga Mochizuki, Kanagawa (JP); Ichiro Saito, Kanagawa (JP); Hiroyuki Ishinaga, Tokyo (JP); Yoshiyuki Imanaka, Kanagawa (JP); Masahiko Kubota, Tokyo (JP); Ryoji Inoue, Kanagawa (JP); Takaaki Yamaguchi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 214 days.

This patent is subject to a terminal disclaimer.

(21) Appl. No.: 10/650,694

(22) Filed: Aug. 29, 2003

(65) Prior Publication Data

US 2004/0036734 A1 Feb. 26, 2004

Related U.S. Application Data

(62) Division of application No. 09/879,237, filed on Jun. 12, 2001, now Pat. No. 6,685,296.

(30) Foreign Application Priority Data

Jun. 16, 2000 (JP) ..... 2000-181637
Jun. 16, 2000 (JP) ..... 2000-181638
Jun. 16, 2000 (JP) ..... 2000-181836

(51) Int. Cl.
*B41J 29/393* (2006.01)
*B41J 2/175* (2006.01)

(52) U.S. Cl. ..... 347/19; 347/86

(58) Field of Classification Search ..... 347/7, 347/14, 17, 19, 50, 86, 87; 73/291, 306, 73/313; 257/417

See application file for complete search history.

(56) References Cited

U.S. PATENT DOCUMENTS 645,576 A 3/1900 Tesla ..... 375/259

(Continued)

FOREIGN PATENT DOCUMENTS

DE 196 42 899 10/1997

(Continued)

OTHER PUBLICATIONS

"Capacitive Ink Level Detector" IBM Technical Disclosure Bulletin, vol. 16, No. 10, Mar. 1974.

(Continued)

*Primary Examiner*—Anh T. N. Vo
(74) *Attorney, Agent, or Firm*—Fitzpatrick, Cella, Harper & Scinto

(57) ABSTRACT

An ink tank is provided which can efficiently perform detection of information in an ink tank such as an ink residual amount in the ink tank with a simple configuration in which it is unnecessary to set wiring or the like. A solid semiconductor element, which is provided with an acquiring unit for acquiring environmental information of the outside, an information storing unit, a discriminating unit for comparing acquired information and stored information to make a determination, and an information communicating unit for displaying the acquired information or communicating the acquired information to the outside, is embedded in an outer wall of an ink tank such that the solid semiconductor element is exposed to an internal side and an external side of the ink tank from the outer wall. The solid semiconductor element can perform supply of its operation energy or exchanges of signals in a non-contact state or by connecting with a terminal provided in a supporting portion or the like of the ink tank directly, thus, it is unnecessary to set wiring. In this case, the information acquiring means can be preferably disposed in the part of the solid semiconductor element exposed to the inside of the ink tank.

18 Claims, 44 Drawing Sheets

U.S. PATENT DOCUMENTS

| | | | | |
|---|---|---|---|---|
| 3,713,148 | A | 1/1973 | Cardullo et al. | 342/42 |
| 4,920,362 | A | 4/1990 | Cowger | 347/87 |
| 4,940,997 | A * | 7/1990 | Hamlin et al. | 347/87 |
| 5,049,898 | A | 9/1991 | Arthur et al. | 347/19 |
| 5,111,201 | A | 5/1992 | Matsumura et al. | 340/870.38 |
| 5,136,309 | A | 8/1992 | Iida et al. | 346/140 R |
| 5,508,722 | A * | 4/1996 | Saito et al. | 347/17 |
| 5,623,290 | A | 4/1997 | Iida et al. | 347/7 |
| 5,729,256 | A * | 3/1998 | Yamanaka et al. | 347/7 |
| 5,877,943 | A | 3/1999 | Ramamurthi | 361/783 |
| 5,956,061 | A * | 9/1999 | Ahn | 347/87 |
| 6,003,966 | A | 12/1999 | Ahn | 347/7 |
| 6,007,173 | A | 12/1999 | DeLouise et al. | 347/7 |
| 6,099,101 | A * | 8/2000 | Maurelli et al. | 347/7 |
| 6,164,743 | A | 12/2000 | Hmelar et al. | 347/7 |
| 6,227,643 | B1 | 5/2001 | Purcell et al. | 347/19 |
| 6,286,921 | B1 * | 9/2001 | Ochi et al. | 347/7 |
| 6,302,527 | B1 | 10/2001 | Walker | 347/50 |
| 6,312,074 | B1 * | 11/2001 | Walker | 347/7 |
| 6,312,106 | B1 | 11/2001 | Walker | 347/50 |
| 6,322,182 | B1 | 11/2001 | Lin et al. | 347/7 |
| 6,361,135 | B1 * | 3/2002 | Coudray et al. | 347/7 |
| 6,366,742 | B1 | 4/2002 | Reihl et al. | 399/12 |
| 6,685,296 | B1 * | 2/2004 | Mochizuki et al. | 347/19 |
| 6,719,394 | B1 * | 4/2004 | Kubota et al. | 347/19 |
| 2002/0008722 | A1 | 1/2002 | Imanaka et al. | 347/14 |
| 2002/0008724 | A1 | 1/2002 | Kubota et al. | |
| 2002/0015066 | A1 | 2/2002 | Siwinski et al. | 347/19 |
| 2002/0033855 | A1 | 3/2002 | Kubota et al. | |
| 2004/0036733 | A1 * | 2/2004 | Kubota et al. | 347/19 |

FOREIGN PATENT DOCUMENTS

| | | |
|---|---|---|
| DE | 198 09 855 | 9/1999 |
| EP | 585560 | 3/1994 |
| EP | 631870 | 1/1995 |
| EP | 440110 | 6/1995 |
| EP | 878316 | 11/1998 |
| EP | 878319 | 11/1998 |
| EP | 1053880 | 11/2000 |
| FR | 2744391 | 8/1997 |
| GB | 1466269 | 3/1977 |
| JP | 56-039414 | 4/1981 |
| JP | 6-143607 | 5/1994 |
| JP | 8-290579 | 11/1996 |
| JP | 10-193640 | 7/1998 |
| JP | 11-58766 | 3/1999 |
| JP | 11-58783 | 3/1999 |
| JP | 11-129499 | 5/1999 |
| JP | 11-138843 | 5/1999 |
| JP | 2947245 | 7/1999 |
| WO | 90/00974 | 2/1990 |
| WO | 98/04414 | 2/1998 |
| WO | 98/52762 | 11/1998 |
| WO | 00/19278 | 4/2000 |

OTHER PUBLICATIONS

J.W. Haskell, "Ink Concentration Monitor", IBM Technical Disclosure Bulletin, vol. 20, No. 2, Jul. 1977.

N. Kong, "Floating Ink-Density Sensor", IBM Technical Disclosure Bulletin, vol. 21, No. 7, Dec. 1978.

W.E. Broom, et al., "Continuous Liquid Level Sensor", IBM Technical Disclosure Bulletin, vol. 23, No. 7B, Dec. 1980.

* cited by examiner

FIG. 36A

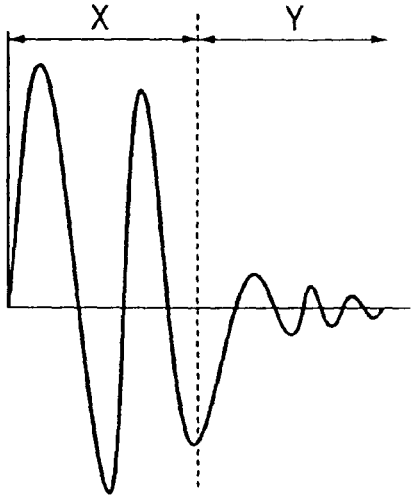

X (INK) & Y (INK+NEGATIVE PRESSURE GENERATING MEMBER) ARE DIFFERENT IN MEDIUM THEREIN

X IS DIFFERENT IN ATTENUATION AMOUNT FROM Y

DIFFICULT FOR CONTROLLING ENVIRONMENT DETECTION BECAUSE OF DIFFERENCE OF ATTENUATION AMOUNT

ENVIRONMENTAL DETECTION BECOMES EASY IF MEDIUM THEREIN IS SAME

POSITION PLURALITY OF SOLID SEMICONDUCTORS IN EACH OF X & Y AND CORRECT EACH DATA TO COMPARE THEM

FIG. 36B

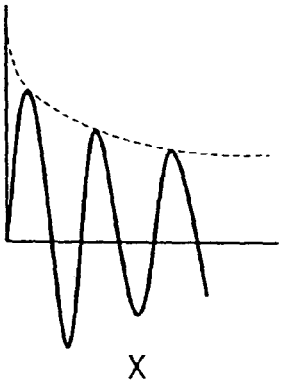

FIG. 36C

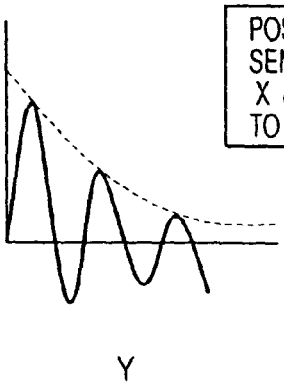

INK TANK AND INK JET RECORDING APPARATUS PROVIDED WITH THE SAME

This application is a division of application Ser. No. 09/879,237, filed Jun. 12, 2001, now U.S. Pat. 6,685,296.

BACKGROUND OF THE INVENTION

1. Field of the Invention

The present invention relates to an ink tank provided with a semiconductor element having functions of detecting environmental information of the surroundings to communicate the information to the outside and display the same, or having functions of detecting information inside an ink tank (e.g., an ink residual amount) using a semiconductor element to communicate the information to the outside and display the same.

In addition, the present invention relates to an ink jet recording apparatus such as a facsimile machine, a printer and a copying machine to which the ink tank is detachably mountable.

2. Related Background Art

Conventionally, in an ink jet recording apparatus for printing an image on a sheet with dot patterns by moving a carriage, which is provided with a recording head, in a printing direction while jetting ink from a plurality of jet nozzles provided in the recording head, an ink tank containing ink for recording is provided and the ink in the ink tank is supplied to the recording head via an ink supply line. Therefore, an ink residual amount detection apparatus, with which a residual amount of the ink in the ink tank is detected, has been practically used, and a variety of ink residual amount detection apparatuses have been proposed.

For example, according to Japanese Patent Application Laid-open No. 6-143607, two (a pair of) electrodes 702 are disposed on an internal surface of the bottom of an ink tank 701 that is filled with nonconductive ink, and a float body 703, on which electrodes 704 opposing the electrodes 702 are disposed, floats in ink contained in the ink tank 701 as shown in FIGS. 26A to 26C of the patent application. The patent application discloses that the two electrodes 702 are connected respectively to a detecting unit (not shown) for detecting a conduction state of both the electrodes, and when detecting the conductance of both the electrodes, the detecting unit outputs a residual ink error signal indicating that no ink is left in the ink tank 701 and stops operations of an ink jet recording head 705.

In addition, Japanese Patent No. 2947245 discloses an ink cartridge 805 for an ink cartridge 805 for ink jet printer with a configuration in which a lower part is formed in a funnel-shape toward a bottom surface, two electric conductors 801 and 802 are provided on the bottom surface and a metal ball 804 having specific gravity smaller than that of ink 803 is provided inside. In such a configuration, when the ink 803 is consumed and decreases, the liquid level of the ink 803 is lowered. As the liquid level of the ink 803 is lowered, the position of the metal ball 804 floating on the liquid level is also lowered. When the liquid level of the ink 803 is lowered to the position of the bottom surface of the ink cartridge housing, the metal ball 804 contacts the two electric conductors 801 and 802. Then, since the electric conductors 801 and 802 continue each other, an electric current flows between them. If the flow of the current is detected, an ink end state can be detected. If the ink end state is detected, information indicating the ink end state is communicated to a user.

Configurations for detecting an ink residual amount in an ink tank as represented by the conventional art disclosed in the above-mentioned patent and patent application are known. In the above-mentioned configurations, it is necessary to dispose electrodes for detection in the ink tank such that information and a state are detected and communicated by directly contacting elements themselves such as electrodes and a float body or electric conductors and a metal ball. In addition, since the ink residual amount is detected by a conduction state between the electrodes, there is a restriction on ink to be used as indicated by the fact that a metal ion cannot be used as an ink component, or the like.

In addition, only the ink residual amount can be detected and the other information on the inside of the tank cannot be found from the outside in the above-mentioned configurations. For example, pressure information inside the ink tank, variations of a physical property of the ink, or the like are parameters that are important for always operating an ink jet head with a stable discharge amount. Thus, a tank is desired which can inform, on a real time basis, an ink jet recording apparatus in the outside of a pressure inside the tank that varies every moment in accordance with the consumption of the ink in the tank, or can communicate the variations of the physical property of the ink to the outside.

Moreover, an ink tank is desired which does not only unilaterally informs the outside of information detected in the ink tank but also can execute bidirectional exchanges of information such as returning inside information in response to an inquiry from the outside.

In developing an ink tank such as those described above, inventors of the present invention took notice of a ball semiconductor of Ball Semiconductor, Inc. in which a semiconductor integrated circuit was formed on a spherical surface of a silicon ball with a diameter of one millimeter. Since the ball semiconductor had a spherical shape, it was expected that, if this ball semiconductor was contained in the ink tank, the detection of surrounding environmental information and the bidirectional exchanges of information with the outside could be performed extremely efficiently compared with a flat-shaped one. However, when the inventors searched an ink tank having such functions, it was found that only a technology for connecting ball semiconductors by electric wiring as disclosed in U.S. Pat. No. 5,877,943 is existed, and that it is necessary to develop an element itself having the above-mentioned functions. In addition, in order to make this element effectively applicable to the ink tank, there were problems that should be cleared. One of the problems is supply of electricity for activating the element contained in the tank. If a power source for activating the element is provided in the ink tank, the tank becomes larger, or even if the power source is provided outside the tank, wiring is necessary between the power source and the element. As a result, since manufacturing costs of the tank increases and a tank cartridge becomes expensive, a user has to activate the element from the outside without contacting it or has to activate the element by directly contacting it.

In addition, it is not conventionally known that a user communicates information between two elements disposed in remote places without contacting them or communicates with and controls a configuration that is provided with, for example, a plurality of pairs consisting of two elements.

SUMMARY OF THE INVENTION

Thus, the present invention is for realizing a new configuration for communicating information between two elements disposed in remote places without contacting and for discriminating which pair is selected among a plurality of pairs consisting of two elements to communicate with and control, for example, with respect to a configuration of a communication system provided with the pairs of elements.

It is an object of the present invention to provide an ink tank that has a simple configuration not requiring to draw around wiring from the element on the ink tank and provided with a solid semiconductor element capable of extremely efficiently performing bidirectional exchanges of information with the outside such as detection of information in the ink tank, and an ink jet recording apparatus provided with the ink tank.

In addition, it is another object of the present invention to provide an ink tank that extremely efficiently performing detection of surrounding environmental information and bidirectional exchanges of information with the outside, thereby being capable of detecting detailed information in the ink tank on a real time basis and bidirectionally performing exchanges of information with an ink jet recording apparatus in the outside, and an ink jet recording apparatus provided with the tank.

It is yet another object of the present invention to provide a communication method that is capable of efficiently performing determination and selection of a pair of elements among a plurality of pairs or communication and control between the elements, an ink tank employing the communication method, an ink jet recording apparatus and a communication system.

In order to solve the above-mentioned objects, an ink tank of the present invention is an ink tank for holding ink, which is supplied to a recording head for recording information by applying the ink on a medium for recording information thereon, in an ink containing chamber substantially surrounded by a wall, wherein the ink tank has a solid semiconductor element that comprises: information acquiring means for acquiring environmental information of the outside; information storing means for storing information to be compared with the information acquired by the information acquiring means; discriminating means for comparing the information acquired by the information acquiring means and information stored in the information storing means, which corresponds to the acquired information, to determine the necessity of communicating information; and information communicating means for displaying the information acquired by the information acquiring means or communicating the information to the outside if the discriminating means determines that it is necessary to communicate information, and wherein a solid semiconductor element is embedded in the wall such that a part of the solid semiconductor element exposes from a side of the wall contacting the ink, and the information acquiring means is disposed in the exposed part.

According to this configuration, since the information acquiring means is disposed in a part exposed from the side of the wall of the solid semiconductor element contacting the ink, a residual amount of the ink, pH of the ink inside the ink tank can be acquired preferably. Then, the acquired information can be compared with information stored by the information storing means, which corresponds to the acquired information, by the discriminating means and can be displayed or communicated to the outside by the information communicating means according to the comparison result.

The solid semiconductor element can be embedded in the wall such that it is exposed from the both sides of the ink tank utilizing its solid shape. In this way, means can be disposed in an exposed part opposite the exposed part on the side contacting the ink, which functions preferably because it is exposed.

For example, an electrical contact can be disposed preferably on the part exposed to the outside by embedding the solid semiconductor element in the outer wall. That is, in this way, communication of information between the solid semiconductor element and a recording apparatus main body, supply of energy for activating the solid semiconductor element or the like can be performed via a contact provided in a part supporting the ink tank. In addition, the information communicating means can be disposed preferably in the part exposed to the outside, which can acquire an advantage of being capable of efficiently communicating a signal to the outside because it is exposed to the outside. In this case, the solid semiconductor element is disposed such that it can be seen from the outside, whereby a user can directly confirm information from the information communicating means with the information communicating means as means for communicating information to the outside by a visually recognizable method such as emitting light.

In addition, the solid semiconductor element is embedded in an inner wall dividing the inside of the ink tank into a plurality of ink containing chambers, and each independent information acquiring means is disposed in a part exposed from one side of the inner wall and a part exposed from the other side. Thus, information on the ink inside the ink containing chambers on both the sides divided by the inner wall can be detected by one solid semiconductor element.

Instead of disposing one solid semiconductor element to be exposed from the both sides of the wall, a first solid semiconductor element having a part exposed from one side of the wall and a second solid semiconductor element having a part exposed from the other side may be provided to communicate information between them.

In the present invention, if a plurality of solid semiconductor elements are disposed in a plurality of parts on a wall, a state of ink in the plurality of parts inside an ink tank can be detected to confirm a state inside the ink tank more in detail. In this case, communication of information of the plurality of solid semiconductor elements is performed by signals of different frequencies, respectively, or a specific signal assigned to each of them is communicated together with acquired information by the plurality of solid semiconductor elements. Thus, it can be made distinguishable which solid semiconductor element outputted a signal.

In the present invention, receiving means for receiving a signal from the outside is further provided in the solid semiconductor element, and environmental information inside the ink containing chamber is acquired by the information acquiring means according to the signal received by the receiving means. Thus, bidirectional exchanges of information can be performed such as taking out information in the ink tank according to a request from the outside. This receiving means is advantageously disposed in a part of the solid semiconductor element, which is exposed to the outside of the tank.

In addition, it is desirable to further provide in the solid semiconductor elements energy converting means for converting energy from the outside into energy of a different kind such that activation energy for the solid semiconductor element can be easily supplied from the outside. This energy converting means is advantageously disposed in a part of the solid semiconductor element, which is exposed to the outside of the tank.

If the energy converting means is means having an electric conductor coil, which generates electricity by electromagnetic induction between the energy converting means and an external oscillating circuit, and an oscillating circuit, energy can be supplied to the solid semiconductor element from the outside in a non-contact state. In addition, in this case, a state of the ink in the ink tank can be detected utilizing a characteristic that an inductance of an electric conductor coil is changed by contacting the ink.

In addition, the recording apparatus of the present invention is provided with the ink tank as described above. The recording apparatus in this case preferably has means for supplying an electromotive force as external energy, which is converted by the energy converting means, to the solid semiconductor element in the ink tank. As this electromotive force, electromagnetic induction, heat, light or radiation is possible. In addition, the recording apparatus desirably has means for receiving a communication signal from the solid semiconductor element.

In addition, the present invention for attaining the above-mentioned objects is a method of communicating with a plurality of groups of elements with two or more solid semiconductor elements among a plurality of solid semiconductor elements disposed in a predetermined container forming one group, wherein the plurality of solid semiconductor elements comprises: information acquiring means for acquiring information; information communicating means for displaying or communicating the information acquired by the information acquiring means; and energy converting means for converting energy given from the outside into energy of a kind for operating the information acquiring means and the information communicating means, which is different from the energy given from the outside, wherein communication is performed with a communication condition different for each of the groups of elements.

In addition, the present invention is a method of communicating with a plurality of groups of elements with two or more solid semiconductor elements among a plurality of solid semiconductor elements disposed in a predetermined container forming one group, wherein the plurality of solid semiconductor elements comprises: information acquiring means for acquiring information; discriminating means for discriminating information based on the information acquired from the information acquiring means and a data table stored in advance; information communicating means for displaying or communicating the information determined by the discriminating means; and energy converting means for converting energy given from the outside into energy of a kind for operating the information acquiring means, the discriminating means and the information communicating means, which is different from the energy given from the outside, wherein communication is performed with a communication condition different for each of the groups of elements.

In addition, the present invention is a method of communicating with a plurality of solid semiconductor elements provided in a predetermined container, wherein the plurality of solid semiconductor elements comprises; information acquiring means for acquiring information; information communicating means for displaying or communicating the information acquired by the information acquiring means; and energy converting means for converting energy given from the outside into energy of a kind for operating the information acquiring means and the information communicating means, which is different from the energy given from the outside, wherein each of the solid semiconductor elements has information for distinction or a memory, and communication is performed by recognizing the information for distinction or distinguishing the information by the memory.

In addition, the present invention is a method of communicating with a plurality of solid semiconductor elements provided in a predetermined container, wherein the plurality of solid semiconductor elements comprises: information acquiring means for acquiring information; discriminating means for discriminating information based on the information acquired from the information acquiring means and a data table stored in advance; information communicating means for displaying or communicating the information determined by the discriminating means; and energy converting means for converting energy given from the outside into energy of a kind for operating the information acquiring means, the discriminating means and the information communicating means, which is different from the energy given from the outside, wherein each of the solid semiconductor elements has information for distinction or a memory, and communication is performed by recognizing the information for distinction or distinguishing the information by the memory.

In addition, the present invention is an ink tank for containing ink, wherein the ink tank includes two or more solid semiconductor elements, which comprises; energy converting means for converting energy given from the outside into energy of a different kind; information acquiring means for acquiring environmental information of the outside; information storing means for storing information to be compared with the information acquired by the information acquiring means; discriminating means for comparing the information acquired by the information acquiring means and the information stored in the information storing means, which corresponds to the acquired information, to determine the necessity of communicating information; and information communicating means for displaying the information acquired by the information acquiring means or communicating the information to the outside if the discriminating means determines that communication of information is necessary, and the information acquiring means, the information storing means, the discriminating means and the information communicating means are activated by the energy converted by the energy converting means, and wherein the two or more solid semiconductor elements have a function of detecting environmental information of the surrounding of the solid semiconductor elements to communicate the environmental information to the outside or display the environmental information by communicating with each other.

In addition, the ink tank of the present invention is provided with: energy converting means for converting energy given from the outside into energy of a different kind; receiving means for receiving a signal from the outside; information storing means for storing information; and information communicating means for displaying or communicating the information of the information storing means according to the signal received by the receiving means, wherein the receiving means, the information storing means and the information communicating means have two or more solid semiconductor elements that are activated by the energy converted by the energy converting means, and the two or more solid semiconductor elements have a function of detecting environmental information of the surrounding of the solid semiconductor elements to communicate the environmental information to the outside or display the environmental information by communicating with each other.

The solid semiconductor element of the present invention is provided with: energy converting means for converting energy given from the outside into energy of a different kind; receiving means for receiving a signal from the outside; information acquiring means for acquiring environmental information of the outside; information storing means for storing information to be compared with the information acquired by the information acquiring means; and discriminating means for causing the information acquiring means to acquire environmental information of the outside according to the signal received by the receiving means and comparing the acquired information and the information stored in the information storing means, which corresponds to the acquired information, to discriminate whether or not the acquired information meets a predetermined condition and information communicating means for displaying or communicating at least the determination result of the discriminating means to the outside, wherein the receiving means, the information storing means, the discriminating means and the information communicating means have two or more solid semiconductor elements that are activated by the energy converted by the energy converting means, and the two or more solid semiconductor elements have a function of detecting environmental information of the surrounding of the solid semiconductor elements to communicate the environmental information to the outside or display the environmental information by communicating with each other.

The information communicating means of the solid semiconductor element may display information or communicate information to the other solid semiconductor elements, and the receiving means may receive a signal from the other solid semiconductor elements. Moreover, at least one of the two or more solid semiconductor elements as described above may have a function of giving an electromotive force to the other solid semiconductor elements.

In the solid semiconductor element as described above, external energy to be converted by the energy converting means is preferably supplied in a non-contact state.

In addition, in the solid semiconductor element as described above, the energy converted by the energy converting means is electricity. As the external energy to be converted by the energy converting means into electricity, an electromotive force by electromagnetic induction, heat, light or radiation is possible.

As the information communicating means in this case, means for converting electricity converted by the energy converting means into a magnetic field, light, a shape, a color, an electric wave or sound, which is energy for displaying information or communicating information to the outside, is possible.

In addition, as the energy converting means, means having an electric conductor coil, which generates electricity by electromagnetic induction between the means and an external oscillating circuit, and an oscillating circuit is possible. The electric conductor coil is preferably formed such that it winds itself around an outer surface of the solid semiconductor element.

In addition, the solid semiconductor element as described above may be further provided with buoyance force generating means for generating buoyance force using energy converted by the energy converting means.

In addition, the solid semiconductor element as described above may have a hollow part for floating on a liquid level or a predetermined position in the liquid.

In this case, it is preferable that a center of gravity of the solid semiconductor element floating in the liquid is positioned in a part lower than the center of the element, and the element does not rotate in the liquid, in which it floats, and steadily rocks. In addition, a meta center of the solid semiconductor element is always in a position higher than the center of gravity of the solid semiconductor element in the direction of the center of gravity.

These two or more solid semiconductor elements can be provided not only in liquid in an ink tank but also outside the liquid. It can be moved to other places by giving an electromotive force or causing it to communicate. In addition, it may be fixed in a definite place if necessary.

In addition, the plurality of solid semiconductor elements preferably does not always communicate but communicates if necessary from the viewpoint of saving energy. An application such as giving a new function to the plurality of solid semiconductor elements by combining them is also possible.

In addition, the ink jet recording apparatus of the present invention is provided with the above-mentioned ink tank. The recording apparatus in this case preferably has means for supplying an electromotive force to the plurality of solid semiconductor elements in the ink tank as external energy to be converted by the energy converting means. As the electromotive force, electromagnetic induction, heat, light or radiation is possible. Moreover, the above-mentioned ink jet recording apparatus preferably has means for receiving communication from the solid semiconductor element.

When the electromotive force is supplied to the plurality of solid semiconductor elements, it is possible to first supply the electromotive force to a main solid semiconductor element among the two or more solid semiconductor elements from the outside and to the other solid semiconductor element from the main solid semiconductor element. Alternatively, it is possible that the electromotive force is supplied to the plurality of solid semiconductor elements directly from the outside.

In addition, the present invention is a communication system using a solid semiconductor element, which is provided with: a liquid container in which two or more solid semiconductor elements are disposed; an oscillating circuit having an electric conductor coil, information acquiring means for acquiring information on the inside of the container, receiving means for receiving a signal from the outside and information communicating means for communicating information to the outside that are formed in the solid semiconductor element; an external oscillating circuit, which is disposed outside the solid semiconductor element, for generating electricity by electromagnetic induction between the external oscillating circuit and the oscillating circuit of the solid semiconductor element; and external communicating means for bidirectionally communicating between the receiving means and the information communicating means of the solid semiconductor element.

In the communication system of this case, it is preferable that a center of gravity of the solid semiconductor element floating in the liquid, among the two or more solid semiconductor element, is positioned in a part lower than the center of the element, and the element does not rotate in the liquid, in which it floats, and steadily rocks. In addition, a meta center of the solid semiconductor element is always in a position higher than the center of gravity of the solid semiconductor element in the direction of the center of gravity.

If a method of supplying external energy is used in an ink jet recording apparatus, it is sufficient to provide means for supplying an electromotive force to an element as external energy in a recovery position, a return position, a carriage, a head or the like. In addition, if an apparatus having means for supplying an electromotive force is used, a state inside an ink tank can be found without the ink jet recording apparatus, for example, if it is used in a factory or a sales shop, it can be used for inspection or the like (guarantee of quality).

When specific energy is given to the solid semiconductor element of the present invention for attaining the above-mentioned objects from the outside of the element or from the main solid semiconductor element (preferably in a non-contact state), the energy converting means converts the external energy into different energy, and the solid semiconductor element activates the information acquiring means, the discriminating means, the information storing means and the information communicating means by the converted energy. The activated information acquiring means acquires environmental information around the element. The discriminating means then reads information for referring to the acquired information from the information storing means and compares the read stored information and the acquired information to determine the necessity of communication information. Then, if the discriminating means determines that it is necessary to communicate information, it causes the information communicating means to communicate the acquired information to the outside.

In this way, since a function of acquiring surrounding environmental information to communicate it to the outside is incorporated in a semiconductor element of a solid shape, information can be acquired and communicated three-dimensionally. Thus, a direction of communicating information is not limited compared with the case in which a semiconductor element of a flat shape is used. Therefore, surrounding environmental information can be efficiently acquired and communicated to the outside.

In addition, when a plurality of solid semiconductor elements are disposed in a predetermined container to communicate with a plurality of groups of elements with two or more solid semiconductor elements among the plurality of solid semiconductor elements in the predetermined container forming one group, communication is performed with a different communication condition for each of the element groups. As a result, it becomes possible to efficiently performing determination and selection of a pair of elements among the plurality of pairs and communication and control between the elements. Alternatively, each of the plurality of solid semiconductor elements provided in the predetermined container has information for distinction or a memory, and communication is performed by recognizing the information for distinction or distinguishing the information by the memory. Thus, it also becomes possible to efficiently performing determination and selection of a pair of elements among the plurality of pairs and communication and control between the elements.

Moreover, information corresponding to a received signal can be acquired and a determination result of comparison with the stored information can be communicated to the outside together with the acquired information by adding communicating means for receiving a signal from the outside. Thus, it is also possible to bidirectionally exchange signals with an external element.

In addition, more than two solid semiconductor elements of this kind are disposed in an ink tank, and environmental information of the surrounding of the semiconductor solid elements is detected by mutually communicating between the two or more solid elements, and the environmental information is communicated to and displayed in the outside. Thus, it is possible to communicate information on ink contained in the ink tank, a pressure in the tank or the like to, for example, an ink jet recording apparatus in the outside on a real time basis. This is advantageous in controlling, for example, an amount of negative pressure that changes every moment in accordance with ink consumption to stabilize discharge of ink jet.

Moreover, since external energy for activating a solid semiconductor element is supplied in a non-contact state, there is no need to provide an energy source for activating an element in an ink tank or to connect wiring for supplying energy to the element. Thus, the solid semiconductor element can be used in a part where it is difficult to draw around wiring directly connected to the outside.

For example, when energy for activating an element is electricity, an electric conductor coil for an oscillating circuit as an external energy converting means is formed such that it winds itself around an outer surface of the solid semiconductor element. Thus, it is possible to generate electricity in the electric conductor coil by electromagnetic induction between the solid semiconductor element and the external oscillating circuit to supply the electricity to the element in a non-contact state.

In this case, since the coil is wound around the outer surface of the element, the magnitude of the inductance of the coil varies in response to, for example, existence of ink, a residual amount of the ink, ink pH in the ink tank. Therefore, since the oscillating circuit changes an oscillating frequency in response to the variation of the inductance, it is possible to detect a residual amount of the ink in the ink tank based on the variation of the oscillating frequency to be changed.

In addition, the solid semiconductor element has a hollow part for floating in liquid, and is formed such that a center of gravity of the element is positioned lower than the center of the element. Therefore, for example, even if the recording head provided in the ink jet recording apparatus and the ink tank operate serially and ink in the ink tank rocks up and down or left and right, the solid semiconductor element can detect information on the ink or a pressure in the tank with high accuracy while steadily floated in the ink in the ink tank. Moreover, the coil of the oscillating circuit formed in the element is held in a stable position with respect to a coil of the external oscillating circuit to allow stable bidirectional communication at all times.

Further, the term solid in the solid semiconductor element throughout this specification includes all of various solid forms such as a triangular prism, a sphere, a hemisphere, a quadratic prism, a spheroid and an uniaxial body of rotation.

In addition, the term meta center in this specification indicates an intersection of a line of action of weight in balance and a line of action of buoyance force when slanted.

Other features and advantages of the present invention will be apparent from the following description taken in conjunction with the accompanying drawings, in which the same reference characters designate the same or similar parts throughout the figures thereof.

BRIEF DESCRIPTION OF THE DRAWINGS

In the accompanying drawings,

FIGS. 36A, 36B and 36C are diagrams for illustrating reasons for disposing a plurality of solid semiconductor elements;

FIG. 40 is a perspective view showing an example of an ink jet recording apparatus mounted with the ink tank shown in FIGS. 12 to 22 or the like;

DETAILED DESCRIPTION OF THE PREFERRED EMBODIMENTS

Embodiments of the present invention will be described with reference to the drawings.

(First Embodiment)

Figure 1:
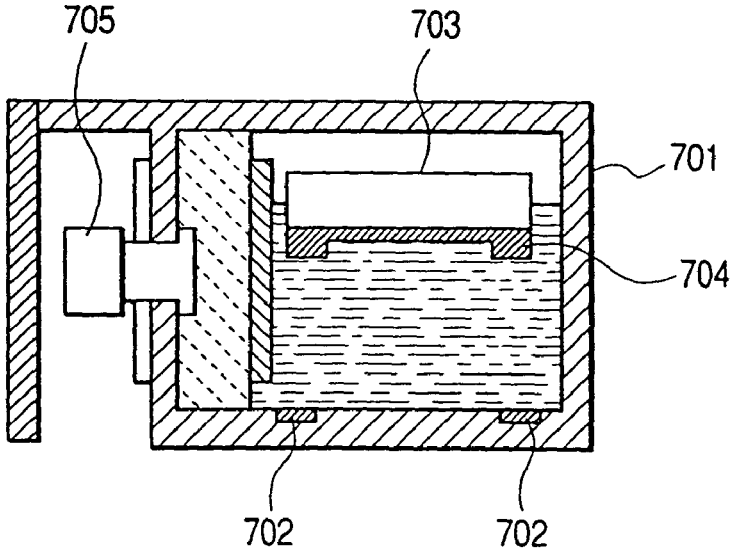
FIG. 1 (PRIOR ART)
FIG. 1 is a view showing an ink residual amount detecting apparatus described in Japanese Patent Application Laid-open No. 6-143607.
Figure 2:
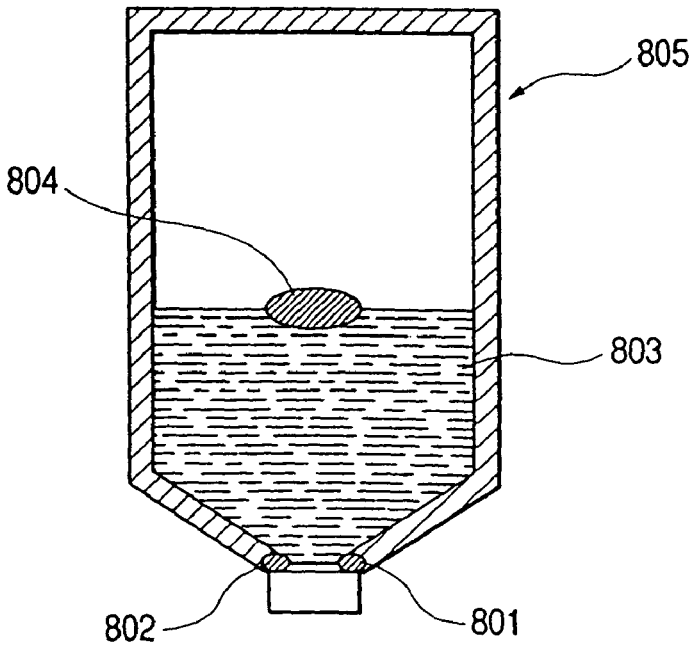
FIG. 2 (PRIOR ART)
FIG. 2 is a view showing an ink residual amount detecting apparatus described in Japanese Patent No. 2947245.
Figure 3:
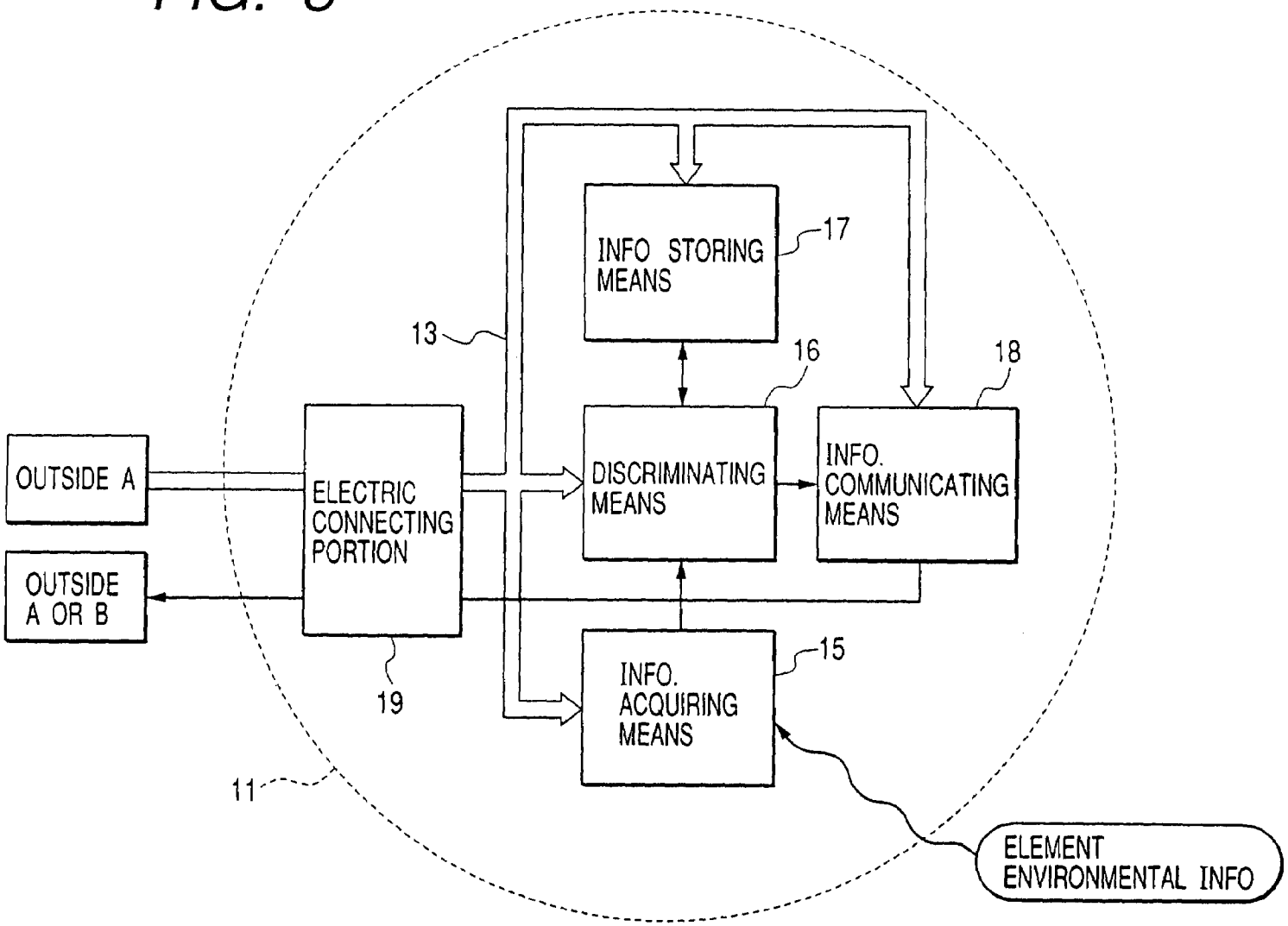
FIG. 3 is a block diagram illustrating an internal configuration and exchanges of information with the outside of a solid semiconductor element of a first embodiment used in an ink tank of the present invention.

FIG. 3 is a block diagram illustrating an internal configuration and exchanges of information with the outside of a solid semiconductor element of a first embodiment used in an ink tank of the present invention. A solid semiconductor element 11 of a form shown in the figure is provided with an electric connecting portion 19 for receiving supply of electricity from the outside A and outputting a signal to the outside A or B, information acquiring means activated by the electricity received by the electric connecting portion 19, discriminating means 16, information storing means 17 and information communicating means 18 and is disposed on an outer wall of the ink tank. In addition, it is desirable that at least the information acquiring means 15 is formed on a surface of the element or in the vicinity of the surface, and the electric connecting portion 19 is formed on a surface opposing it.

The information acquiring means 15 acquires information on the inside of the ink tank that is surrounding environmental information of the element 11. The discriminating means compares the information on the inside of the ink tank acquired from the information acquiring means 15 and information stored in the information storing means 17 to determine whether it is necessary to communicate the acquired information on the inside of the tank to the outside. The information storing means 17 stores conditions for comparing with information on the inside of the tank to be acquired and the information on the inside of the tank acquired from the information acquiring means 15. The information communicating means 18 communicates the information on the inside of the tank to the outside A or B by sending a signal via the electric connecting portion 19 according to an instruction of the discriminating means 16.

Figure 6:
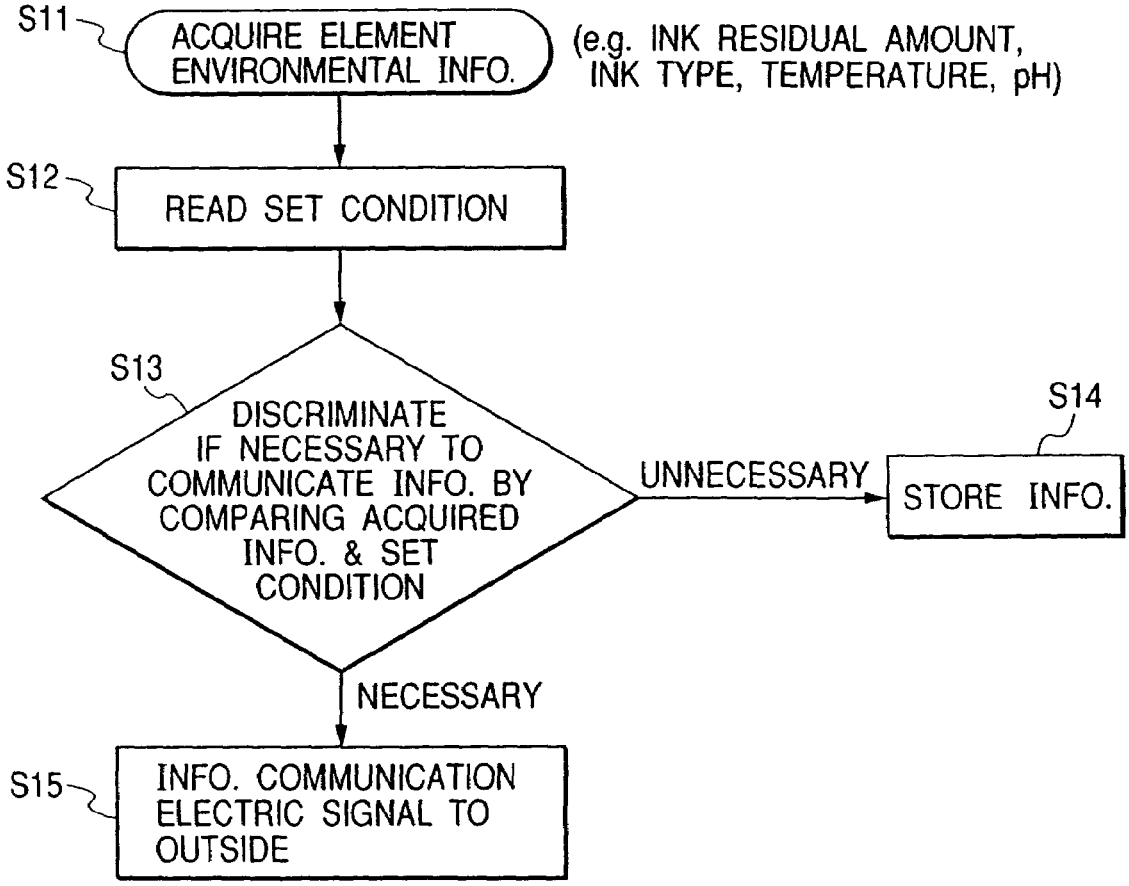
FIG. 6 is a flow chart for describing operations of the element shown in FIG. 3.
Figure 7:
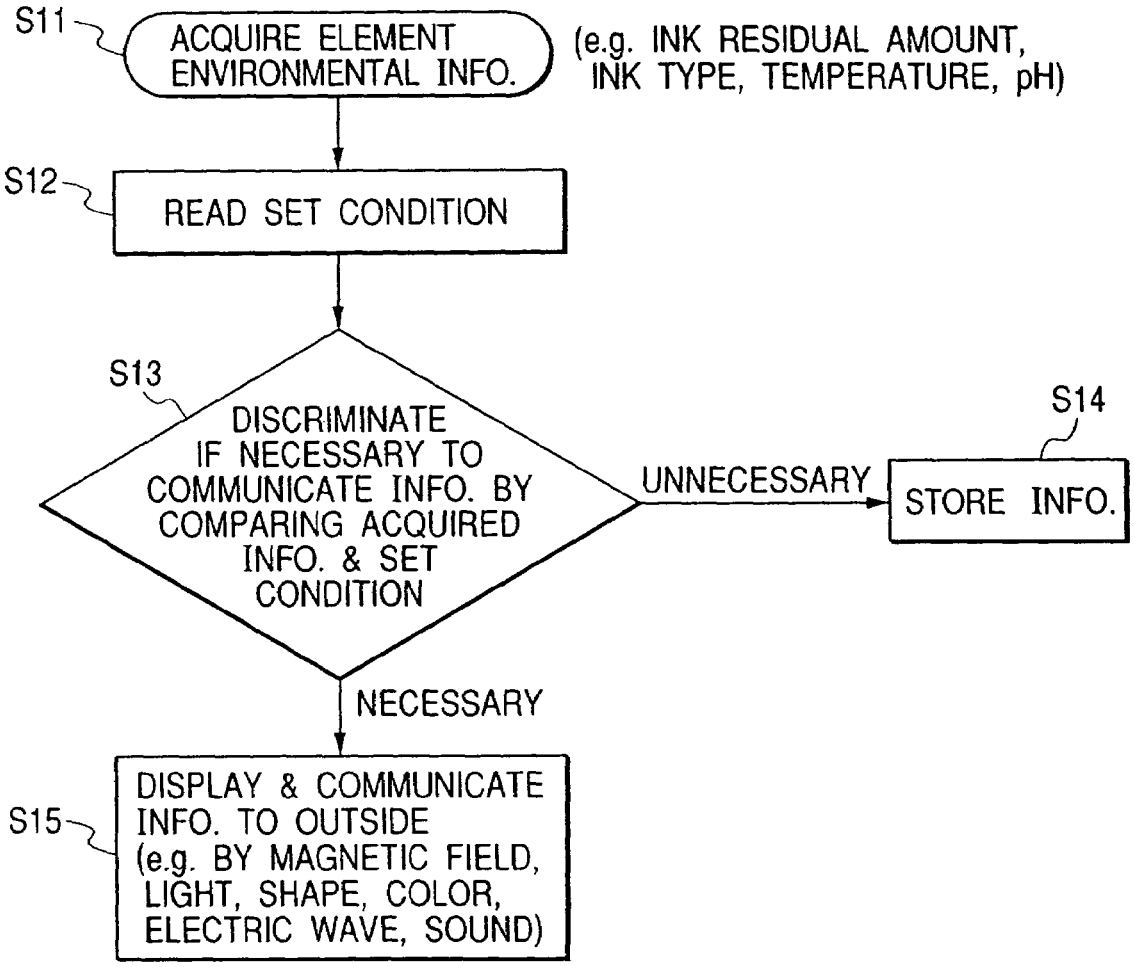
FIG. 7 is a flow chart for describing operations of the element shown in FIG. 5.

FIG. 6 is a flow chart for describing operations of the element shown in FIG. 3. Referring to FIGS. 3 and 7, it is seen that, when electricity 12 is given to the element 11 from the outside A or B, the information acquiring means 15, the discriminating means 16, the information storing means 17 and the information communicating means 18 are activated by the electricity.

The activated information acquiring means 15 acquires information on the inside of the ink tank, which is environmental information around the element, such as a residual amount of ink, a type of ink, temperature and pH (step S11 of FIG. 6). The discriminating means 16 reads conditions for comparing with the acquired information on the inside of the tank from the information storing means 17 (step S12 of FIG. 6), and compares the read conditions and the acquired information on the inside of the tank to determine the necessity of communicating information (step S13 of FIG. 6). Here, as an example of determination based on conditions set in advance in the information storing means 17, it is determined that replacement of a tank is required because the ink residual amount is reduced to two milliliters or less or pH of the ink changes significantly.

If the discriminating means 16 determines that it is not necessary to communicate the information on the inside of the tank to the outside in step S13, present information on the inside of the ink tank is stored in the information storing means 17 (step S14 of FIG. 6). This stored information may be compared with the information acquired by the information acquiring means 15 in the discriminating means 16 next.

In addition, if the discriminating means 16 determines that it is necessary to communicate the information on the inside of the tank to the outside in step S13, a signal is outputted from the information communicating means 18 and communicated to the outside. For example, if it is determined that the ink residual amount is reduced to two milliliters or less, the information communicating means 18 outputs an electric signal and communicates to the ink jet recording apparatus that replacement of the tank is necessary (step S15 of FIG. 6).

If the element is used in an ink jet recording apparatus, it is sufficient to provide means for supplying electricity to the device and receiving a signal in a recovery position, a return position, a carriage, a head or the like. Besides, if an apparatus having connecting means is used, a state inside the ink tank can be found without the ink jet recording apparatus, and for example, if it is used in a factory or a sales shop, it can be used for inspection or the like (guarantee of quality).

According to this embodiment, since information acquired by the information acquiring means can be acquired as an electric signal if one part is connected, excess installation of wiring is unnecessary and a state of ink can be grasped on a real time basis with a simple configuration.

(Second Embodiment)

Figure 4:
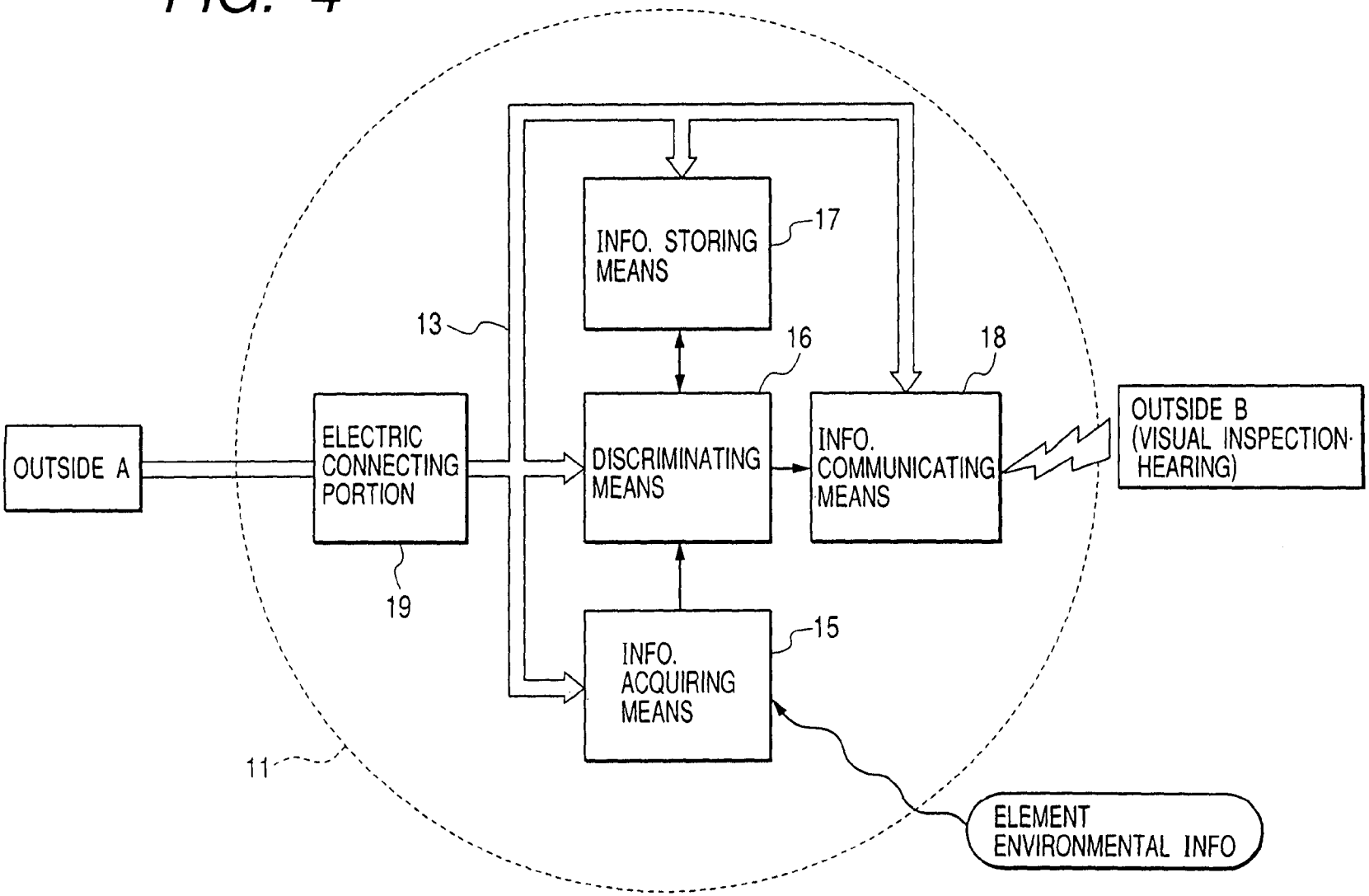
FIG. 4 is a block diagram illustrating an internal configuration and exchanges of information with the outside of a solid semiconductor element of a second embodiment used in the ink tank of the present invention.

FIG. 4 is a block diagram illustrating an internal configuration and exchanges of information with the outside of a solid semiconductor element of a second embodiment used in the ink tank of the present invention.

In FIG. 4, the information communicating means 18 converts electricity to energy for communicating information on the inside of the tank according to an instruction of the discriminating means 16 to display and communicate the information on the inside of the tank to the outside B.

Electricity is converted into energy for communicating information on the inside of the ink tank to the outside by the information communicating means 18. As the energy for this communication, a magnetic field, light, a shape, a color, an electric wave, sound or the like can be used. For example, if it is determined that an ink residual amount is reduced to two milliliters or less, the information communicating means 18 emits sound to communicate to the ink jet recording apparatus that replacement of the tank is necessary. In addition, information is not only communicated to the ink jet recording apparatus but may be communicated for visual inspection and hearing if the information is communicated by light, a shape, a color, sound or the like in particular. Moreover, a method of communicating may be changed according to information. For example, if it is determined that the ink residual amount is reduced to two milliliters or less, the information is communicated by sound, and if it is determined that pH of the ink varies significantly, the information is communicated by light.

According to this embodiment, since the element has means for directly communicating information, it is sufficient to supply electricity only, and excess electric wiring is unnecessary. Thus, it becomes possible to simply and accurately grasp a state of ink on a real time basis.

(Third Embodiment)

Figure 5:
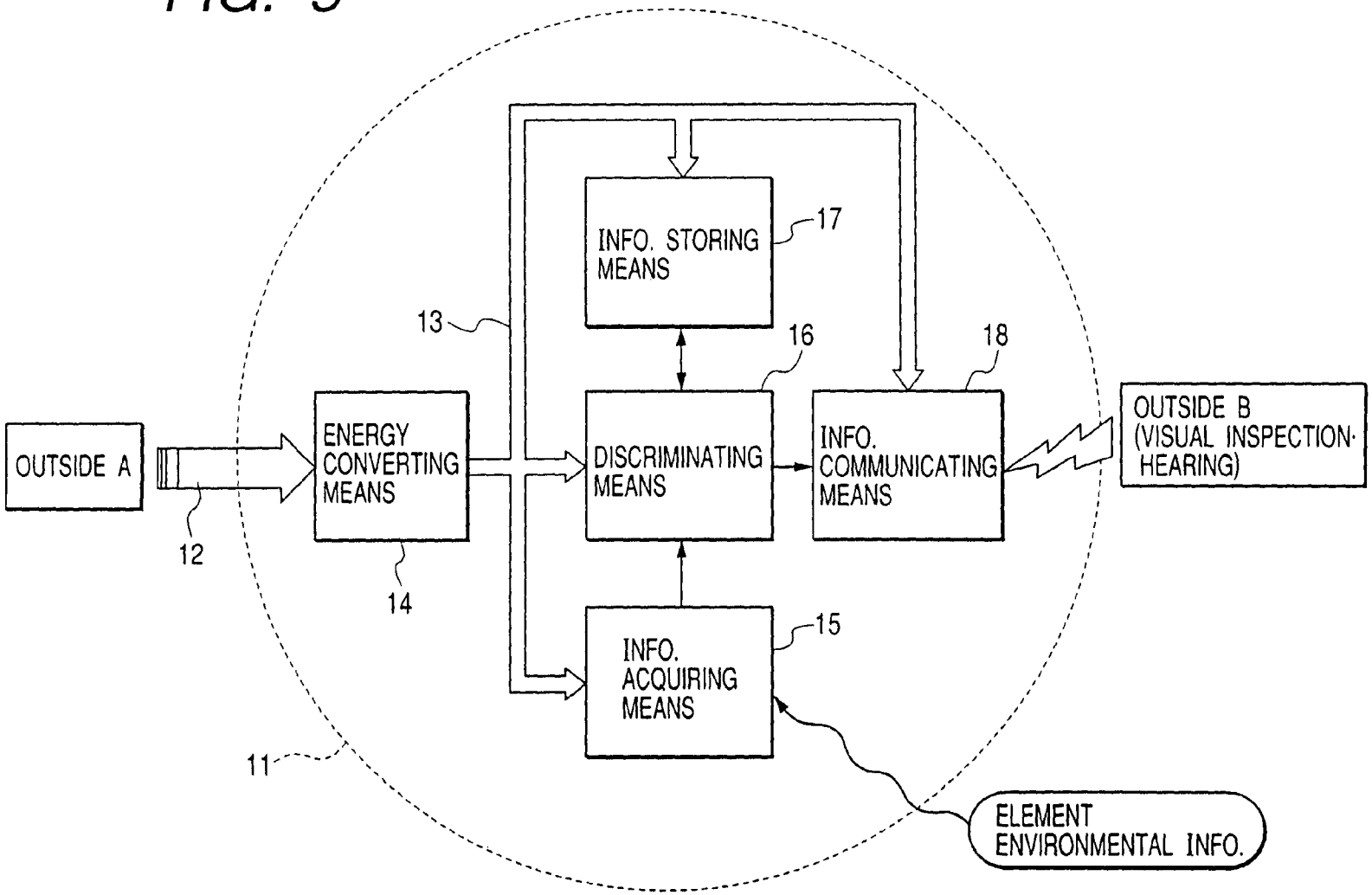
FIG. 5 is a block diagram illustrating an internal configuration and exchanges of information with the outside of a solid semiconductor element of a third embodiment used in the ink tank of the present invention.

FIG. 5 is a block diagram illustrating an internal configuration and exchanges of information with the outside of a solid semiconductor element of a third embodiment used in the ink tank of the present invention. The solid semiconductor element 11 of a form shown in this figure is provided with an energy converting means 14 for converting an electromotive force 12 supplied from the outside A to the element 11 on a non-contact state into electricity 13, the information acquiring means 15 to be activated by the electricity acquired by the energy converting means 14, the discriminating means 16, the information storing means 17 and the information communicating means 18 and is disposed on an outer wall inside an ink tank. As the electromotive force to be supplied for activating the element, electromagnetic induction, heat, light radiation or the like can be applied. In addition, at least the energy converting means 14 and the information acquiring means 15 are desirably formed on a surface of the element or in the vicinity of the surface.

The information acquiring means 15 acquires information on inside the ink tank which is surrounding environmental information of the element 11. The discriminating means 16 compares the information on the inside of the tank acquired from the information acquiring means 15 and information stored in the information storing means 17 to determine if it is necessary to communicate the acquired information on the inside of the tank to the outside. The information storing means 17 stores conditions for comparing with information on the inside of the tank to be acquired and the information on the inside of the tank which is acquired from the information acquiring means 15. The information communicating means 18 converts electricity into energy for communicating the information on inside the tank according to an instruction of the discriminating means 16 to display and communicate the information on the inside of the tank on or to the outside B.

FIG. 7 is a flow chart for describing operations of the device shown in FIG. 5. Referring to FIGS. 5 and 7, it is seen that when the electromotive force 12 is given from the outside A toward the element 11, the energy converting means 14 converts the electromotive force 12 into the electricity 13 and activates the information acquiring means 15, the discriminating means 16, the information storing means 17 and the information communicating means 18 by the electricity.

The activated information acquiring means 15 acquires information on the inside of the ink tank, which is environmental information around the element, such as an ink residual amount, a type of ink, temperature and pH (step S11 of FIG. 7). The discriminating means 16 then reads the acquired information on the inside of the tank and the conditions for comparing from the information storing means 17 (step S12 of FIG. 7) and compares the read conditions with the acquired information on the inside of the tank to determine the necessity of communicating the information (step S13 of FIG. 7). Here, as an example of the determination based on conditions set in advance in the information storing means 17, it is determined that replacement of a tank is required because the ink residual amount is reduced to two milliliters or less or pH of the ink changes significantly.

If the discriminating means 16 determines that it is unnecessary to communicate the information on the inside of the tank to the outside in step S13, present information on the inside of the tank is stored in the information storing means 17 (step S14 of FIG. 7). This stored information may be compared with the information acquired by the information acquiring means 15 next by the discriminating means 16.

In addition, if the discriminating means 16 determines that it is necessary to communicate the information on the inside of the tank to the outside in step S13, the electricity acquired by the energy conversion is converted into energy for communicating the information on the inside of the ink tank to the outside in the information communicating means 18. As the energy for this communication, a magnetic field, light, a shape, a color, an electric wave, sound or the like can be used. For example, if it is determined that an ink residual amount is reduced to two milliliters or less, the information communicating means 18 emits sound to communicate to the ink jet recording apparatus that replacement of the tank is necessary (step S15 of FIG. 7). In addition, information is not only communicated to the ink jet recording apparatus but may be communicated for visual inspection and hearing if the information is communicated by light, a shape, a color, sound or the like in particular. Moreover, a method of communicating may be changed according to information. For example, if it is determined that the ink residual amount is reduced to two milliliters or less, the information is communicated by sound, and if it is determined that pH of the ink varies significantly, the information is communicated by light.

If the element is used in an ink jet recording apparatus, it is sufficient to provide means for supplying electricity to the device as external energy in a recovery position, a return position, a carriage, a head or the like. Besides, if an apparatus having means for supplying electromotive force is used, a state inside the ink tank can be found without the ink jet recording apparatus, and for example, if it is used in a factory or a sales shop, it can be used for inspection or the like (guarantee of quality).

According to this embodiment, since the element has the energy converting means, it becomes unnecessary to set electric wiring directly with the outside. Thus, the element can be used in a part where it is difficult to set wiring directly connected to the outside, or in any part in an object such as an inner wall of an ink tank shown in FIGS. 12 to 22. In addition, it becomes possible to accurately grasp a state of ink on a real time basis.

In addition, since the element has the energy converting means, it becomes unnecessary to dispose means for storing electromotive force for activating the element (a power source in this example). Thus, the element can be miniaturized and can be used in a narrow part, or in any part inside an object such as on an inner wall of an ink tank as shown in FIGS. 12 to 22. Further, although electromotive force is supplied in a non-contact state in this embodiment, electromotive force may be supplied temporarily in a contact state with the outside and, then, in a non-contact state with the outside.

(Fourth Embodiment)

Figure 8:
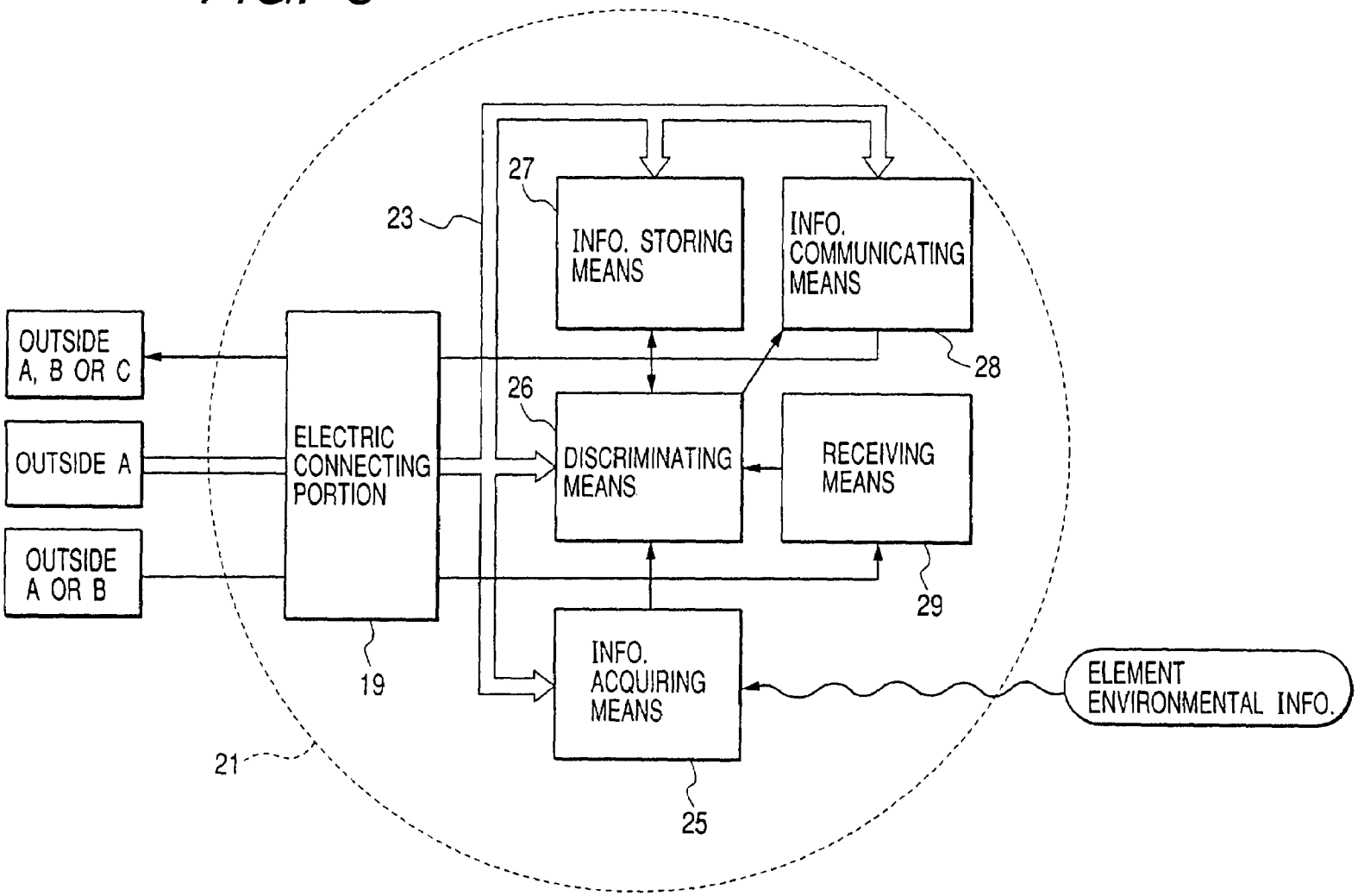
FIG. 8 is a block diagram illustrating an internal configuration and exchanges of information with the outside of a solid semiconductor element of a fourth embodiment used in the ink tank of the present invention.

FIG. 8 is a block diagram illustrating an internal configuration and exchanges of information with the outside of a solid semiconductor element of a fourth embodiment used in the ink tank of the present invention. A solid semiconductor element 21 of a form shown in this figure is provided with the electric connecting portion 19 for receiving supply of electricity from the outside A and receiving a signal from the outside A or B and further outputting a signal to the outside A, B or C, information acquiring means 25 to be activated by the electricity received by the electric connecting portion 19, discriminating means 26, information storing means 27, information communicating means 28 and receiving means 29 and is disposed on an outer wall of the ink tank. The ink tank is different from those in the first to third embodiments in that it has a receiving function. In addition, at least the information acquiring means 25 and the receiving means 29 are desirably formed on a surface of the element or in the vicinity of the surface, and the electric connecting portion 19 is desirably formed on a surface opposing it.

The information acquiring means 25 acquires information on the inside of the ink tank which is surrounding environmental information of the element 21. The receiving means 29 receives an input signal 20 from the outside A or B. The discriminating means 26 causes the information acquiring means 25 to acquire the information on the inside of the tank in response to the input signal from the receiving means 29, compares the acquired information on the inside of the tank and information stored in the information storing means 27, and determines if the acquired information on the inside of the tank meets predetermined conditions. The information storing means 27 stores conditions for comparing with information on the inside of the tank to be acquired and the information on the inside of the tank acquired from the information acquiring means 25. The information communicating means 28 communicates the information on the inside of the tank to the outside A, B or C by sending a signal via the electric connecting portion 19 according to an instruction of the discriminating means 26.

According to this embodiment, since the element has a function of receiving a signal from the outside, it becomes possible to answer questions by means of signals of various kinds from the outside in addition to the effect by the first embodiment, and information can be exchanged between the element and the outside.

(Fifth Embodiment)

Figure 9:
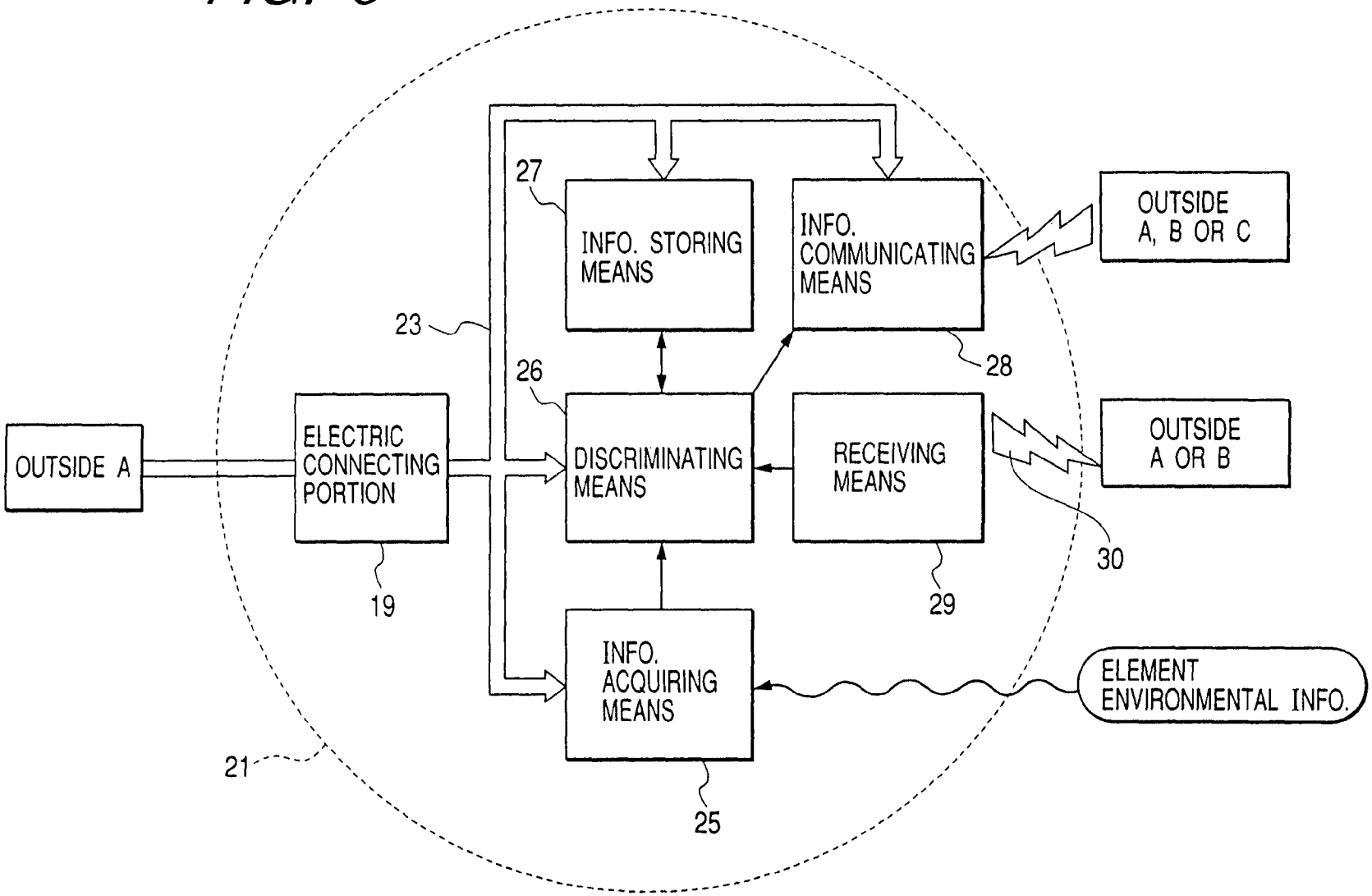
FIG. 9 is a block diagram illustrating an internal configuration and exchanges of information with the outside of a solid semiconductor element of a fifth embodiment used in the ink tank of the present invention.

FIG. 9 is a block diagram illustrating an internal configuration and exchanges of information with the outside of a solid semiconductor element of a fifth embodiment used in the ink tank of the present invention. In FIG. 9, the information communicating means 18 converts electricity into energy for communicating information on the inside of the tank according to an instruction of the discriminating means 16 to display the information on the inside of the tank or communicate the information to the outside B.

Electricity is converted into energy for communicating information on the inside of the ink tank to the outside by the information communicating means 18. As the energy for this communication, a magnetic field, light, a shape, a color, an electric wave, sound or the like can be used. For example, if it is determined that an ink residual amount is reduced to two milliliters or less, the information communicating means 18 emits sound to communicate to the ink jet recording apparatus that replacement of the tank is necessary. In addition, information is not only communicated to the ink jet recording apparatus but may be communicated for visual inspection and hearing if the information is communicated by light, a shape, a color, sound or the like in particular. Moreover, a method of communicating may be changed according to information. For example, if it is determined that the ink residual amount is reduced to two milliliters or less, the information is communicated by sound, and if it is determined that pH of the ink varies significantly, the information is communicated by light.

According to this embodiment, since the element has a function of receiving a signal from the outside, it becomes possible to answer questions by means of signals of various kinds from the outside in addition to the effect by the second embodiment, and information can be exchanged between the element and the outside.

(Sixth Embodiment)

Figure 10:
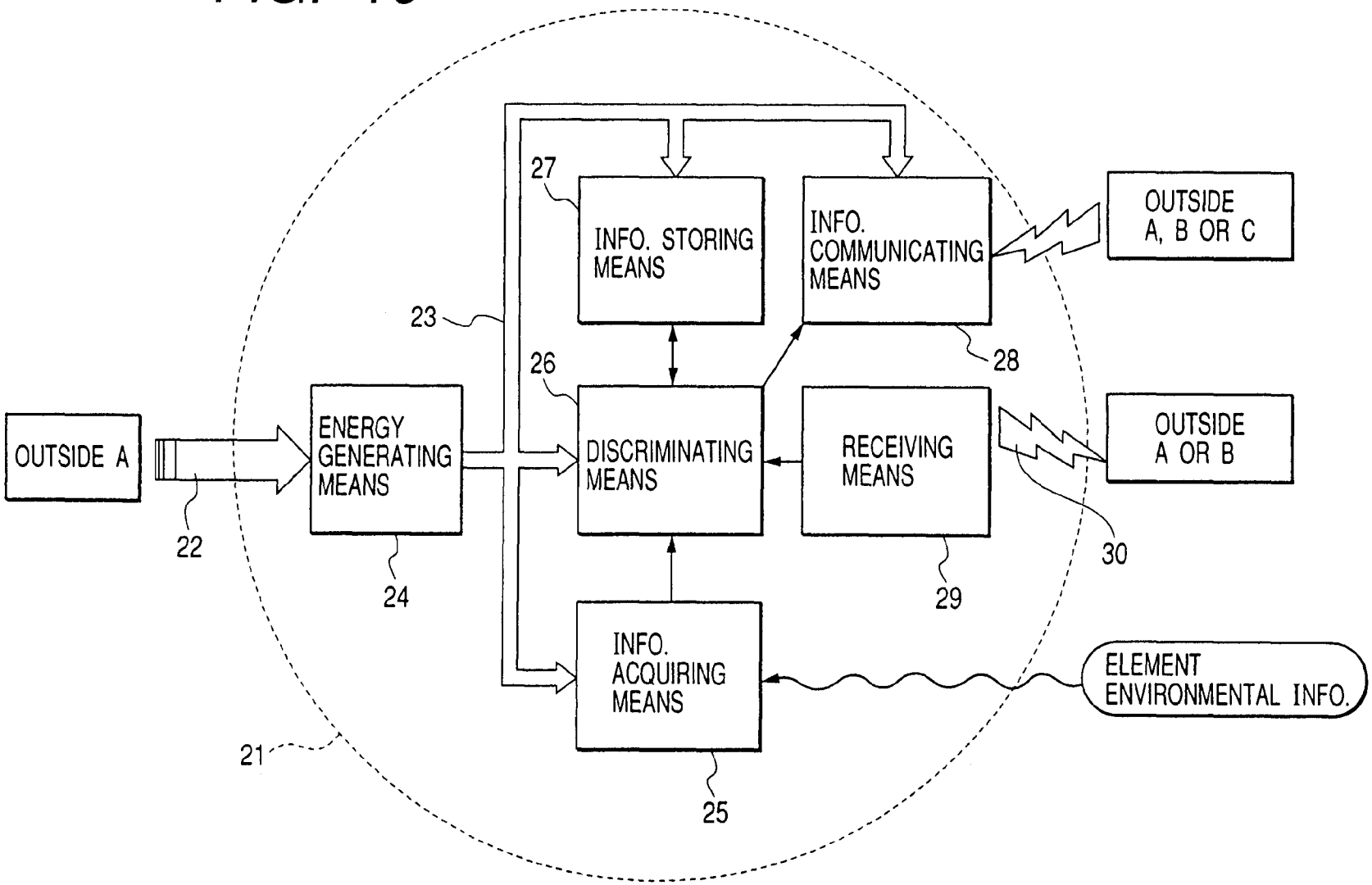
FIG. 10 is a block diagram illustrating an internal configuration and exchanges of information with the outside of a solid semiconductor element of a sixth embodiment used in the ink tank of the present invention.

FIG. 10 is block diagram illustrating an internal configuration and exchanges of information with the outside of a solid semiconductor element of a sixth embodiment used in the ink tank of the present invention. A solid semiconductor element 21 of a form shown in this figure is provided with an energy converting means 24 for converting an electromotive force 22 supplied from the outside A to the element 21 on a non-contact state into electricity 23, the information acquiring means 25 to be activated by the electricity acquired by the energy converting means 24, the discriminating means 26, the information storing means 27, the information communicating means 28 and the receiving means 29 and is disposed in the ink tank. The element is different from that of the first embodiment in that it has a receiving function. As the electromotive force to be supplied for activating the element, electromagnetic induction, heat, light, radiation or the like can be applied. In addition, at least the energy converting means 24, the information acquiring means 25, and the receiving means 29 are desirably formed on a surface of the element or in the vicinity of the surface.

The information acquiring means 25 acquires information on the inside of the ink tank which is surrounding environmental information of the element 21. The receiving means 29 receives an input signal 30 from the outside A or B. The discriminating means 26 causes the information acquiring means 25 to acquire the information on the inside of the tank in response to the input signal from the receiving means 29, compares the acquired information on the inside of the tank and information stored in the information storing means 27, and determines if the acquired information on the inside of the tank meets predetermined conditions. The information storing means 27 stores conditions for comparing with information on the inside of the tank to be acquired and the information on the inside of the tank acquired from the information acquiring means 25. The information communicating means 28 converts electricity to energy for communicating the information on the inside of the tank according to an instruction of the discriminating means 26, and displays or communicates a determination result by the discriminating means 26 on or to the outside A, B or C.

Figure 11:
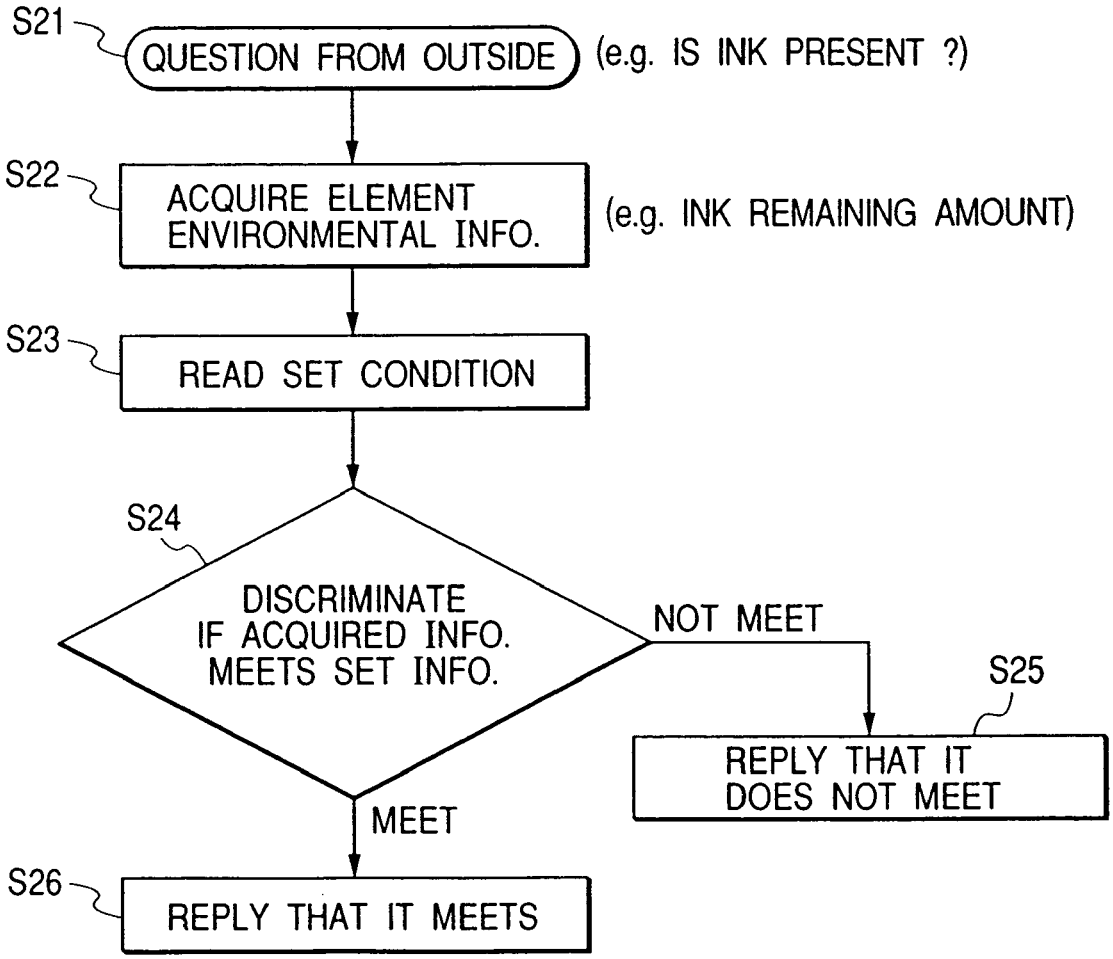
FIG. 11 is a flow chart describing operations of the element shown in FIG. 10.

FIG. 11 is a flow chart describing operations of the element shown in FIG. 10. Referring to FIGS. 10 and 11, it is seen that when the electromotive force 22 is given from the outside A toward the element 21, the energy converting means 24 converts the electromotive force 22 into the electricity 23 and activates the information acquiring means 25, the discriminating means 26, the information storing means 27, the information communicating means 28 and the receiving means 29 by the electricity.

In this state, the signal 30 for inquiring about the information on the inside of the ink tank is sent from the outside A or B to the element 21. This input signal 30 is a signal for inquiring the element, for example, if ink is still left in the ink tank and is received by the receiving means 29 (step S21 of FIG. 11). Then, the discriminating means 26 causes the information acquiring means 25 to acquire information on the inside of the ink tank such as an ink residual amount, a type of ink, temperature and pH (step S22 of FIG. 11) and reads conditions for comparing with the acquired information on the inside of the tank from the information storing means 27 (step S23 of FIG. 11) to determine if the acquired information on the inside of the tank meets set conditions (step S24 of FIG. 11).

If the discriminating means 26 determines that the acquired information does not meet the set conditions in step S24, it communicates that effect, and if the discriminating means 26 determines that the acquired information meets the set conditions, it communicates that effect to the outside A, B or C (steps S25 and S26). At this point, the acquired information may be communicated together with the determination result. This communication is performed by converting electricity acquired by energy conversion into energy for communicating the information on the inside of the ink tank to the outside by the information communicating means 28. As the energy for this communication, a magnetic field, light, a shape, a color, an electric wave, sound or the like can be used, which may be changed in response to the determination result. In addition, the method of communication may be changed according to contents of questions to be answered (e.g., if the ink residual amount is two milliliter or less, if pH of the ink changes, or the like).

Further, electromotive force may be given to the element 21 together with the input signal 30 form the outside A or B, and a signal may be given according to a purpose for using it. For example, if the electromotive force is electromagnetic induction, a signal for inquiring about an ink residual amount is given, and if the electromotive force is light, a signal for inquiring about pH is given.

According to this embodiment, since the element has a function of receiving a signal from the outside, it becomes possible to answer questions by means of signals of various kinds from the outside in addition to the effect by the first embodiment, and information can be exchanged between the element and the outside.

(Examples of a Configuration of an Ink Tank)

Examples of a configuration of an ink tank, to which the solid semiconductor element of the above-mentioned embodiments are applied, are shown in FIGS. 12 to 22.

Figure 12:
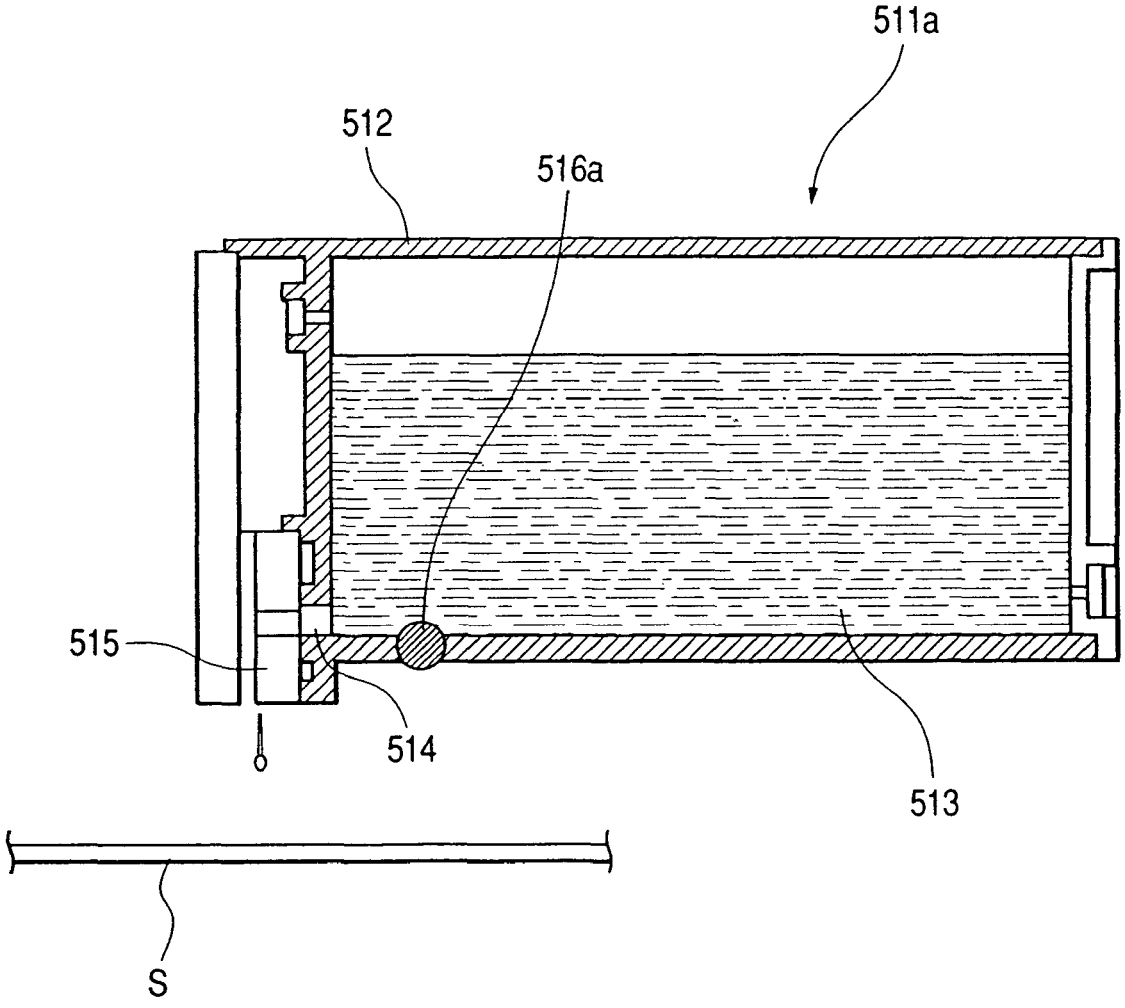
FIG. 12 is a view showing an ink tank using a solid semiconductor element of an example of the present invention.

An ink tank 511*a* shown in FIG. 12 has a housing 512 for containing ink 513 and is provided with an ink supply port 514 on its outer wall. An ink jet head 515 for making a record by discharging and applying the ink 513 supplied from the ink supply port 514 on a recording sheet S is attached on the outer wall provided with the ink supply port 514.

Figure 13:
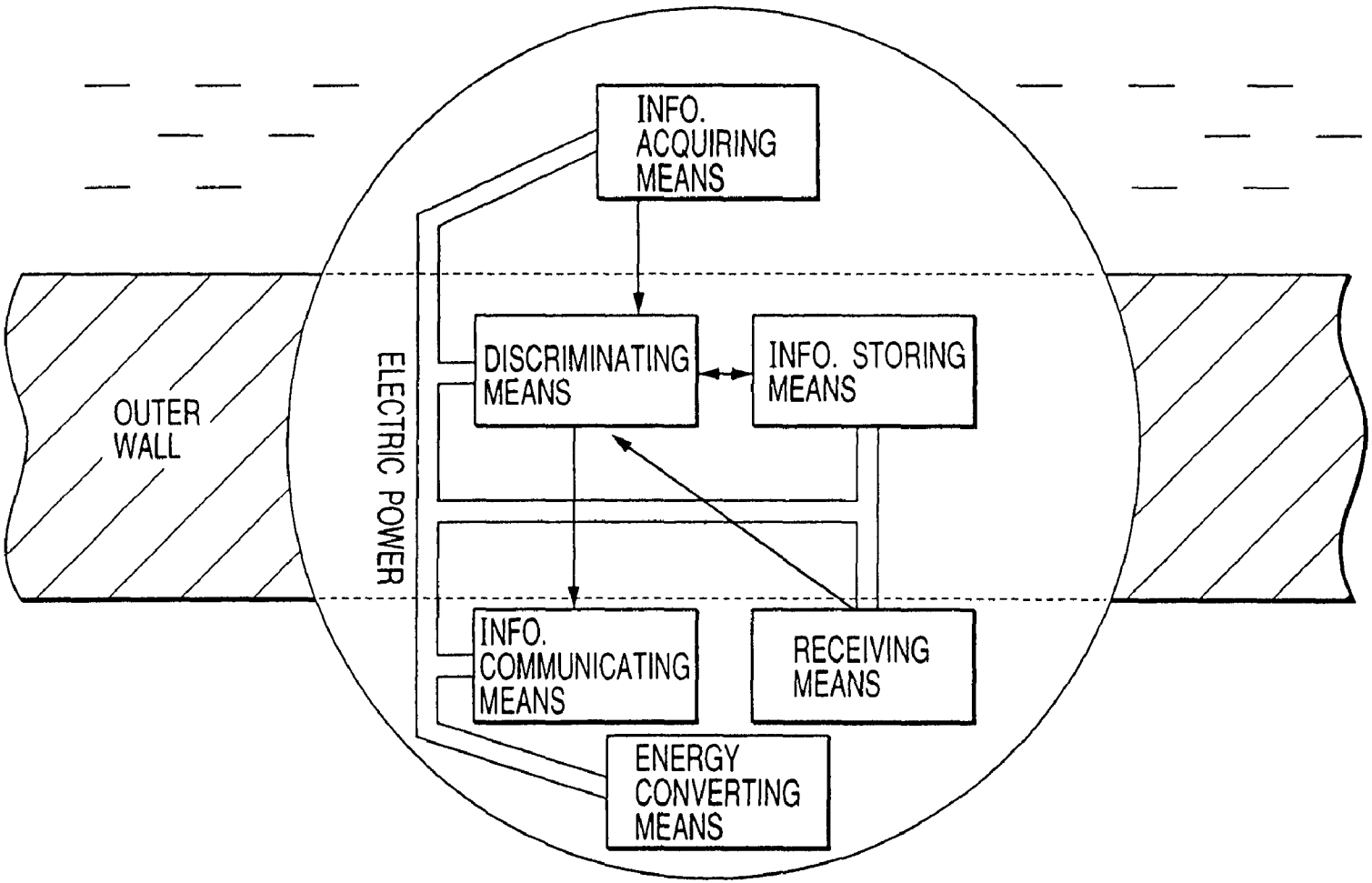
FIG. 13 is an enlarged view of the solid semiconductor element part of the ink tank of FIG. 12.

A solid semiconductor element 516*a* is disposed on a bottom part of the ink tank 511*a* while being embedded in the outer wall. In this case, the solid semiconductor element 516*a* can be disposed such that a part of it is exposed in the ink tank 511*a* and the other side is exposed to the outside. An enlarged view of the solid semiconductor element part is shown in FIG. 13. The part of the solid semiconductor element 516*a* exposed inside the ink tank 511*a* is a part contacting the ink, and information acquiring means for detecting presence of ink can be preferably disposed in this part. That is, for example, a mechanism for detecting a residual amount of ink from variations of a resistance value caused by the ink contacting the mechanism can be provided a the information acquiring means, or a pH sensor can be formed on the surface of the element to be made the information acquiring means. In addition, information communicating means, receiving means and energy converting means are disposed on the part exposed to the outside of the ink tank 511*a*. Thus, information and energy can be efficiently exchanged with the outside without being blocked by the outer wall of the ink tank 511*a*.

With such a configuration, for example, the discriminating means compares the information acquired by the information acquiring means and the information stored in the information storing means, whereby it becomes possible to emit a signal such as an electric wave from the information communicating means to the recording apparatus when the discriminating means determines that ink is exhausted.

Figure 14:
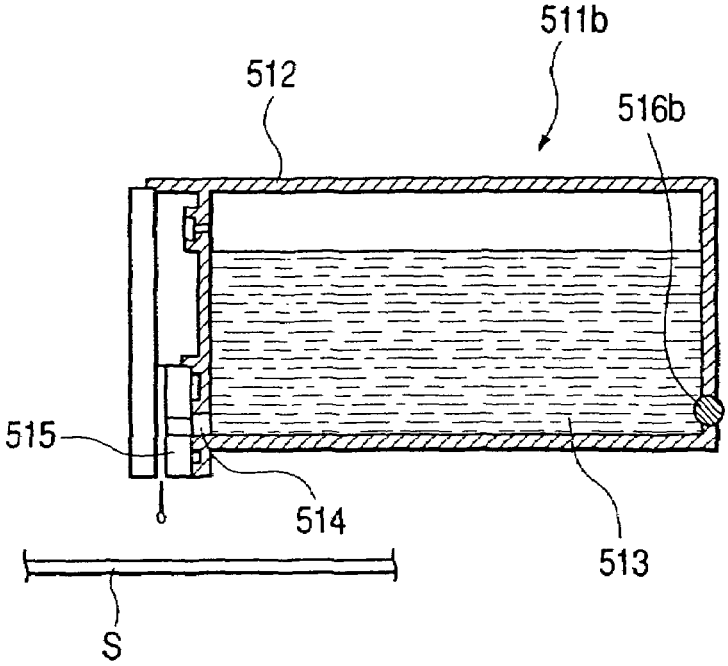
FIG. 14 is a view showing an ink tank of another example using a solid semiconductor element.

An ink tank 511*b* shown in FIG. 14 has a configuration substantially the same as that of the ink tank shown in FIG. 12, in which a solid semiconductor element 516*b* is disposed on an outer wall in a side part such that its part exposed to the outside can be seen by a user. With this configuration, information acquiring means for detecting presence of ink can be disposed in a part exposed to the inside of the solid semiconductor element 516*b*, and information communicating means for emitting, for example, light and sound can be preferably disposed in a part exposed to the outside. By disposing such an information communicating means, the user can directly confirm a signal from the information communicating means of the solid semiconductor element 516*b*.

Figure 15:
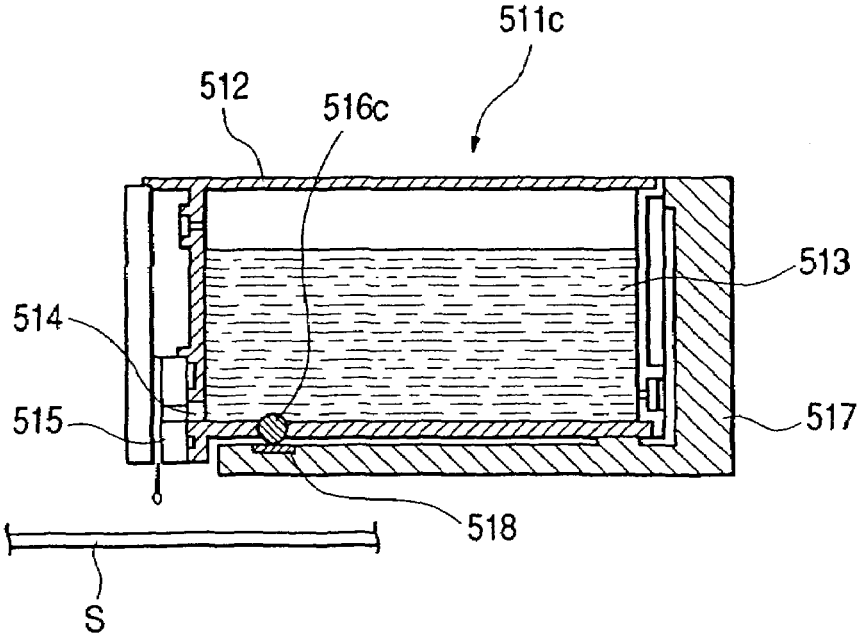
FIG. 15 is a view showing an ink tank of another example using a solid semiconductor element.
Figure 16:
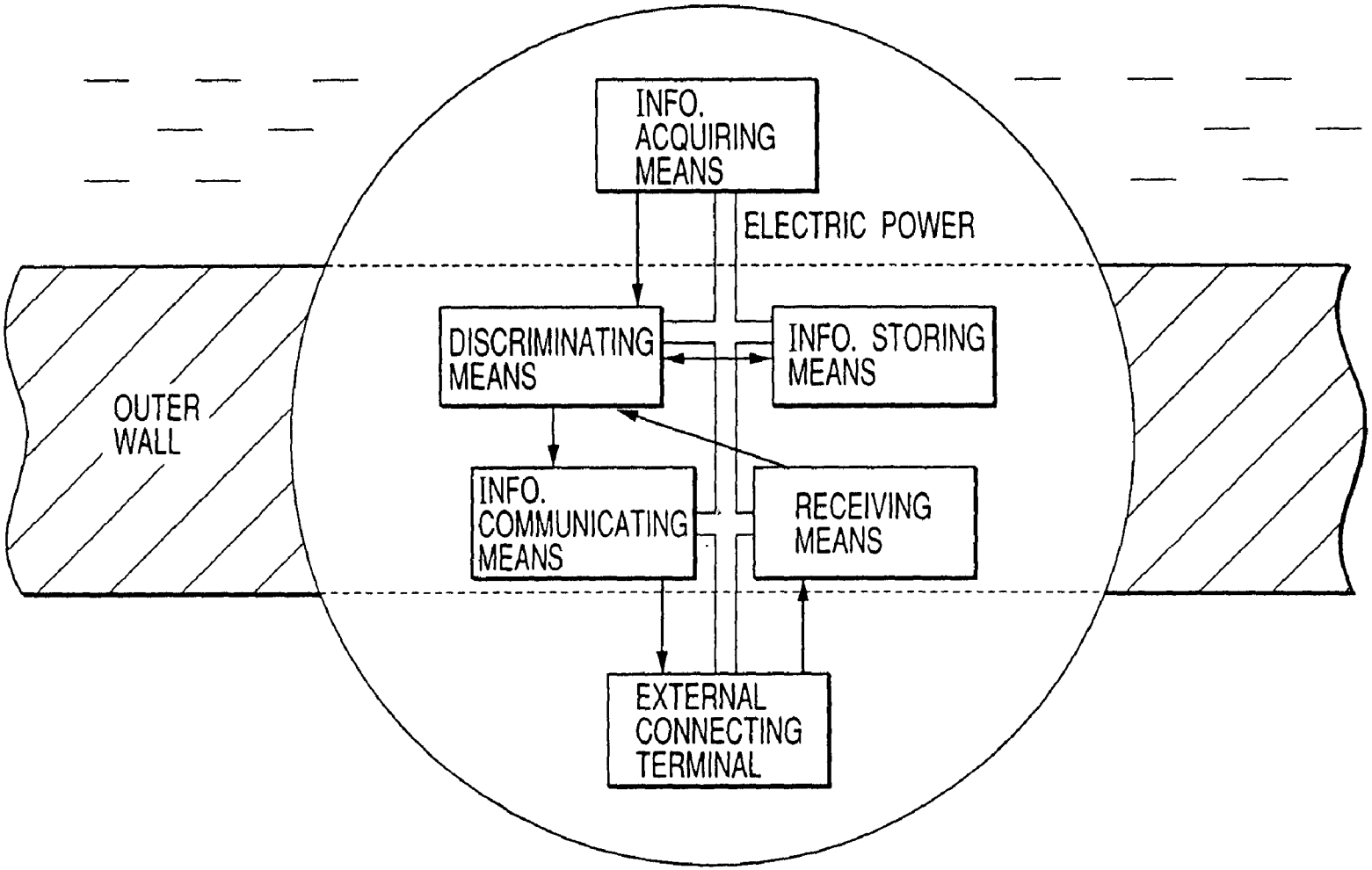
FIG. 16 is an enlarged view of the solid semiconductor element part of the ink tank of FIG. 15.

An ink tank 511*c* shown in FIG. 15 has a configuration substantially the same as those in FIGS. 12 and 14, and can be mounted on a carriage 517. In this ink tank 511*c*, a solid semiconductor element 516*c* is disposed in a part contacting the carriage 517 on its outer wall. FIG. 16 shows an enlarged view of the solid semiconductor element part. A terminal for connection 518 is disposed in a position opposing the solid semiconductor element 516*c* on the carriage 517. Thus, information acquiring means for detecting presence of ink or the like can be disposed in the part exposed to the inside of the solid semiconductor element 516*c* as in the examples of FIGS. 12 and 14, and an electric connecting portion can be disposed in the part exposed to the outside.

In this way, when the ink tank 511*c* is attached to the carriage 517, the electric connecting portion of the solid semiconductor element 516*c* is connected to the terminal for connection 518 on the carriage, whereby, for example, a power source can be supplied to the solid semiconductor element 516*c* and signals can be exchanged via the connecting portion. In this case, the solid semiconductor element 516*c* can be made to be exposed from the outer wall relatively largely. Thus, it is easy to make the electric connecting portion of the solid semiconductor element 516*c* to be steadily connected to the terminal for connection 518 of the carriage 517, and highly credible connection can be performed.

Figure 17:
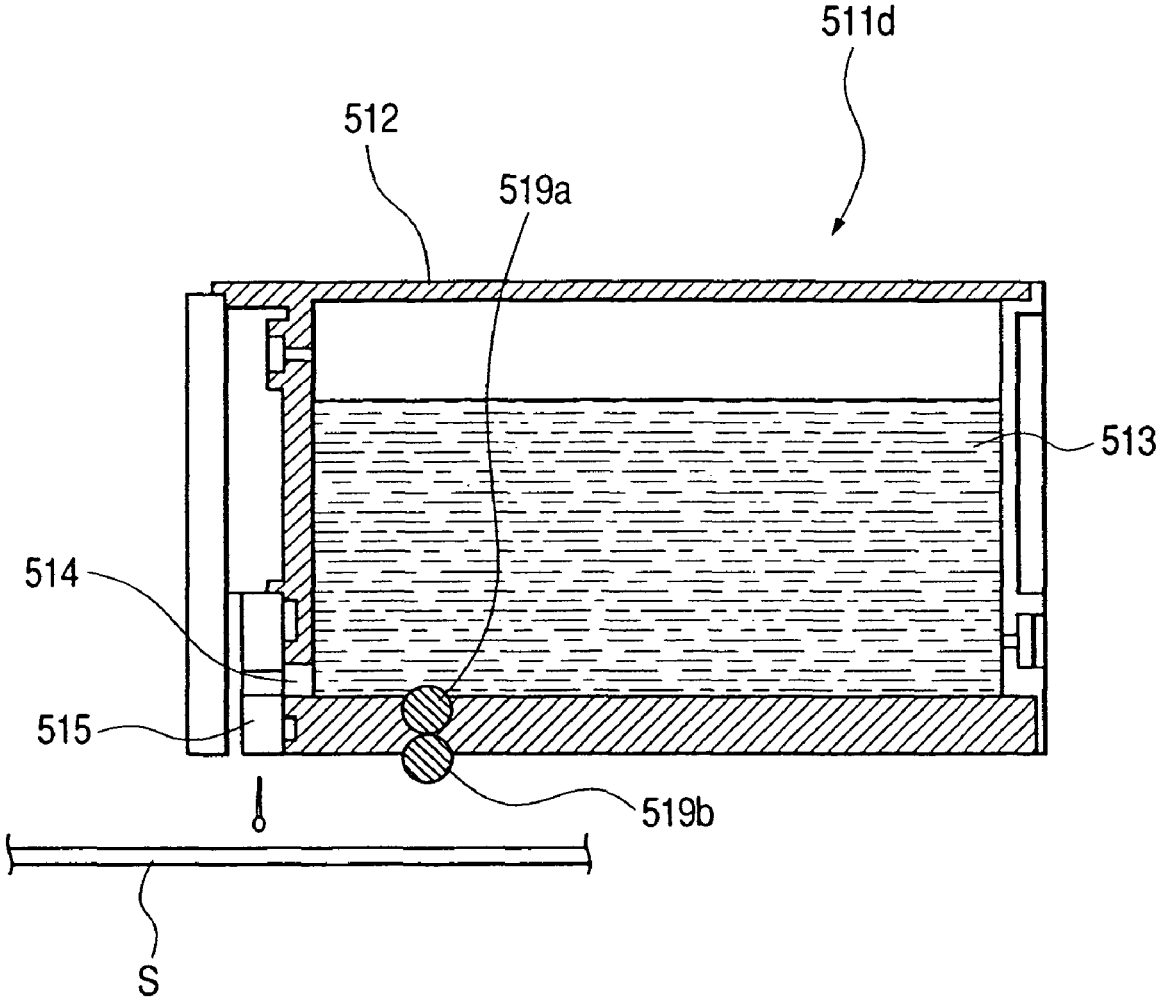
FIG. 17 is a view showing an ink tank of another example using a solid semiconductor element.

Although the examples of FIGS. 12 to 15 show a single solid semiconductor element is disposed on the outer wall of the ink tank, a plurality of solid semiconductor elements may be disposed. FIG. 17 shows an ink tank 511*d* in which two solid semiconductor elements are disposed.

Figure 18:
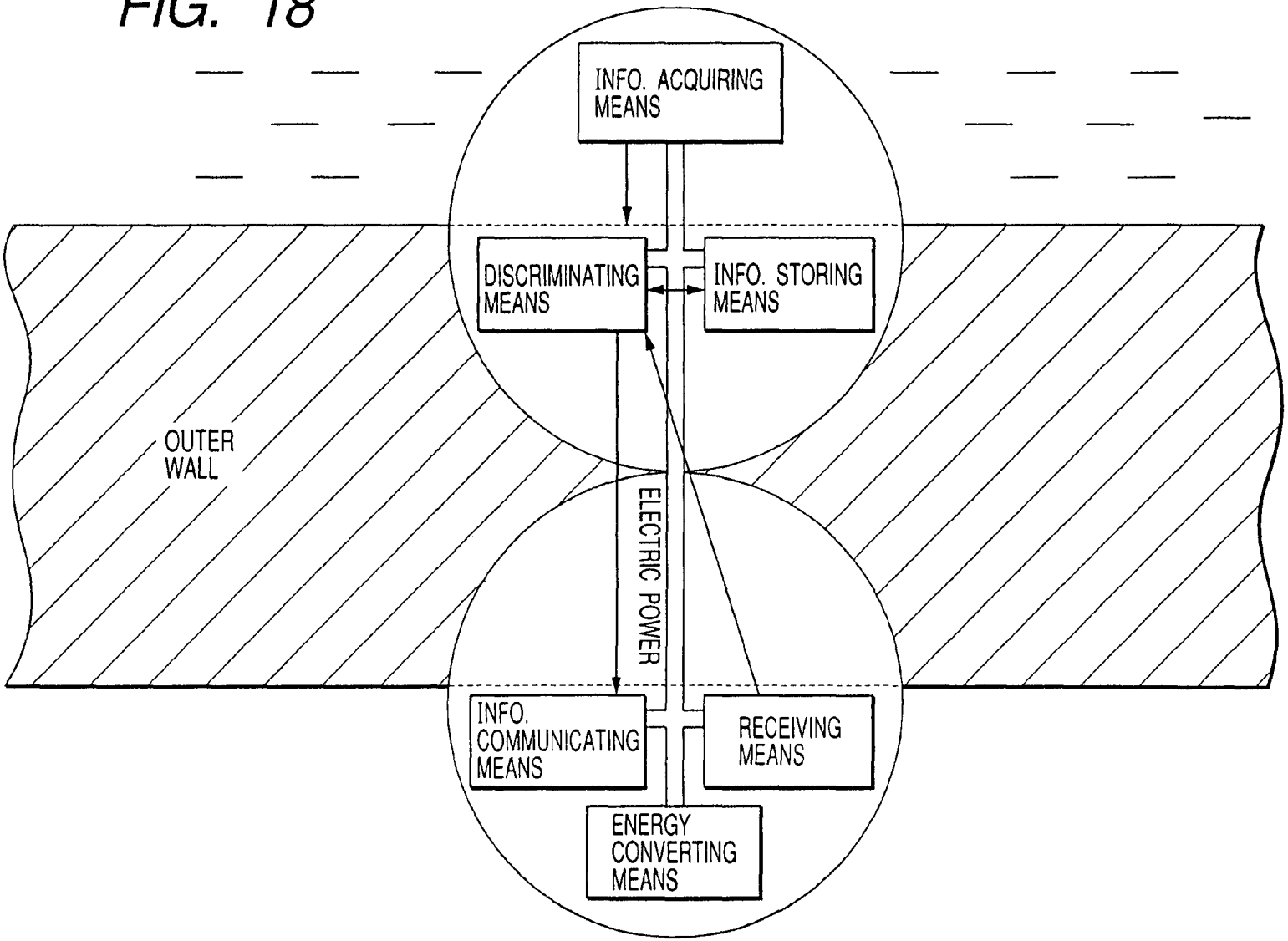
FIG. 18 is an enlarged view of the solid semiconductor element part of the ink tank of FIG. 17.

A first solid semiconductor 519*a* having a part exposed to the inside of the ink tank 511*d* and a second solid semiconductor 519*b* having a part exposed to the outside of the ink tank 511*d* are embedded in the outer wall of the ink tank 511*d*. Exchange of information between the two solid semiconductors 519*a* and 519*b* is performed by, for example, contacting to dispose both the semiconductors and electrically connecting them at a contacting part. FIG. 18 shows an enlarged view of the solid semiconductor element part. In this configuration, functions of the two solid semiconductors 519*a* and 519*b* can be separated by, for example, providing information acquiring means for detecting presence of ink on the part exposed to the inside of the ink tank 511*d* of the first solid semiconductor 519*a* and providing information communicating means in a part exposed to the outside of the ink tank 511*d* of the second solid semiconductor 519*b*.

Figure 19:
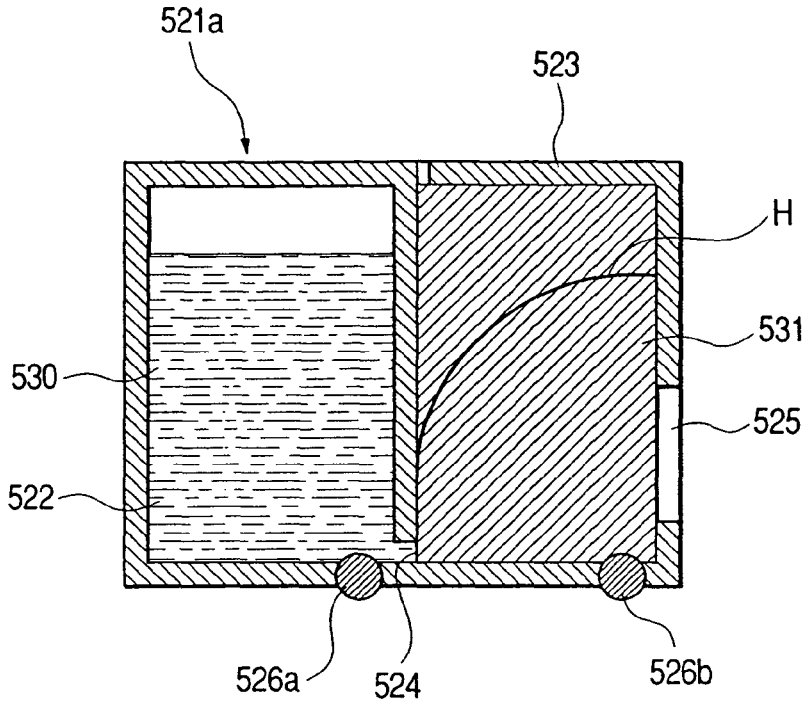
FIG. 19 is a view showing an ink tank of another example using a solid semiconductor element.

An ink tank 521*a* shown in FIG. 19 has a first chamber 530 for directly containing ink 522 and a second chamber 531 for containing a negative pressure generating member 523. The first chamber 530 and the second chamber 531 connect each other in the lowest part of the tank via a connecting path 524 that is opened in an inner wall dividing both the chambers. The first chamber 530 is substantially in a closed state except the connecting path 524. The second chamber 531 is in an air connecting state, and an ink supply port 525 for supplying ink to the outside is opened in the second chamber 531. Ink is held in the second chamber 531 utilizing a negative pressure generated by the negative pressure generating member 523. In this ink tank 521*a*, when ink on the second chamber 531 side is consumed via the ink supply port 525, the air enters the first chamber 530 from the second chamber 531 side, and the ink 522 in the first chamber 530 is guided to the second chamber 531 in place of the air. In this way, a substantially constant amount of ink is always held in the second chamber 531, and ink is steadily supplied.

In the ink tank 521 of such a configuration, a solid semiconductor element may be disposed on one side. However, as shown in FIG. 19, a first solid semiconductor element 526*a* and a second solid semiconductor element 526*b* can be easily disposed in both the first chamber 530 and the second chamber 531. That is, the first solid semiconductor element 526*a* having a part exposed to the inside of the first chamber 530 and a part exposed to the outside of the ink tank 521*a* and the second solid semiconductor element 526*b* having a part exposed to the inside of the second chamber 531 and a part exposed to the outside of the ink tank 521*a* are provided in this ink tank 521*a*. With such a configuration, for example, presence of ink can be detected in each of the first chamber 530 and the second chamber 531 to communicate a detection signal to the outside, and more detailed information on the ink in the ink tank 521*a* can be detected and sent.

Figure 20:
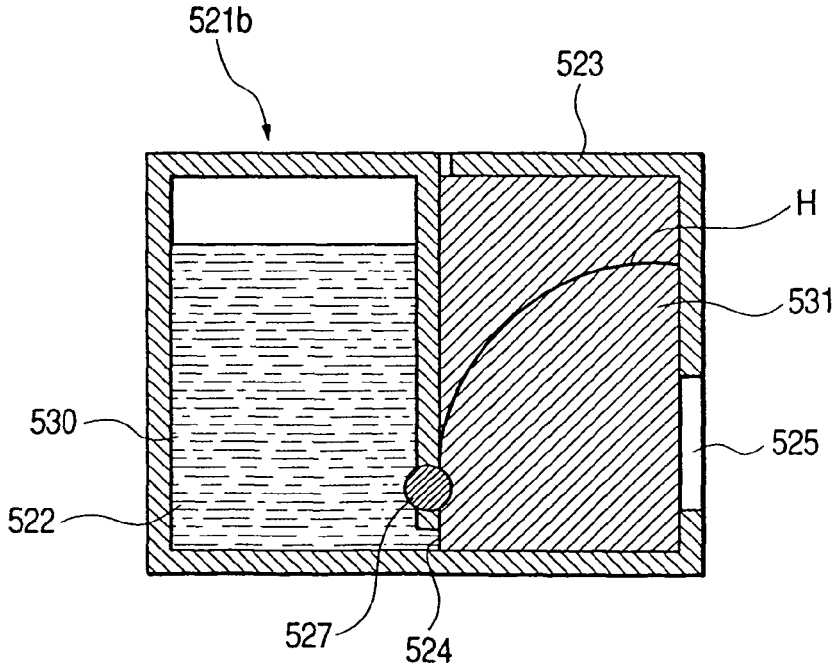
FIG. 20 is a view showing an ink tank of another example using a solid semiconductor element.
Figure 21:
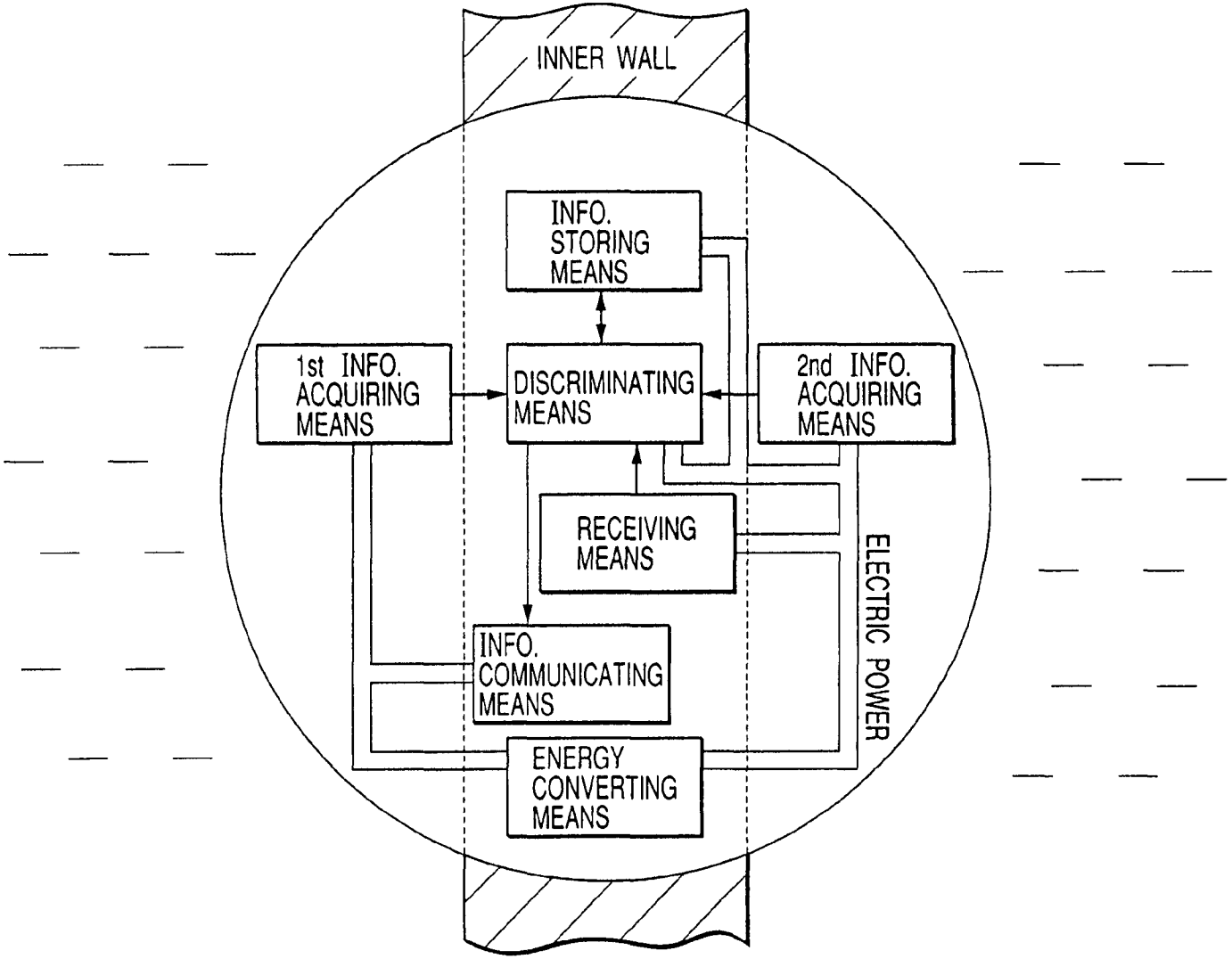
FIG. 21 is an enlarged view of the solid semiconductor element part of the ink tank of FIG. 20.

The ink tank 521*b* shown in FIG. 20 has a solid semiconductor element 527 embedded in an inner wall dividing the first chamber 530 and the second chamber 531 and is disposed to have a part exposed in the first chamber 530 and a part exposed in the second chamber 531. FIG. 21 shows an enlarged view of the solid semiconductor element part. In this configuration, independent information acquiring means for detecting presence of ink or the like can be provided in each of the parts exposed on both sides of the solid semiconductor element 527, and one solid semiconductor element 527 can detect ink in both the first chamber 530 and the second chamber 531. With such a configuration, manufacturing costs can be reduced compared with the case in which a solid semiconductor element are provided independently in both the chambers.

Figure 22:
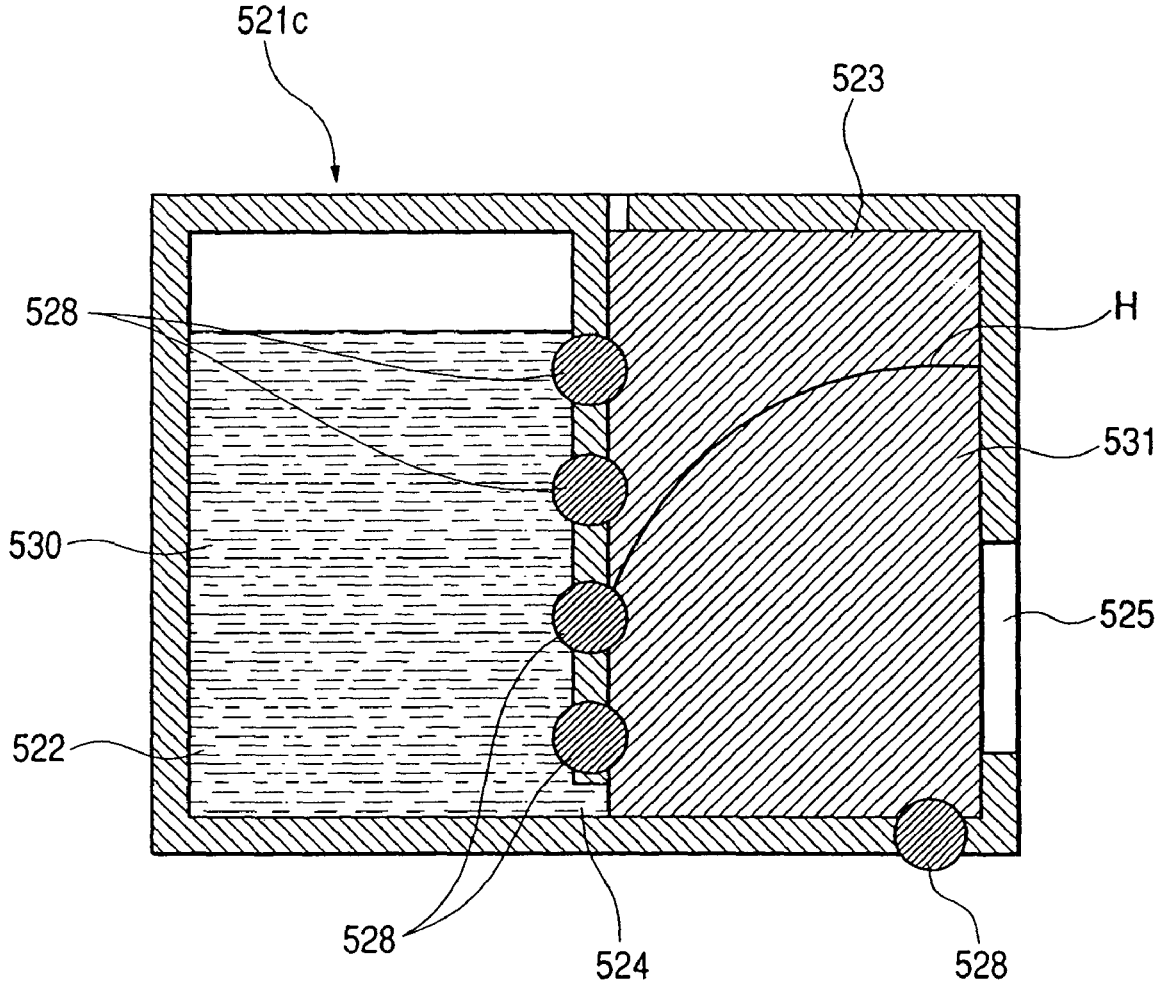
FIG. 22 is a view showing an ink tank of another example using a solid semiconductor element.

The ink tank 521*c* shown in FIG. 22 has a plurality of solid semiconductor elements 528 disposed on the inner wall dividing the first chamber 530 and the second chamber 531 and the outer wall. In the example shown in this figure, four solid semiconductor elements 528 are disposed on the inner wall and one solid semiconductor element 528 is disposed on the outer wall. In this way, a multiplicity of solid semiconductor elements 528 are disposed, whereby a state of ink in the ink tank 521*c* can be detected more in detail, for example, presence of ink is detected in many parts to precisely detect an ink residual amount.

If a plurality of solid semiconductor elements 528 are disposed as described above, for example, frequency of a signal emitted from each solid semiconductor element is changed or an ID signal is transferred and then information is transferred, whereby it can be made distinguishable that a signal is from the solid semiconductor element 528 in each place.

In addition, in the case in which signals from a plurality of solid semiconductor elements are handled, for example, the case in which a plurality of ink tanks are used in one recording apparatus, it is desirable to change frequency for emitting a signal emitted for each solid semiconductor element or an ID signal is transferred and then information is transferred, whereby it can be distinguished which solid semiconductor element is the one that emitted a signal. In this way, it becomes possible to detect an ink residual amount of each color in a recording apparatus having, for example, a plurality of ink tanks corresponding to a plurality of colors of ink.

Further, as the solid semiconductor element used in the ink tank of this example, it is also possible to use one in which the configurations of the above-mentioned first and the second embodiments are appropriately combined.

(Seventh Embodiment)

Figure 23:
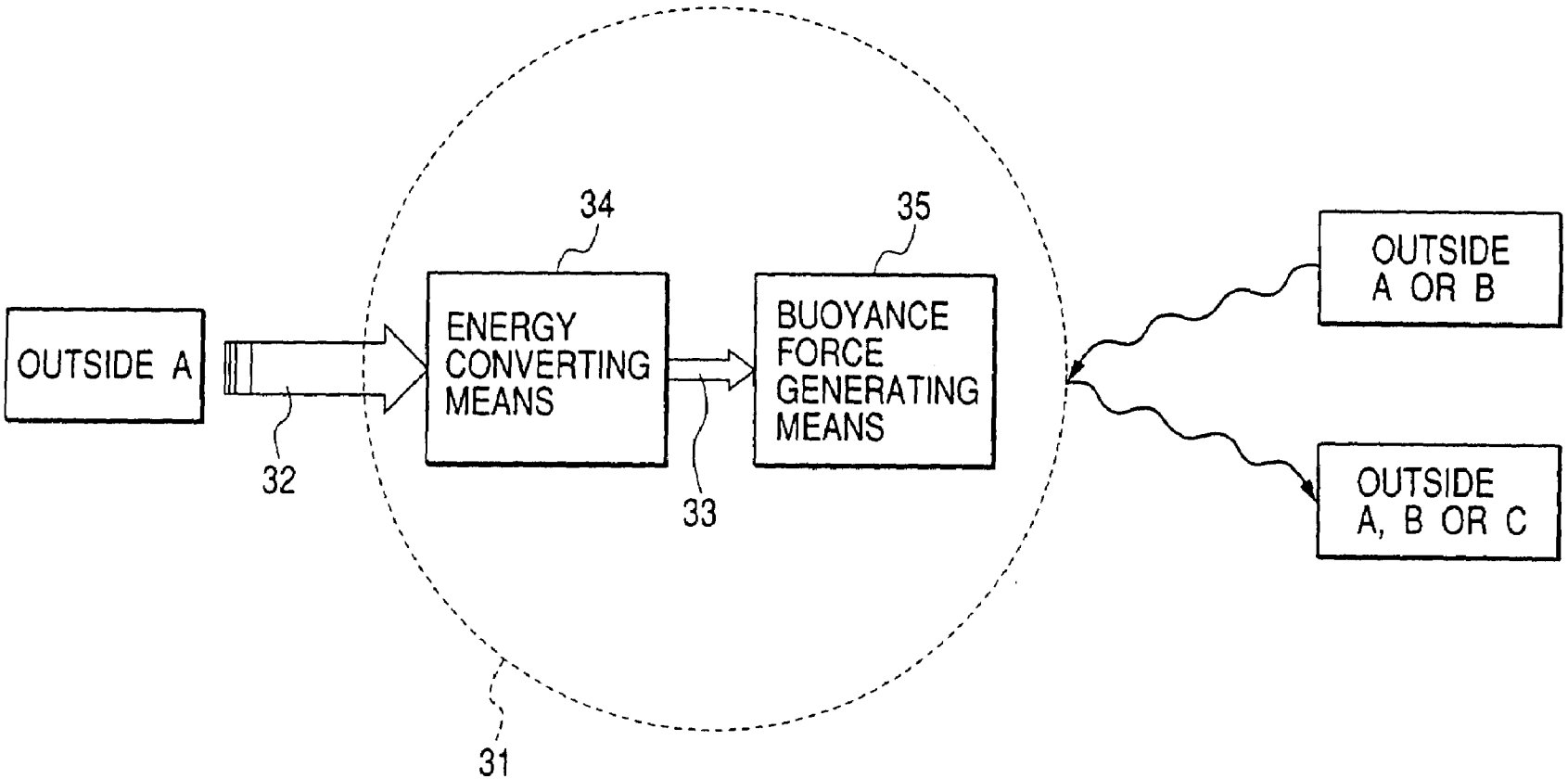
FIG. 23 is a block diagram illustrating an internal configuration and exchanges of information with the outside of a solid semiconductor element of a seventh embodiment of the present invention.

FIG. 23 is block diagram illustrating an internal configuration and exchanges of information with the outside of a solid semiconductor element according to a seventh embodiment of the present invention. A solid semiconductor element 31 of a form shown in this figure is provided with energy converting means 34 for converting electromotive force 32 supplied in a non-contact state from the outside A toward the element 31 into electricity 33 and buoyance force generating means 35 for generating buoyance force using the electricity acquired by the energy converting means 34, and is disposed in ink in an ink tank.

In such a form, when the electromotive force 32 is given from the outside A toward the element 31, the energy converting means 34 converts the electromotive force 32 into the electricity 33, and the buoyance force generating means generates buoyance force using the electricity 33 to float the element 31 on the liquid level of the ink. This buoyance force not only floats the element 31 on the liquid level of the ink but also may always position the element a fixed distance downward from the liquid level of the ink in order to prevent discharge in a state in which the tank is empty.

Figure 24A:
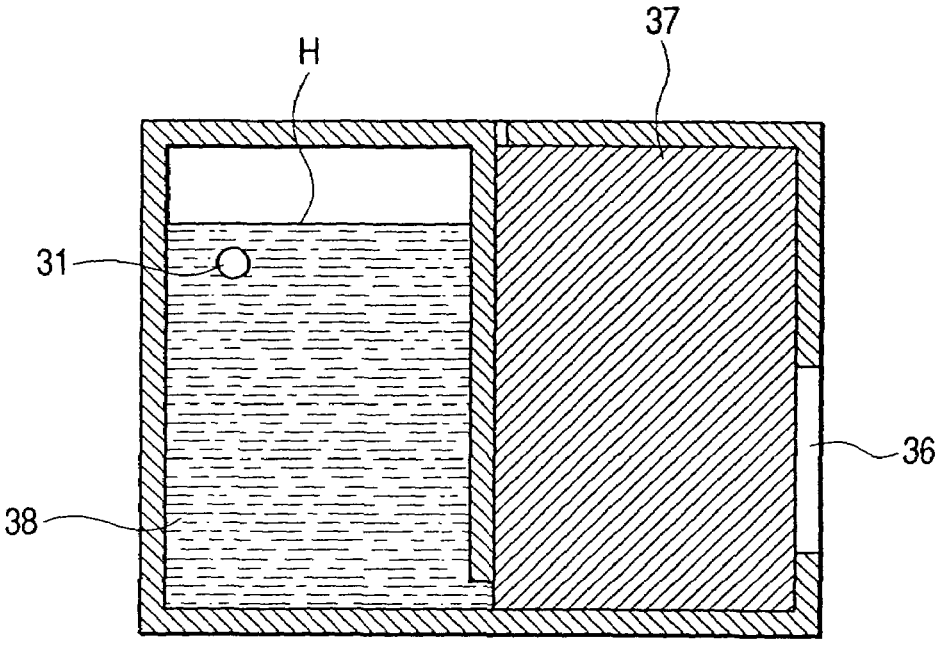
FIGS. 24A and 24B are views showing a position of the element with the configuration of FIG. 5 floated in the ink in the ink tank together with changes of ink consumption.
Figure 24B:
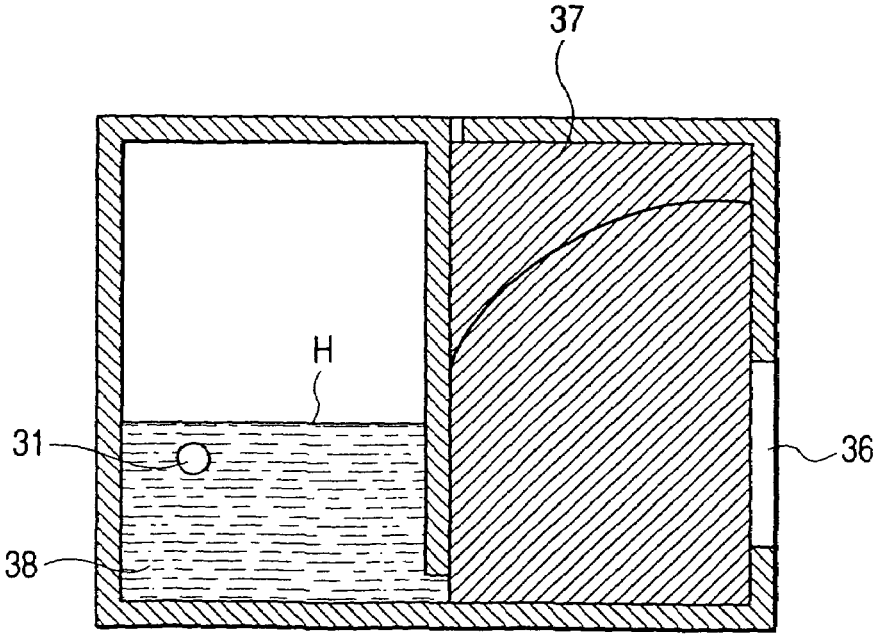

For example, FIGS. 24A and 24B show positions of an element floated in ink contained in an ink tank and changes of the ink consumption. In the tank as shown in FIGS. 24A and 24B, ink equivalent to a consumed amount is held in a negative pressure generating member 37 as the ink in the negative pressure generating member 37 is guided to the outside from an ink supply port 36. Thus, the solid semiconductor element 31 in raw ink 38 moves in accordance with lowering of an ink liquid level H by the consumption of the ink in the state in which the solid semiconductor element 31 exists a fixed distance downward from the ink liquid level H. In this ink tank, the negative pressure generating member 37 for generating a negative pressure in the ink in the ink tank is contained in a negative pressure chamber, and the negative pressure chamber is connected to a chamber that directly contains the raw ink 38.

Figure 25:
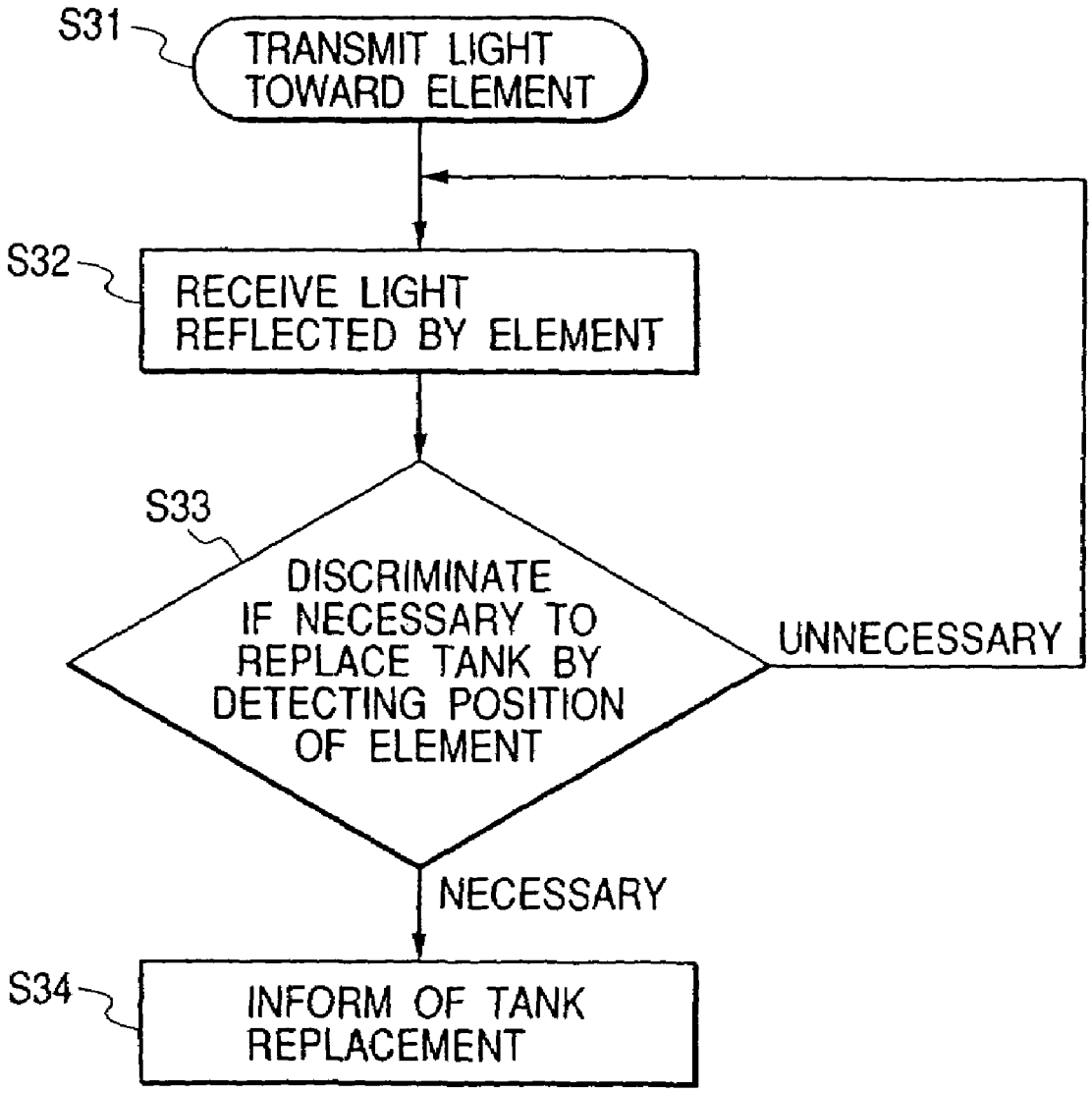
FIG. 25 is a flow chart for confirming a position of the element with the configuration shown in FIG. 5 and discriminating the necessity of replacing the tank.

FIG. 25 is a flow chart for confirming the position of the element 31 and discriminating the necessity of replacing the tank. Referring to steps S31 to S34 of FIGS. 23 and 25, it is seen that light is emitted to the element 31 by the outside A or B (e.g., an ink jet recording apparatus), the position of the element 31 is detected by receiving the light reflected by the element in the outside A or B (e.g., an ink jet recording apparatus) or the outside C, the ink jet recording apparatus determines if it is necessary to replace the ink tank according to the position of the element 31 and, if it is necessary, notifies a user of replacement of the tank by sound, light or the like.

For the detection of the position of the element, an ink jet recording apparatus is provided with light emitting means and light receiving means opposing each other, and a part of the element does not pass light from the light emitting means, whereby the position is confirmed. Alternatively, light emitted from the light emitting means is reflected toward the light receiving means, whereby the position is confirmed.

According to this embodiment, even if buoyance force or the like required for an element according to an environment in which the element is used such as different buoyance force of liquid, the element can be set to always exist in a desired position by converting electromotive force from the outside by energy converting means. Thus, the element can be used regardless of an environment in which it is placed.

Further, this embodiment can be appropriately combined with the above-mentioned first and sixth embodiments.

(Eighth Embodiment)

Figure 26A:
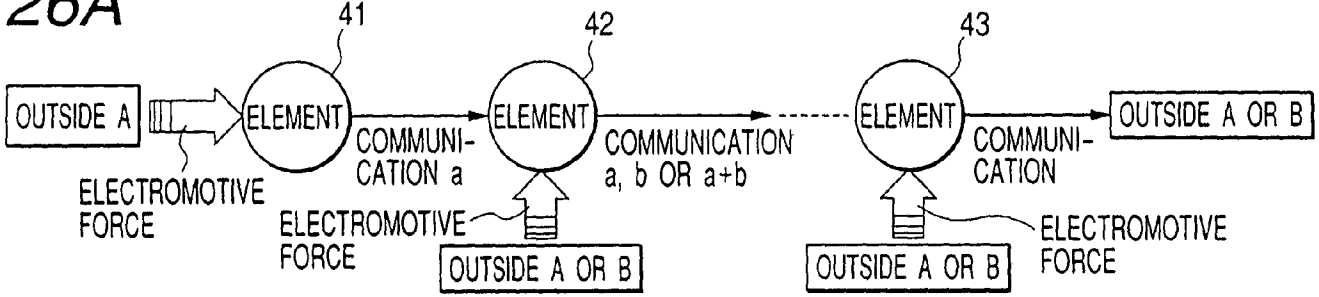
FIGS. 26A, 26B and 26C are conceptual drawings illustrating a method of using a solid semiconductor element being an eighth embodiment of the present invention.
Figure 26B:
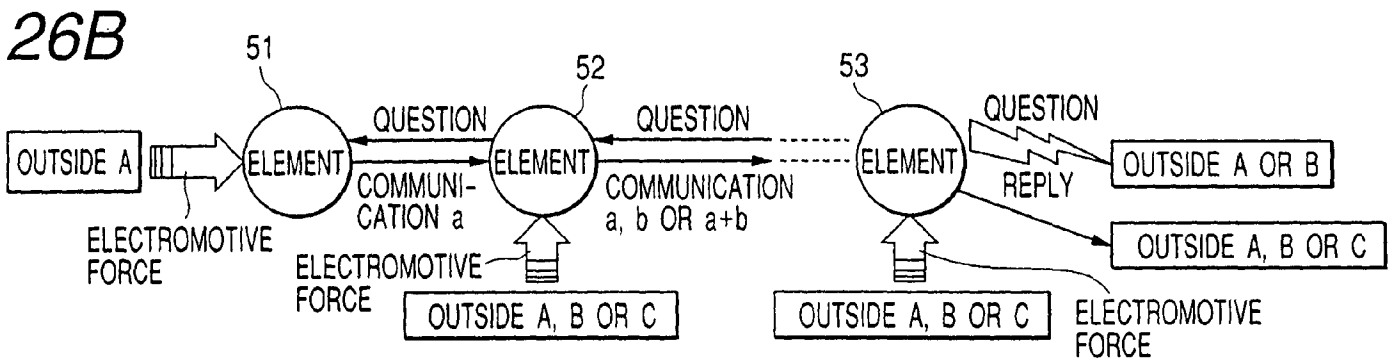
Figure 26C:
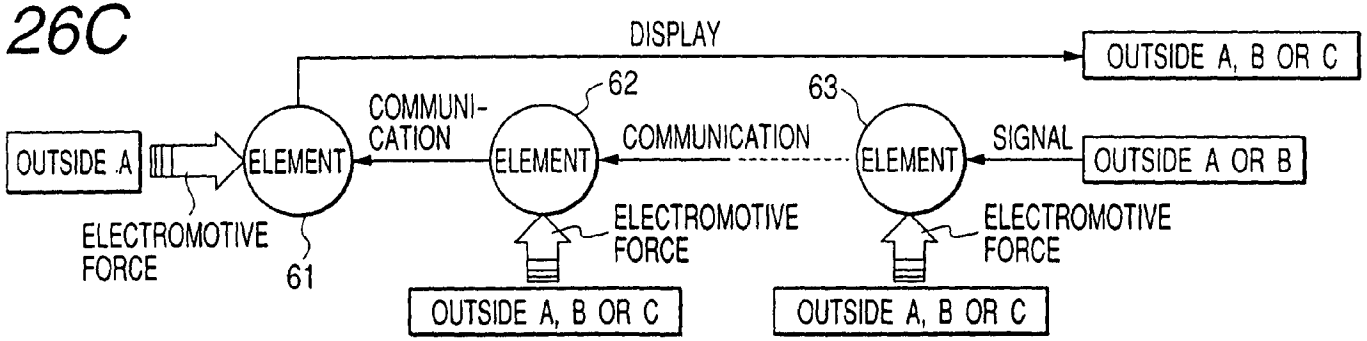

FIGS. 26A to 26C are conceptual drawings illustrating a method of using two or more, that is, a plurality of solid semiconductor elements, which is an eighth embodiment of the present invention.

This embodiment has a configuration in which a function of communicating information to the other elements is given to the solid semiconductor elements of the first and the sixth embodiments, a plurality of which are disposed in an object.

In an example of FIG. 26A, a plurality of solid semiconductor elements of the first embodiment are disposed in an object. When electromotive force is supplied form the outside A or B to each element, each element acquires surrounding environmental information, respectively. Then, information acquired by an element 41 is communicated to an element 42, information a and b acquired by the element 41 and the element 42, and subsequent information is sequentially communicated to the next element. A last element 43 communicates all information acquired to the outside A or B.

In addition, in an example of FIG. 26B, a plurality of solid semiconductor elements of the sixth embodiment are arranged in an object, and electromotive force is supplied to each element from the outside A or B. When a predetermined question by a signal is inputted, for example, in an element 53 from the outside A or B, an element 51 or 52 corresponding to contents of the question acquires information corresponding to the question to make an answer. The question and the answer of the element 51 or 52 are sequentially communicated to the other elements and returned to the outside A, B or C from a desired element 53.

In addition, in an example of FIG. 26C, a plurality of solid semiconductor elements of the sixth embodiment are disposed in an object, and an electromotive force is supplied to each element from the outside A or B. When a certain signal is inputted, for example, in an element 63 from the outside A or B, the signal is sequentially communicated to an element 62 and an element 61, and the element 63 performs display on the outside A, B or C.

Further, in the examples of FIGS. 26A to 26C, the solid semiconductor element provided with buoyance force generating means of the seventh embodiment may be used as one of the plurality of solid semiconductor elements.

Figure 27:
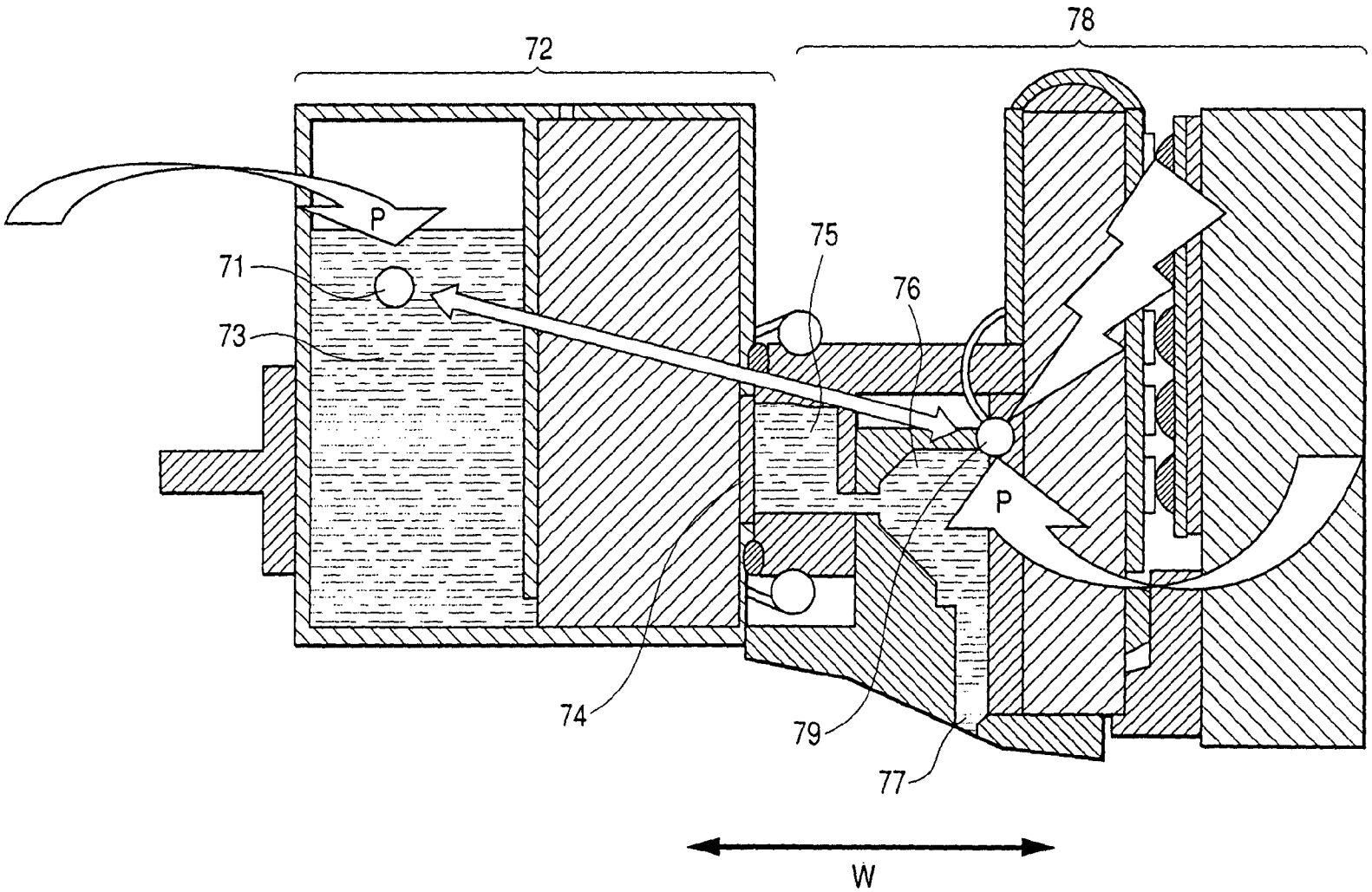
FIG. 27 is a view showing an example of arranging a solid semiconductor element, in which the embodiments are appropriately combined, in an ink tank and an ink jet head connected to the ink tank, respectively.

In addition, FIG. 27 shows an example of disposing a plurality of solid semiconductor elements, with which the embodiments of the first, the sixth or the seventh embodiments is appropriately combined, in an ink tank or an ink jet head connected to the ink tank, respectively. In this example, a solid semiconductor element 71 is disposed in a desired position in ink 73 in an ink tank 72. In the solid semiconductor element 71, the buoyance force generating means and the function of communicating information to another element 79 of the seventh embodiment are added to the solid semiconductor element of the first embodiment. On the other hand, a solid semiconductor element 79 of the sixth embodiment provided with an ID function (authentication function) is disposed in a recording head 78. The recording head 78 discharges ink, which is supplied through a liquid path 75 and a liquid chamber 76 connected to an ink supply port 74 of the ink tank 72, for printing. Electricity may be supplied to this element 79 by the contact between an electrode portion disposed on the surface of the element and a contact portion on an electric substrate for driving the recording head 78.

Then, when electromotive force is supplied to each of the elements 71 and 79 form the outside, the element 71 in the ink acquires, for example, information on a residual amount of ink, and the element 79 on the recording head side communicates, for example, ID information for discriminating an ink residual amount for replacement of a tank to the element 71. Then, the element 71 compares the acquired ink residual amount and the ID and instructs the element 79 to notify the outside of the replacement of a tank only when the ink residual amount and the ID coincide with each other. Upon receiving the instruction, the element 79 communicates a signal notifying the outside of the replacement of a tank and outputs sound, light or the like that appeals to eyes or hearing.

As described above, complicated conditions of information can be set by disposing a plurality of elements in a certain object.

Figure 28:
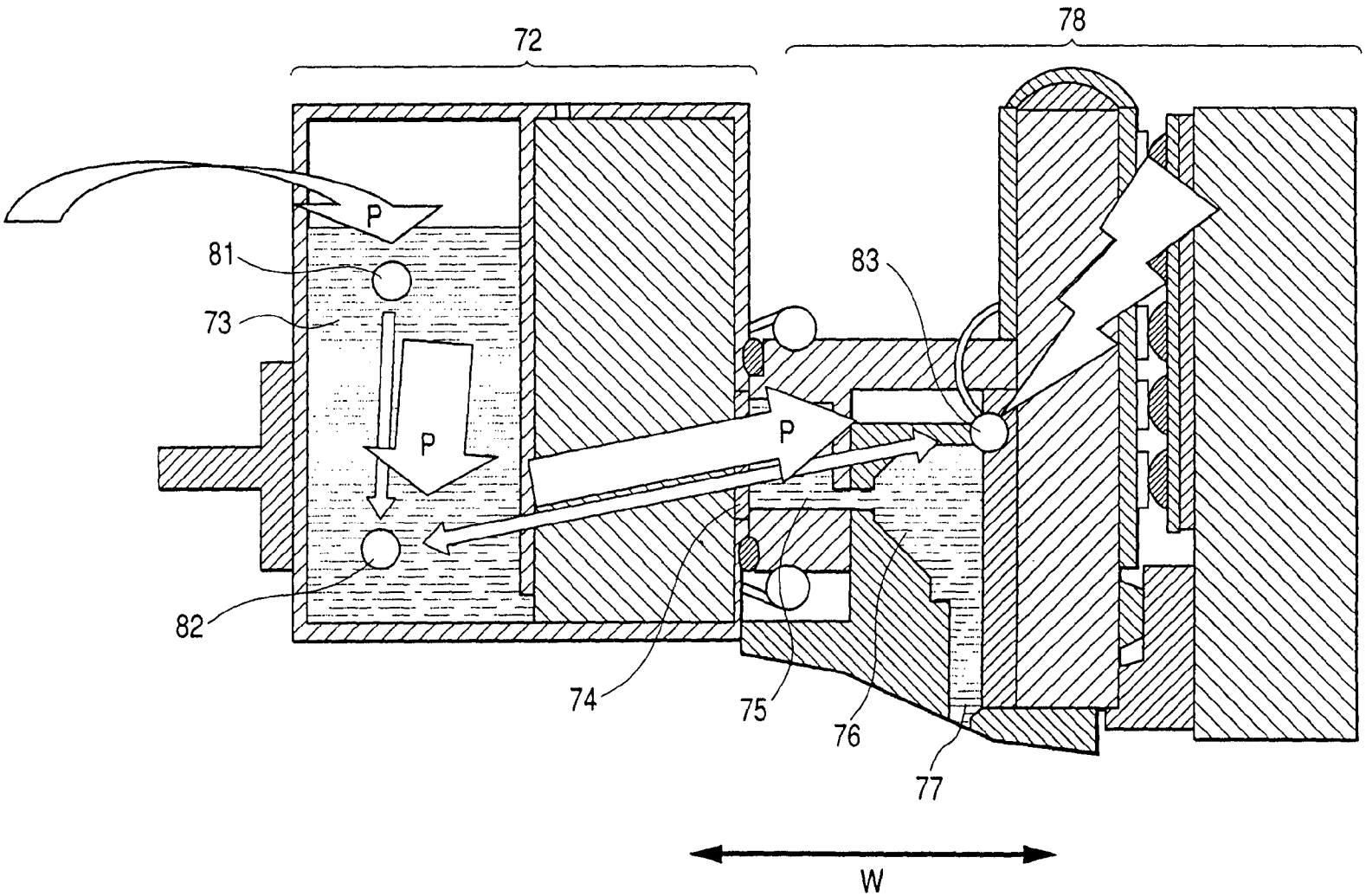
FIG. 28 is a view showing an example of a configuration for sequentially communicating an electromotive force supplied to a certain solid semiconductor element to other solid semiconductor elements together with information in an ink tank and an ink jet head connected to the ink tank.
Figure 29:
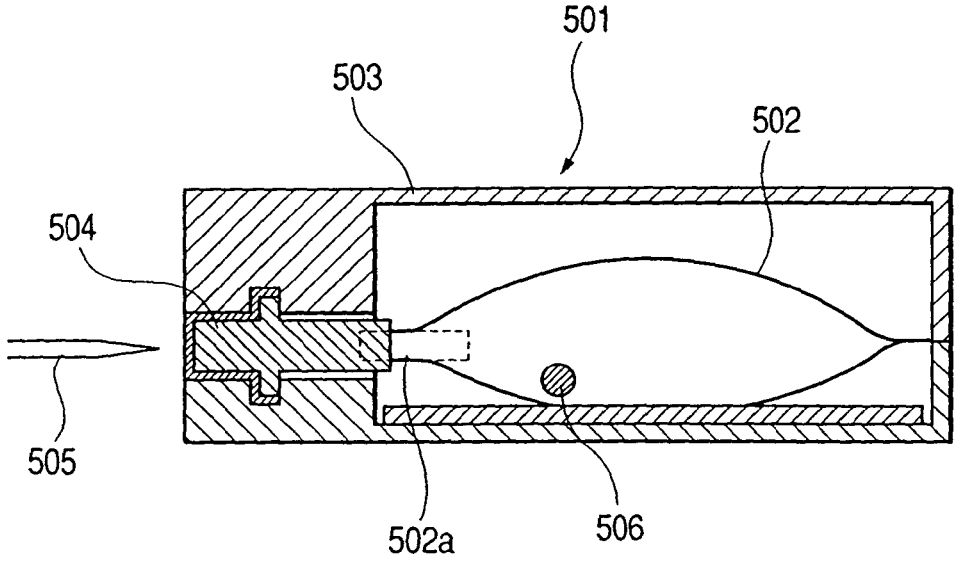
FIG. 29 is a view showing an example of an ink tank that is preferable for providing the solid semiconductor element according to the various embodiments of the present invention therein.

In addition, electromotive force is supplied to each solid semiconductor element in the examples shown in FIGS. 26 and 27. However, the present invention is not limited to this, and electromotive force supplied to a certain element may be sequentially communicated to the other elements together with information. For example, as shown in FIG. 28, a solid semiconductor element 81 and a solid semiconductor element 82 are arranged in predetermined position in the ink 73 in the ink tank 72, respectively, as in shown FIG. 27. In the solid semiconductor element 81, the buoyance force generating means, the function of communicating information to the other elements and the function of supplying electromotive force of the sixth embodiment are added to the solid semiconductor element of the first embodiment. In the solid semiconductor element 82, the buoyance force generating means of the seventh embodiment, the function of communicating information to the other elements, and the function of supplying electromotive force of the seventh embodiment are added to the solid semiconductor element of the sixth embodiment. On the other hand, a solid semiconductor element 83 of the sixth embodiment provided with an ID function (authentication function) is disposed in the recording head 78 connected to the ink tank 72. Electricity may be supplied to this element 83 by the contact between an electrode portion disposed on the surface of the element and a contact portion on an electric substrate for driving the recording head 78. In FIGS. 27 and 28, a symbol P denotes electromotive force and a symbol w denotes a print scanning direction.

Then, when electromotive force is supplied to the element 81 from the outside, the element 81 in the ink acquires, for example, ink residual amount information, compares the information with defined conditions of the inside. If it is necessary to communicate the information to the other elements, the element 81 communicates the acquired ink residual amount information to the element 82 together with electromotive force for operating the element 82. The element 82 to which the electromotive force is supplied receives the ink residual amount information communicated from the element 81 and acquires information on, for example, pH of the ink to communicate electromotive force for operating the element 83 to the element 83 on the recording head side. Then, the element 83 on the recording head side to which the electromotive force is supplied communicates ID information for discriminating, for example, an ink residual amount or pH of the ink for replacement of a tank to the element 82. The element 82 then compares the acquired ink residual amount information and pH information with the ID and communicates to instruct the element 83 to notify the outside of the replacement of the tank only when the acquired ink residual amount information and pH information and the ID coincide with each other. Upon receiving this, the element 83 communicates a signal for notifying the outside of the replacement of the tank or outputs sound, light or the like appealing to eyes and hearing. In this way, a method of supplying electromotive force from a certain element to the other elements together with information is also possible.

Further, as the recording head 78, a recording head is possible which foams ink by heat of an electrothermal conversion element such as a heater in a liquid path and discharges the ink from a micro opening connecting to the liquid path by air bubble growing energy.

(Other Embodiments)

Examples of a configuration of an ink tank to which the solid semiconductor elements of the above-mentioned embodiments can be applied are shown in FIGS. 29 to 35. The ink tank 501 shown in FIG. 29 has a flexible ink bag 502 containing ink provided in a housing 503, closes a bag opening 502*a* by a rubber plug 504 fixed to the housing 503 and sticks a hollow needle 505 for guiding ink into the rubber plug 504 to connect the ink into the bag, thereby suppling the ink to an ink jet head (not shown). A solid semiconductor element 506 of the present invention can be disposed in the ink bag 502 of such an ink tank 501.

Figure 30:
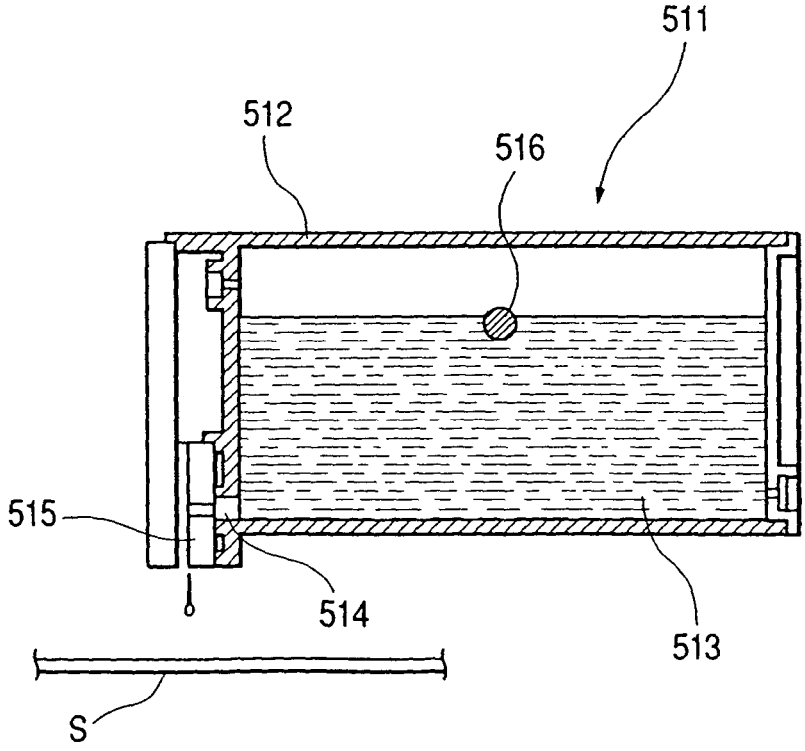
FIG. 30 is a view showing an example of an ink tank that is preferable for providing the solid semiconductor element according to the various embodiments of the present invention therein.

In addition, an ink tank 511 shown in FIG. 30 is an ink tank in which an ink jet head 515, which discharges ink toward a recording sheet S to record information on it, to an ink supply port 514 of a housing 512 containing ink 513. A solid semiconductor element 516 of the present invention can be disposed in the ink 513 in such a tank 511.

Figure 31:
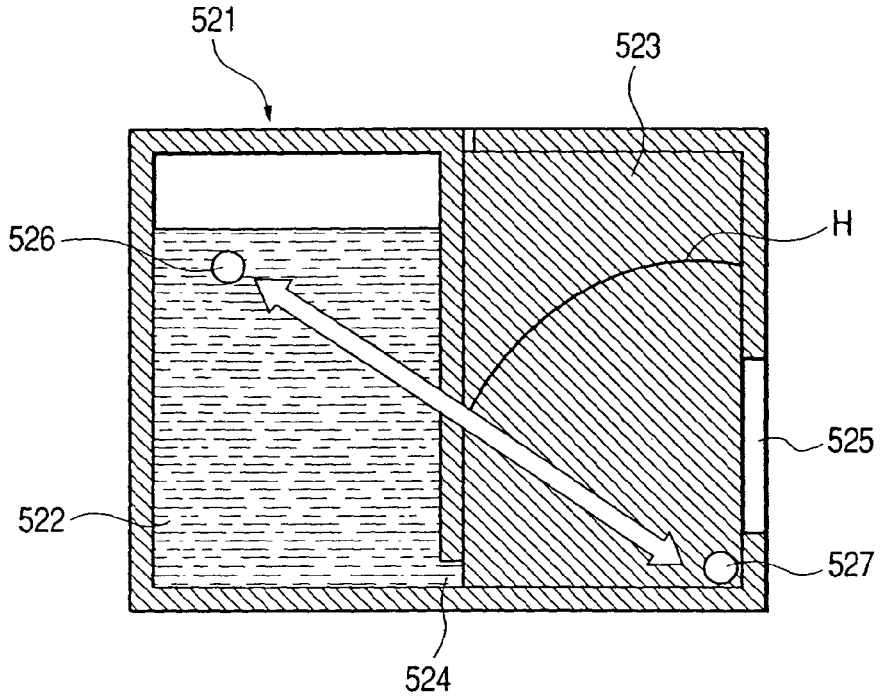
FIG. 31 is a view showing an example of an ink tank that is preferable for providing the solid semiconductor element according to the various embodiments of the present invention therein.

In addition, an ink tank 512 shown in FIG. 31 is provided with a first chamber in a completely closed state for containing ink 522, a second chamber in an air connecting state, which is a negative pressure chamber, for containing a negative pressure generating member 523 for generating a negative pressure in ink, and a connecting path 524 for connecting the first chamber and the second chamber in the lowest part of the tank. When ink is consumed from an ink supply port 525 on the second chamber side, the ink 522 in the first chamber is guided into the second chamber in response to air entering the first chamber from the second chamber side. In the tank 521 of such a configuration, solid semiconductor elements 526 and 527 of the present invention may be disposed in the first and the second chambers, respectively, to exchange information on ink in each of the divided chambers.

Figure 32:
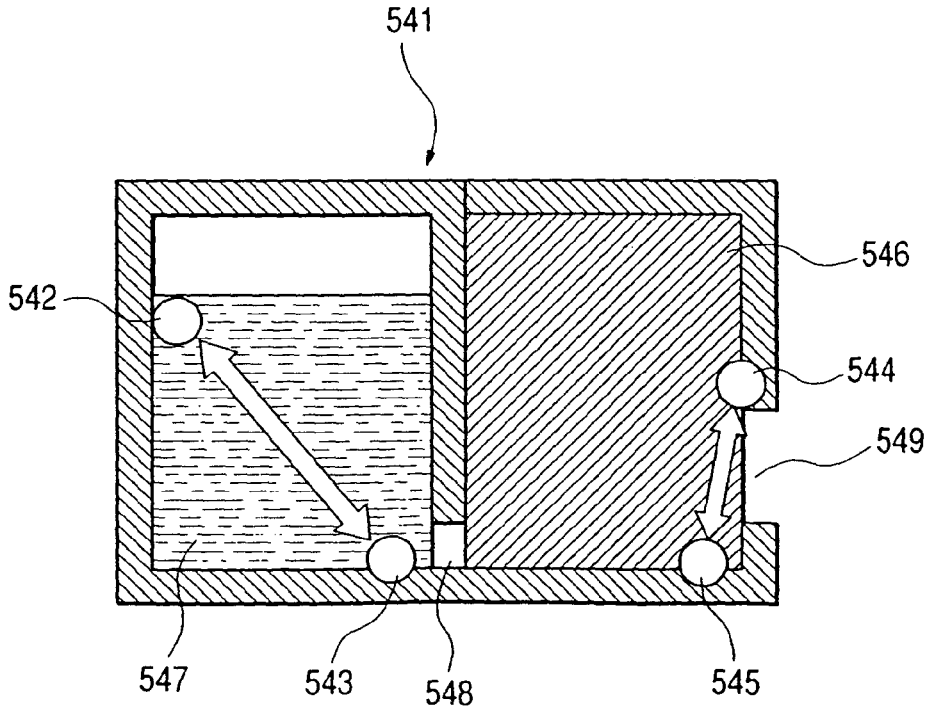
FIG. 32 is a view showing an example of an ink tank that is preferable for providing the solid semiconductor element according to the various embodiments of the present invention therein.
Figure 33:
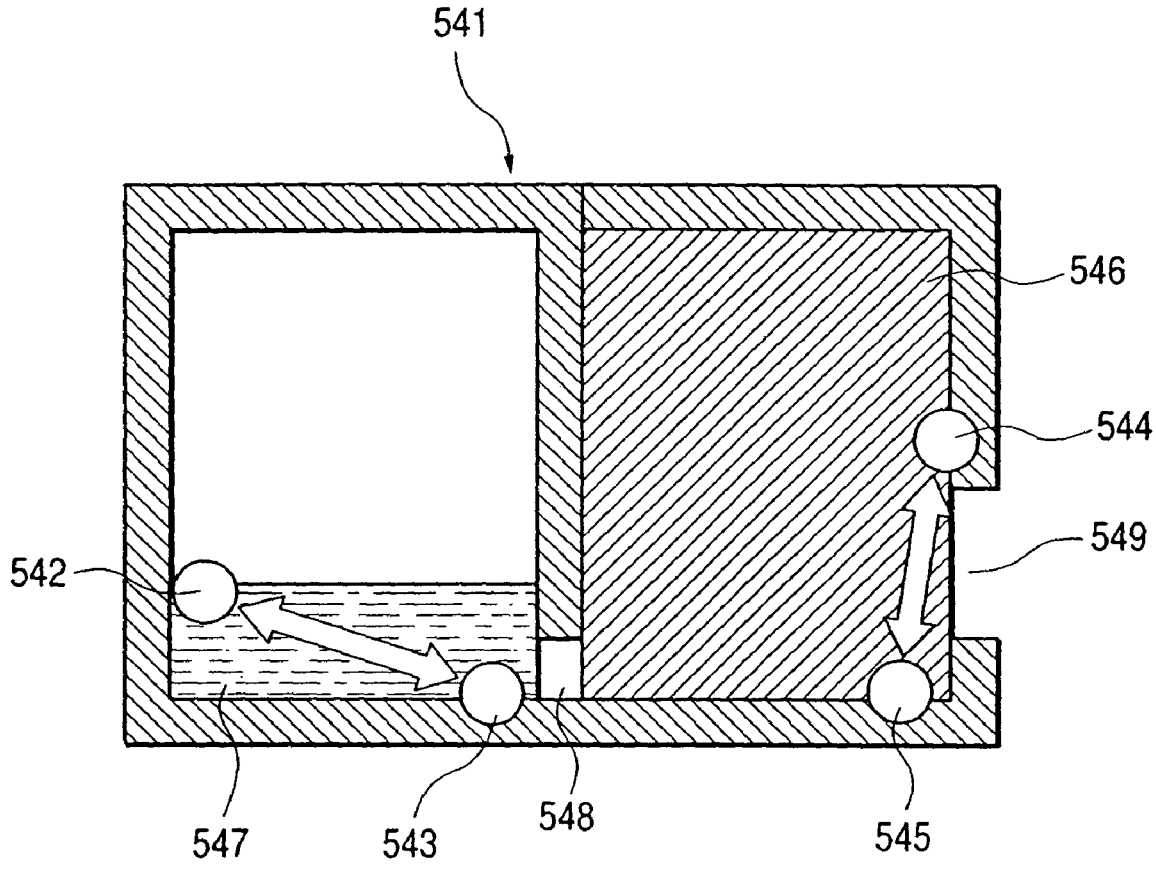
FIG. 33 is a view showing an example of an ink tank that is preferable for providing the solid semiconductor element according to the various embodiments of the present invention therein.
Figure 34:
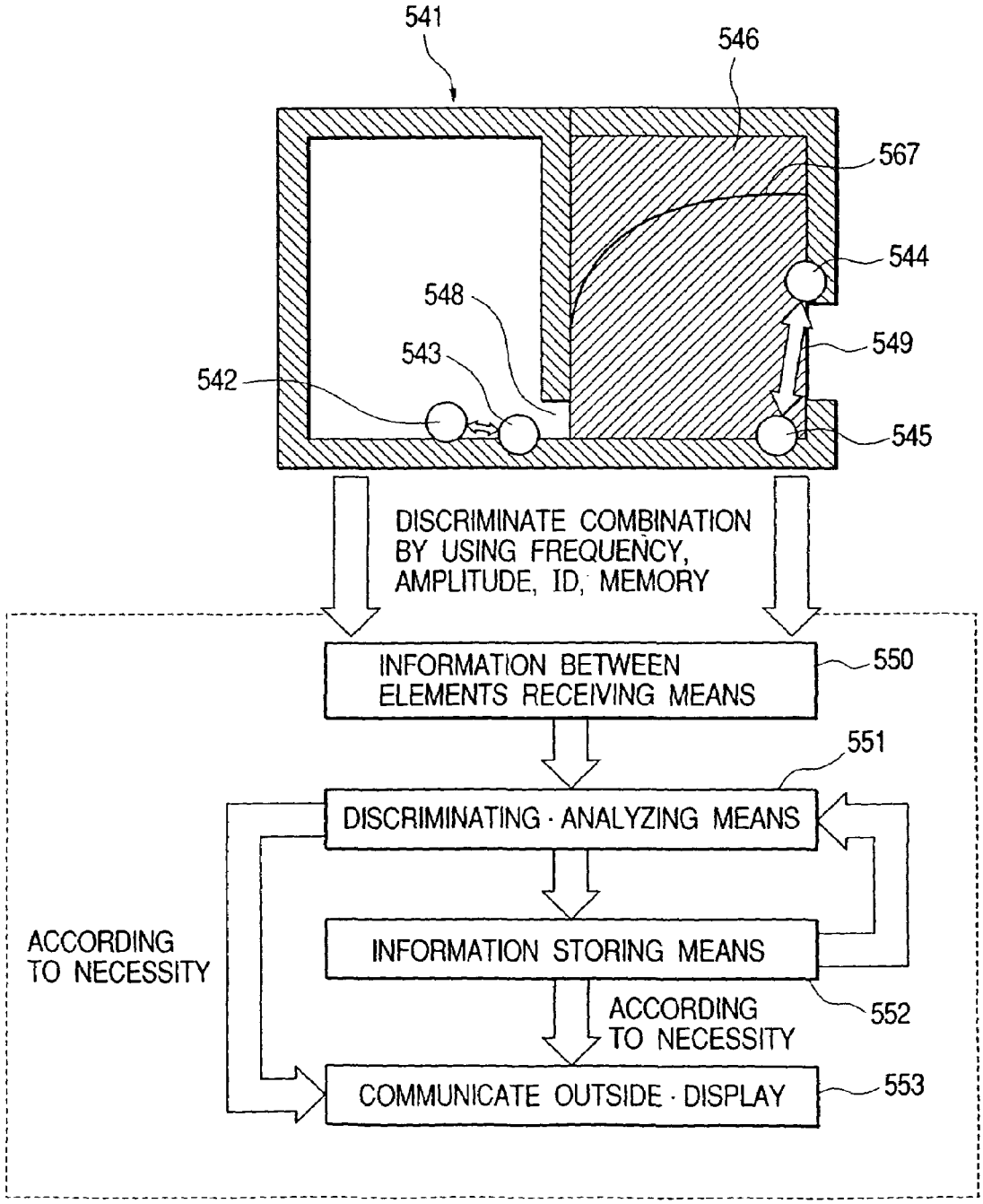
FIG. 34 is a view showing an example of an ink tank that is preferable for providing the solid semiconductor element according to the various embodiments of the present invention therein.

In addition, an ink tank 541 shown in FIGS. 32 to 34 is provided with a first chamber in a completely closed state for containing ink 547, a second chamber in an air connecting state, which is a negative pressure chamber, for containing a negative pressure generating member 546, and a connecting path 548 for connecting the first chamber and the second chamber at the lowest part of the tank as in FIG. 31. Ink in the second chamber is consumed from an ink supply port 549 formed in a part opposite the connecting path 548 side in a wall portion forming the second chamber. In this ink tank 541, solid semiconductor elements 542 and 543 are disposed in the first chamber, and solid semiconductor elements 544 and 545 are disposed in the second chamber. In the case of the ink tank 521 of FIG. 31, one solid semiconductor element is disposed in the first and the second chambers, respectively. Each solid semiconductor element manages information on ink in each chamber, but the information cannot be simply compared because media therein are different in the first and the second chambers.

Reasons for disposing a plurality of solid semiconductor elements in each of the first and the second chambers will be described with reference to FIGS. 36A to 36C. FIG. 36A is a diagram showing an attenuation amount of an electromagnetic wave used for communication between two solid semiconductor elements in the case in which each of the two elements is disposed in the first and the second chambers, respectively. FIG. 36B is a diagram showing an attenuation amount of an electromagnetic wave used for communication between a plurality of solid semiconductor elements in the case in which the elements are disposed in the first chamber (X). FIG. 36C is a diagram showing an attenuation amount of an electromagnetic wave used for communication between a plurality of solid semiconductor elements in the case in which the elements are disposed in the second chamber (Y).

For example, in the case in which a residual amount or the like is detected using an electromagnetic wave, attenuation amounts of the wave are different in the first and the second chambers as shown in FIG. 36A because the first chamber contains only ink, whereas the second chamber contains ink and a negative pressure generating member. Thus, it becomes difficult to grasp a state and to control detection of environmental information. On the other hand, in FIGS. 32 to 34, each chamber has a plurality of solid semiconductor elements. It is advantageous to communicate between the solid semiconductor elements existing in each chamber as shown in FIGS. 36B and 36C because media therein are the same. In addition, a plurality of solid semiconductor elements are disposed in each of the first and the second chambers in this way, and data detected by each of the elements are corrected to be compared, whereby it becomes possible to accurately manage information in a tank. Thus, more accurate detection on a real time basis becomes possible.

In addition, a problem occurs here in that which solid semiconductor elements among the plurality of solid semiconductor elements are used to detect information on the inside of a predetermined container. As an example of a method of distinguishing a necessary solid semiconductor element out of the plurality of solid semiconductor elements, there is a case shown in FIG. 32. In this case, solid semiconductor elements 542 and 543 or solid semiconductor elements 544 and 545 communicate with each other. As a method of distinguishing the solid semiconductor elements, a method of changing properties of the solid semiconductor elements for each group to communicate under different conditions is possible in a case such as the case in which a frequency to be detected is changed or an amplitude is changed. Since communication is performed under different conditions by changing a property of a solid for each group in this way, it becomes possible to operate for each group in response to information from the outside.

As another method, if solid semiconductor elements, all of which have the same properties, are used, a method of incorporating identification information (ID) in a plurality of solid semiconductor elements before they are disposed in a predetermined container to detect which solid semiconductor element is used according to the identification information is possible. Alternatively, a method of inserting solid semiconductor elements before they are provided in a predetermined container and inputting distinguishing means in the memory in advance to distinguish a necessary one out of a plurality of solid semiconductor elements based on the information inputted in the memory earlier is also possible. If the identification information (ID) is used, when a signal for identification information (ID), for example called A, is sent from the outside, it is possible that solid semiconductor elements falling into A communicate with each other, and as a result, detected environmental information is communicated to or displayed on the outside. Alternatively, if a signal for identification information (ID) called B is sent, it is possible that solid semiconductor elements falling into B communicate with each other, and detected environmental information is communicated to or displayed on the outside. A similar method is possible in the case of a memory.

In FIGS. 32 to 34, a method of detecting a residual amount of ink using an attenuation amount of a wave form of an electromagnetic wave will be described here as an example. In addition, it is assumed that the solid semiconductor elements 543, 544 and 545 are embedded in the ink tank 541, and the solid semiconductor element 542 floats in the ink 547 in the first chamber in this example. FIG. 32 shows a state in which a lot of ink is still left, FIG. 33 shows a state in which a residual amount of the ink is decreasing, and FIG. 34 shows a state in which ink residual amount is little and ink is only left in a negative pressure chamber, that is, the second chamber. First, a relations of wave forms of electromagnetic waves of the solid semiconductor elements 542 and 543 and those of the solid semiconductor elements 544 and 545 are stored as an initial state. If the ink 547 in the first chamber decreases compared with the initial state as shown in FIG. 33, the solid semiconductor elements 542 and 543 approaches. When the elements approaches, attenuation of a wave form of an electromagnetic wave becomes less. This means that ink is decreasing. This state is effective in finding at random and at all times how much residual amount decreases compared with the initial state.

Then, when no ink is left in the first chamber as in the state shown in FIG. 34, since there is not factor for entering between the solid semiconductor elements 542 and 543, there is little attenuation amount of an electromagnetic wave. Moreover, when no ink is left, in the state of FIG. 34 as well, communication is then performed between the solid semiconductor elements 544 and 545, and when a liquid level 567 in the negative pressure generating member 546 is lowered, both a part with ink and a part without ink exist between the solid semiconductor elements 564 and 565. Then, a point where dispersion of attenuation of a wave form occurs, which gradually lowers as the ink becomes less. It becomes possible to detect how much ink is left according to the point where dispersion occurs.

In addition, what is shown in the lower part of FIG. 34 is a diagram showing an example in the case in which the ink tank communicates with the outside. First, information between elements receiving means 550 receives a result of communication between the solid semiconductor elements 542 and 543. In this case, the solid semiconductor elements are distinguished using frequencies, amplitudes, IDs, memories or the like such that information of a wrong solid semiconductor elements are not received. Then, the result is communicated to discriminating and analyzing means 551. Items that are required to be communicated to or displayed on the outside are communicated to or displayed on the outside, and the items of information are stored in the information storing means 552. However, it is possible to store items of information that have been communicated to the outside in the information storing means 552. Then, if communication is performed between the solid semiconductor elements 544 and 545, information acquired as a result of the communication is received by the information between elements receiving means 550 as described above. Then, the information received by the information between elements receiving means 550 is communicated to the discriminating and analyzing means 551, where items of the information is also communicated to or displayed on the outside if necessary, and the other items of the information or items of information that have already been communicated to or displayed on the outside are also stored in the information storing means 552. Then, the operations are repeated, whereby an amount of information stored in the information storing means 552 increases, and the information can be communicated to or displayed on the outside. In addition, in some cases, determination and analysis are performed among items of stored information, or between information newly received and the information stored in the information storing means 552 to communicate a result to the outside. In this way, a plurality of solid semiconductor elements are provided in a predetermined container, communication is performed for each group, a state is determined and analyzed each time communication is performed, and information is stored, whereby information can be acquired each time according to the necessity.

Figure 38:
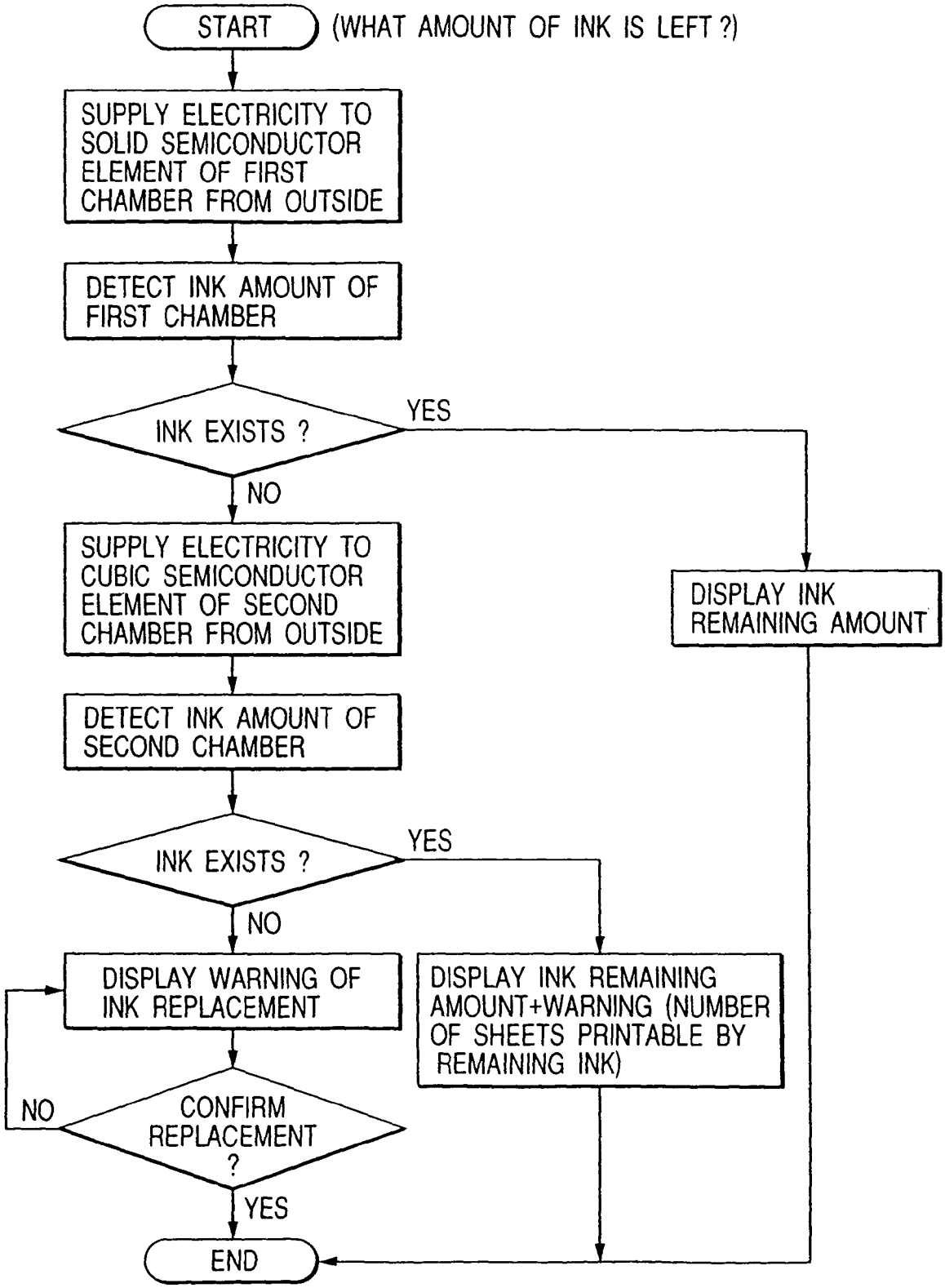
FIG. 38 is a flow chart showing an example of a method of detecting an ink residual amount.
Figure 39A:
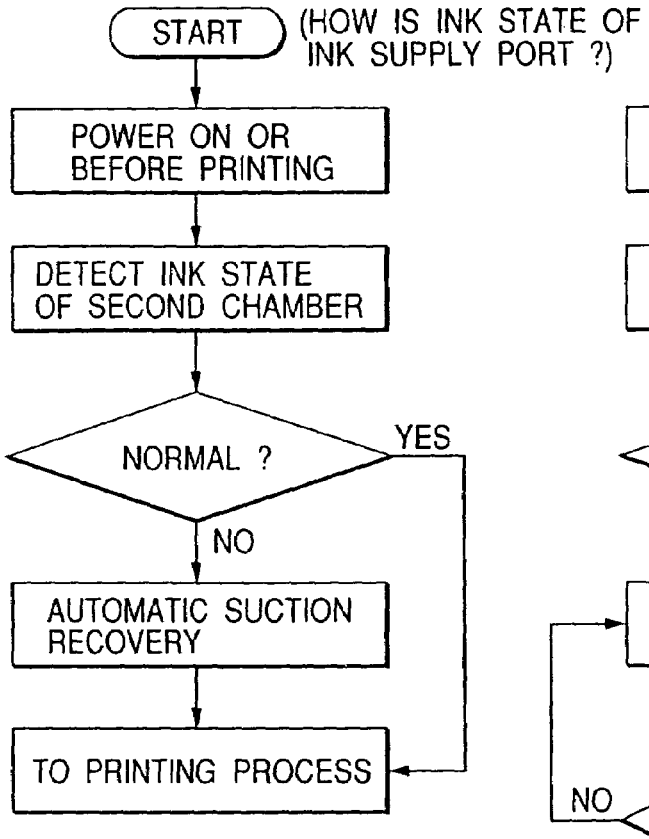
FIGS. 39A and 39B are flow charts showing an example of detecting a state of ink around an ink supply port.
Figure 39B:
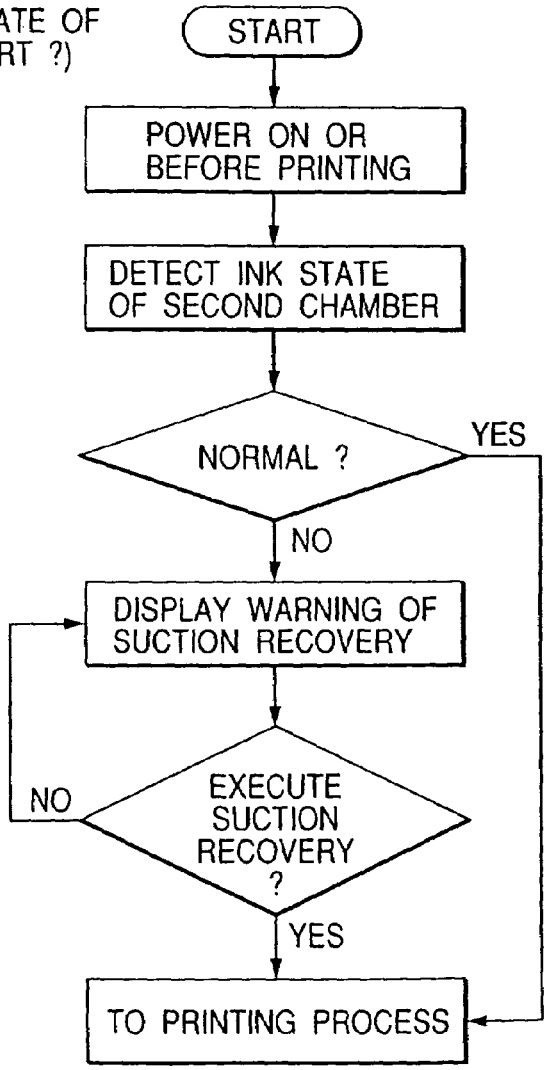

FIGS. 38, 39A and 39B are flow charts showing how information in an ink tank is actually detected in the case of the configuration shown in FIGS. 32 to 34.

First, FIG. 38 is a flow chart showing an example of a method of detecting an ink residual amount. In the first place, electromotive force required for detecting an ink residual amount is supplied to the solid semiconductor elements 542 and 543 existing in the first chamber. Although it is possible to simultaneously supply electromotive force to the solid semiconductor elements 544 and 545, in this example, electromotive force is first supplied to the solid semiconductor element in the first chamber for efficiency and in order to prevent a failure caused by supplying electricity to a multiplicity of solid semiconductor elements at one time. Then, an ink residual amount in the first chamber is detected by mutual communication of the solid semiconductor elements 542 and 543 using the supplied electricity. As a result, if ink is still left as in the states of FIGS. 32 and 33, the ink residual amount is communicated to or displayed on the outside. To the contrary, if no ink is left in the first chamber as shown in FIG. 34, electricity is supplied from the outside to the solid semiconductor elements 544 and 545 in the second chamber. Then, as described above, an ink residual amount in the second chamber is detected by mutual communication between the solid semiconductor elements 544 and 545 using the supplied electricity. As a result, if ink is still left, the residual amount is displayed. In addition, since no ink is left in the first chamber already, it is communicated to or displayed on the outside that ink is running out. Moreover, it is preferable that a warning can be also displayed indicating, for example, how many recording sheets can be printed by remaining ink. To the contrary, if there is no ink residual amount, a warning indicating replacement of an ink tank is displayed, and a state is made printable when the replacement is completed.

FIGS. 39A and 39B are flow charts showing an example of detecting a state of ink around an ink supply port. This will be described with the configurations of FIGS. 32 to 34 as examples as described above. In addition, in this example, detection can be executed even in an ink tank that has the second chamber only. First, a state of ink is detected by mutual communication of the solid semiconductor elements 544 and 545 in the second chamber when a power source of a main body is turned on as shown in FIGS. 39A and 39B or when it is communicated that printing is performed. As a result, as shown in FIG. 39A, if there is no anomaly, processing advances to a printing process in the case immediately after power source is turned on and before printing. However, if an anomaly is detected, for example, in the case in which air entered from an ink supply port, automatic suction recovery is performed, and processing advances to the printing process. In addition, if suction recovery cannot be executed automatically, it is communicated to or displayed on the outside that suction recovery is executed, and the suction recovery is executed and processing advances to the printing process as shown in FIG. 39B. In this way, a plurality of solid semiconductor elements are disposed around an ink supply port to detect an ink state in the surrounding part and execute suction recovery according to the necessity, whereby operations for suction recovery that has been conventionally regularly executed regardless of a state of ink can be reduced, and ink does not decrease excessively.

The method of detecting information on the inside of a tank indicated above is simply one example. In this example, environmental detection is performed in the first chamber first, and detection is performed using the solid semiconductor element in the second chamber when ink in the first chamber has run out. However, it is also possible to simultaneously perform environmental detection in the first chamber and environmental detection in the second chamber and correct the results to perform environmental detection using relative comparison.

Figure 35:
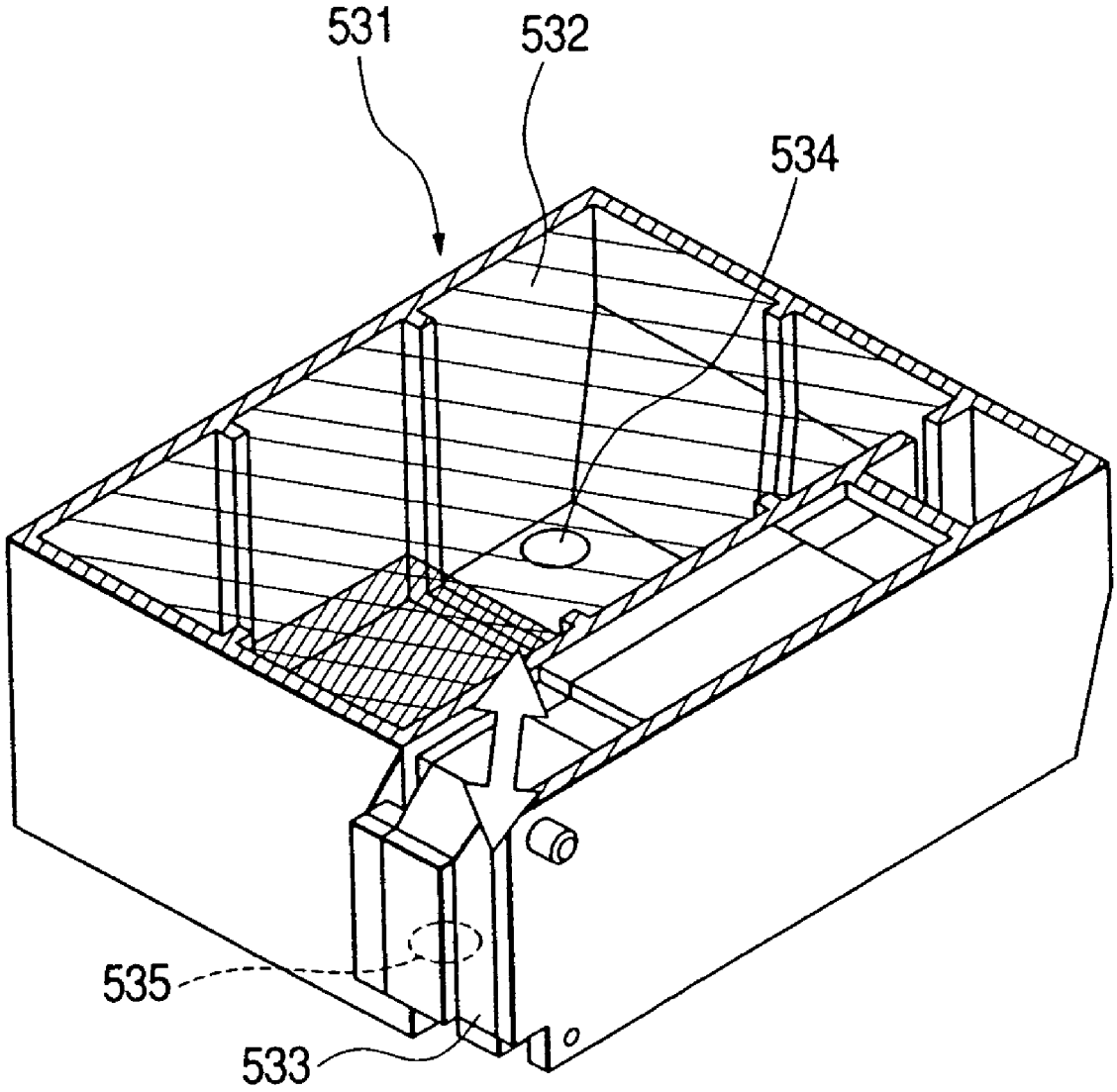
FIG. 35 is a view showing an example of an ink tank that is preferable for providing the solid semiconductor element according to the various embodiments of the present invention therein.

In addition, an ink tank 531 shown in FIG. 35 contains a porous material 532 holding ink, to which an ink jet head 533 that uses the contained ink for recording is attached. In the tank 531 with such a configuration, the solid semiconductor elemetns 534 and 535 of the present invention may also be disposed on the ink tank side and the ink jet head side, respectively, to exchange information on ink inside each divided part.

Figure 37A:
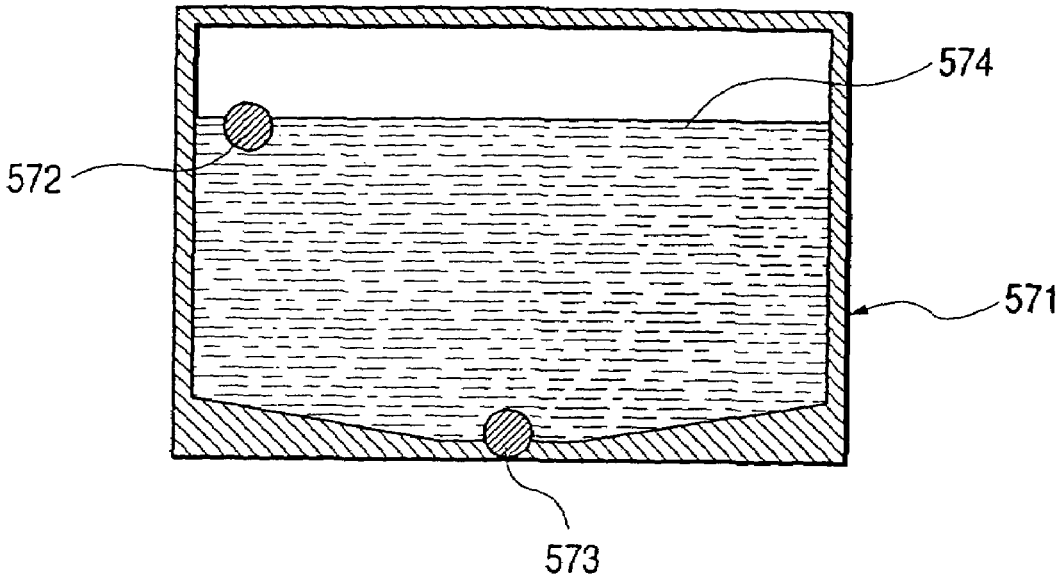
FIGS. 37A and 37B are sectional views illustrating a method of detecting existence of ink, which can be attained by combining a plurality of solid semiconductor elements.
Figure 37B:
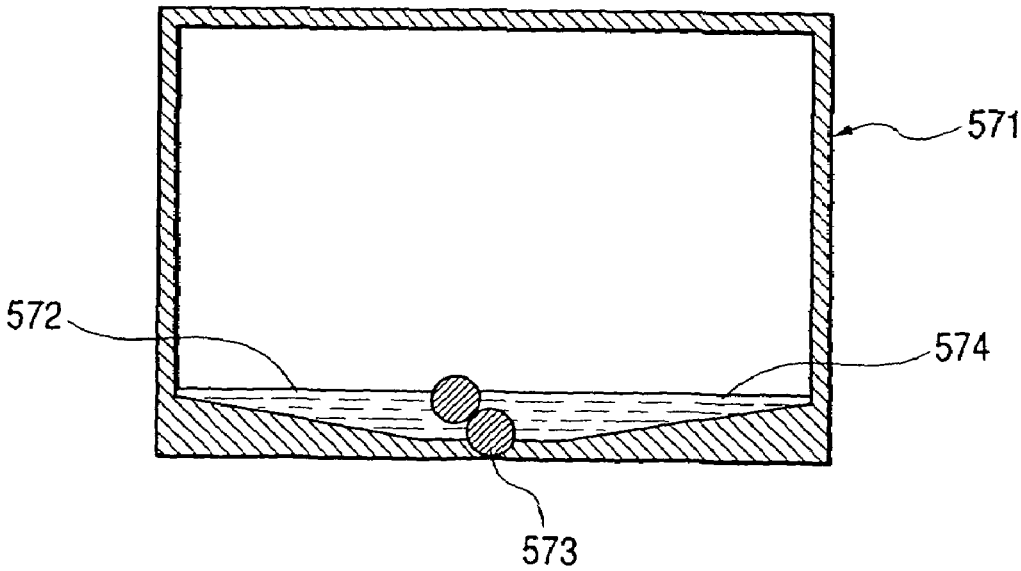

In addition, FIGS. 37A and 37B show sectional views illustrating examples of detecting presence of ink using a plurality of solid semiconductor element.

FIGS. 37A and 37B show ink tank 571 in which only ink is contained and other media such as a sponge are not contained at all or a part of the ink tank 571. Solid semiconductor elements 572 and 573 are disposed in the ink tank 571. The solid semiconductor element 572 floats on a liquid level of ink in the ink tank 571, and the solid semiconductor element 573 is fixed at the deepest part of the bottom surface in the ink tank 571. First, in the state in which ink normally exists in the ink tank 571 as shown in FIG. 37A, the solid semiconductor elements 572 and 573 do not mutually communicate. However, it is possible, for example, to detect a state of ink by the solid semiconductor element 572 or 573 alone. When an ink residual amount in the ink tank 571 decreases and most ink is consumed to reach the state of FIG. 37B, since the bottom surface of the ink tank 571 has a slant and the solid semiconductor element 573 is fixed in the deepest part of the bottom surface, the solid semiconductor elements 573 and 572 contact each other. Then, detection of presence of ink is possible with a method of communicating to the outside that the ink has run out by the solid semiconductor elements 573 and 572 contacting each other. That is, it is possible that a new function is provided by a plurality of solid semiconductor elements being combined or contacting each other.

As described above, two or more solid semiconductor elements are disposed in an ink tank, and the two or more solid semiconductor elements mutually communicate, whereby environmental information around the solid semiconductor elements is detected and the environmental information is communicated to or displayed on the outside. Thus, information on ink contained in the ink tank, a pressure in the tank or the like can be more easily communicated to, for example, an ink jet recording apparatus in the outside on a real time basis.

If two or more solid semiconductor elements are disposed in an ink tank in this way, as a method of supplying electromotive force from the outside to the plurality of solid semiconductor elements, there is a method of directly supplying electromotive force from the outside to each of the plurality of solid semiconductor elements as described above. Alternatively, electromotive force may be first supplied from the outside to a main solid semiconductor element among the plurality of solid semiconductor elements, and then supplied to the other solid semiconductor elements from the main solid semiconductor element.

(Other Examples)

Figure 40:
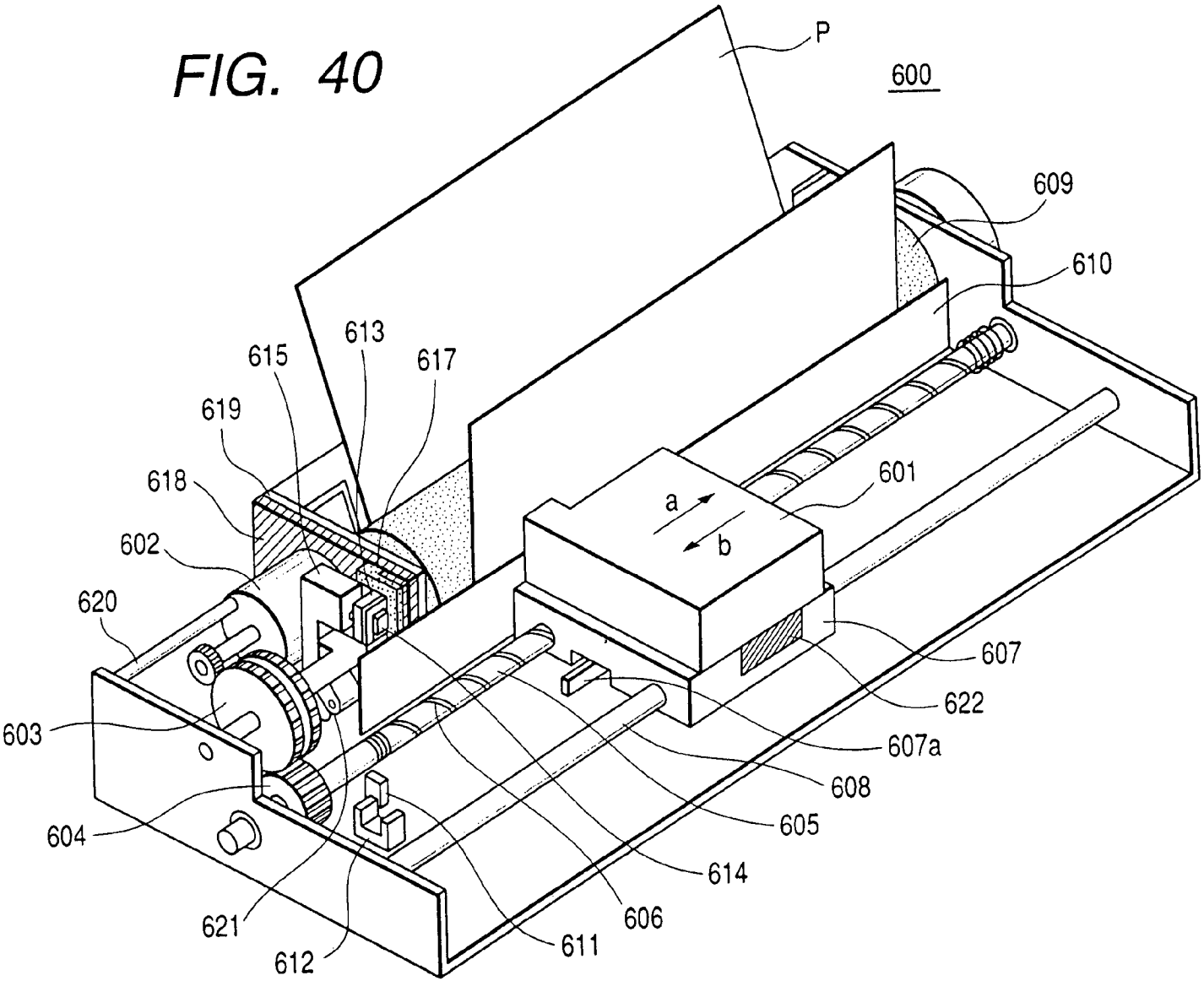

An example of a configuration of an ink jet recording apparatus mounted with an ink tank, which is provided with the solid semiconductor element of the present invention, is schematically shown in FIG. 40. A head cartridge 601 mounted on an ink jet recording apparatus 600 shown in FIG. 40 has a liquid discharge head for discharging ink for printing and recording and an ink tank, as shown in FIGS. 12 to 22, for holding liquid supplied to the liquid discharge head. In addition, means 622 for supplying electromotive force being external energy to a cubit semiconductor element disposed in the ink tank or means (not shown) for bidirectionally communicating information with the element are disposed in the recording apparatus 600.

As shown in FIG. 40, the head cartridge 601 is mounted on a carriage 607 that engages in apical grooves 606 of a lead screw 605, which rotates via driving force transmission gears 603 and 604 in an interlocking manner with forward and reverse rotations of a driving motor 602. The head cartridge 601 is reciprocatingly moved in the directions of arrows a and b along a guide 608 with the carriage 607 by power of the driving motor 602. Means for conveying medium for recording information thereon (not shown) is provided in the ink jet recording apparatus 600, which conveys a print sheet P as a medium for recording information thereon for receiving liquid such as ink discharged from the head cartridge 601. A sheet pressing plate 610, which presses a print sheet P conveyed on a platen 609 by the means for conveying medium for recording information thereon, presses the print sheet P against the platen 609 over a moving direction of the carriage 607.

A photo couplers 611 and 612 are disposed in the vicinity of one end of the lead screw 605. The photo couplers 611 and 612 are home position detecting means for confirming existence of a lever 607*a* of the carriage 607 in the areas of the photo couplers 611 and 612 to perform switching of the like of a rotational direction of the driving motor 602. A supporting member 613 for supporting a cap member 614, which covers the front of the head cartridge 601 having a discharge opening, is provided in the vicinity of one end of the platen 609. In addition, ink absorbing means 615 for absorbing ink accumulated inside the cap member 614 by being vainly discharged from the head cartridge 601 is also provided. Absorption recovery of the head cartridge 601 is performed via an opening part of the cap member 614 by this ink absorbing member 615.

A main body supporting body 619 is provided in the ink jet recording apparatus 600. A moving member 618 is movably supported in the front and back direction, that is, in a perpendicular direction with respect to a moving direction of the carriage 607 by the main body supporting body 619. A cleaning blade 617 is attached to the moving member 618. A form of the cleaning blade 617 is not limited to this and may be any publicly known cleaning blade of other forms. Moreover, a lever 620 for starting absorption in performing absorption recovery operations by the ink absorbing means 615 is provided. The lever 620 moves in accordance with the movement of a cam 621 engaging with the carriage 607, and driving force from the driving motor 602 is controlled by publicly known transmitting means such as switching of a clutch. An ink jet recording control portion is provided on the recording apparatus main body side, which gives a signal to a heating body provided in the head cartridge 601 and manages driving control of each of the above-mentioned mechanisms, and is not shown in FIG. 40.

In the ink jet recording apparatus 600 having the above-mentioned configuration, the head cartridge 601 reciprocatingly moves over the entire width of the print sheet P that is conveyed on the platen 609 by the means for conveying medium for recording information thereon. When a driving signal is supplied from a driving signal supplying means (not shown) to the head cartridge 601 at the time of the movement, ink (recording liquid) is discharged from a liquid discharge head to a medium for recording information thereon according to this signal and recording is performed.

A preferred specific example in disposing the solid semiconductor element of the present invention in an ink tank will now be described more in detail.

First, information acquiring means applicable to the solid semiconductor element of the present invention will be described as an example. If the solid semiconductor element disposed in an ink tank is formed in a spherical silicon, as the information acquiring means described in the above-mentioned example, there are (1) a sensor detecting pH of ink, in which an $SiO_2$ film or an SiN film is made as an ion sensitive film, (2) a sensor for detecting presence of ink from a moisture amount in the tank by using a conducting effect of a material, or the like.

Figure 41:
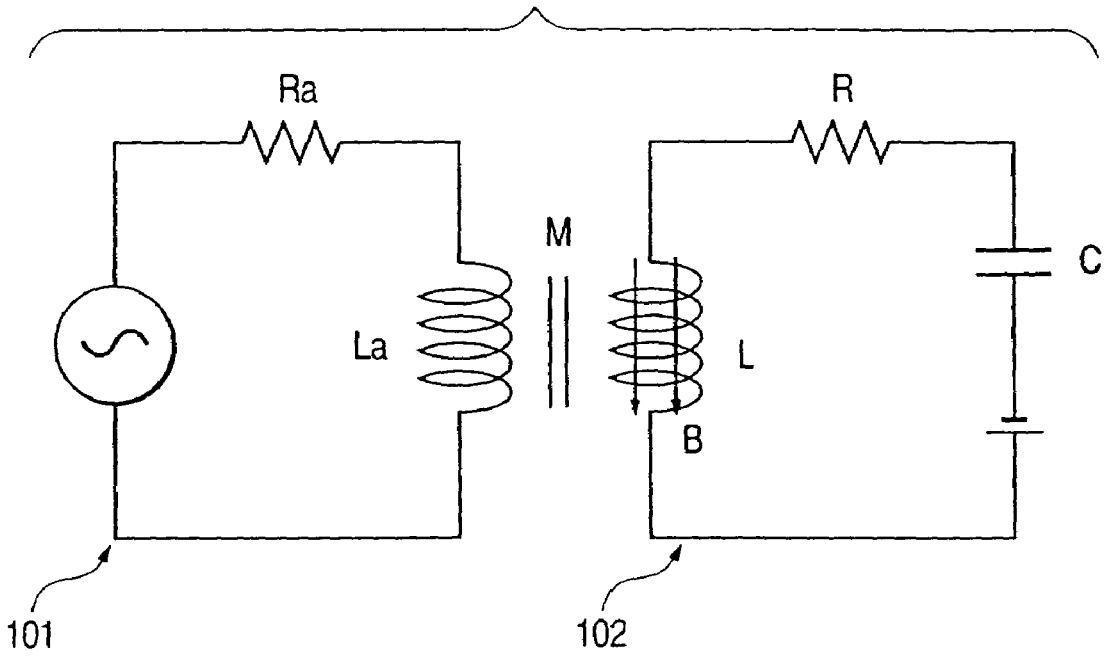
FIG. 41 is a view illustrating a theory of generating electricity of energy generating means that is an element of the solid semiconductor element of the present invention.

A specific example of energy generating means applicable to the solid semiconductor element of the present invention will be described next. FIG. 41 illustrates a theory of generating electricity of energy generating means that is an element of the solid semiconductor element of the present invention.

In FIG. 41, when an electric conductor coil L of an oscillating circuit 102 is placed adjacent a coil La of an external oscillating circuit 101 and an electric current la is flown to the coil La through the external oscillating circuit 101, a magnetic flux B is generated which penetrates the coil L of the oscillating circuit 102 by the current la. Here, since the magnetic flux B penetrating the coil L changes when the electric current la is changed, inductive electromotive force V is generated in the coil L. Therefore, the oscillating circuit 102 as the energy generating means is formed in a spherical silicon, and the external oscillating circuit 101 is disposed in, for example, an ink jet recording apparatus outside the element. Thus, the electric conductor coil L of the oscillating circuit 102 on the element side and the coil La of the oscillating circuit 101 outside the element are adjacent each other, whereby electricity for operating the element can be generated by inductive electromotive force by electromagnetic induction from the outside.

In addition, the magnetic flux B penetrating the coil L with the number of turns N of the oscillating circuit 102 formed in the spherical silicon as the energy generating means is proportional to a product of the number of turns Na of the coil La of the external oscillating circuit 101 and the electric current la. Thus, when a proportional constant is k, the following expression is found:

$$B=K*Na*Ia$$

Electromotive force V generated in the coil L is:

$$\begin{aligned} V &= -N\{dB/dt\} \\ &= -kNaN\{dIa/dt\} \\ &= -M\{dIa/dt\} \end{aligned}$$

Here, when a magnetic permeability of a magnetic core of the coil is $\mu_a$ and a magnetic field is H, the magnetic flux B is:

$$\begin{aligned} B &= \mu_a H(z) \\ &= \{\mu_a N_a I_a r_a^2 / 2(r_a^2 + z^2)^{3/2}\} \end{aligned}$$

Here, z indicates a distance between the coil of the external oscillating circuit and the coil formed in the spherical silicon.

Mutual inductance M of the expression is:

$$\begin{aligned} M &= \{\mu N / I_a \mu Ia\} \int_s B \cdot dS \\ &= \{\mu\mu_a r_a^2 N_a NS / 2\ \mu_0 (r_a^2 + z^2)^{3/2}\} \end{aligned}$$

Here, $\mu_0$ is a magnetic permeability of vacuum.

Then, impedance Z of the oscillating circuit formed in the spherical silicon is represented as:

$$Z(\omega)=R+j\{\omega L-(1/\omega C)\}$$

and impedance Za of the external oscillating circuit is:

$$Za(\omega)=Ra+j\omega La-\{\omega^2M^2/Z(\omega)\}$$

Here, J represents magnetization. Impedance Zo at the time when this external oscillating circuit oscillates (an electric current value la is maximum) is:

$$Zo(\omega_0)=Ra+jLa\omega_0-(\omega_0^2M^2/R)$$

and a phase lag $\phi$ of this oscillating circuit is:

$$\tan\phi=\{jLa\omega_0-(\omega_0^2M^2/R)\}/R$$

An oscillating frequency $f_0$ of this external oscillating circuit can be found by:

$$f_0=\tfrac{1}{2}\pi(LC)^{1/2}$$

According to the relation as described above, when the impedance of the oscillating circuit 102 formed in the spherical silicon changes in response to the change in the amount of the ink in the ink tank, the frequency of the external oscillating circuit 101 is changed, and the above-mentioned change in the amount of the ink appears in an amplitude and a phase difference of the impedance of the external oscillating circuit 101. Moreover, this phase difference and amplitude include an ink residual amount (i.e., variation of z) as well.

For example, if an oscillating frequency of the external oscillating circuit 101 is made variable, an output (impedance) from the oscillating circuit 102 formed in the spherical silicon changes in response to environmental changes of the surrounding. Thus, presence of ink or the ink residual amount can be detected by detecting this dependency on frequency.

Therefore, an oscillating circuit to be formed in a spherical silicon can be used not only as an energy generating means for generating electricity but also as a part of means for detecting changes in the amount of ink in a tank according to a relation between the oscillating circuit and an external oscillating circuit.

Incidentally, the element 11 may be floated on a liquid level of ink. Such an element 11 floating on a liquid level of ink will be hereinafter described together with a method of manufacturing the same.

FIGS. 45A to 45G are views showing a series of steps for illustrating an example of a method of manufacturing a solid semiconductor element 11 of a floating type using a spherical silicon that becomes a base of the above-mentioned ball semiconductor. Further, in FIGS. 45A to 45G, each step is shown by a cross section through the center of the spherical silicon. In addition, a manufacturing method is described as an example, which creates the spherical silicon such that a center of gravity is in a part lower than the center and an upper part inside the sphere is made hollow, and further the hollow part is held in a hermetic state.

Figure 45A:
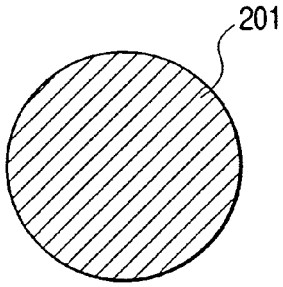
FIGS. 45A, 45B, 45C, 45D, 45E, 45F and 45G are views showing a series of steps for illustrating an example of a method of manufacturing a solid semiconductor element of a floating type.
Figure 45B:
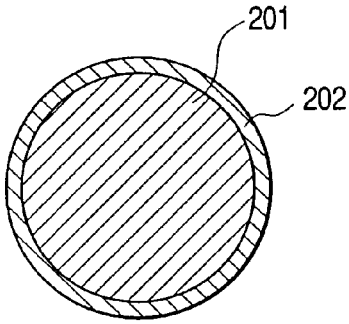
Figure 45C:
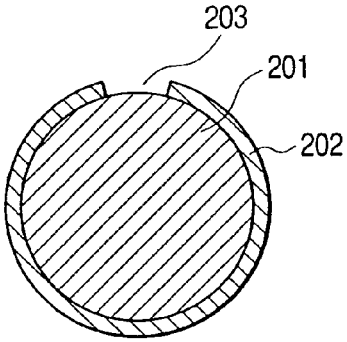

First, as shown in FIG. 45C, a thermally oxidized $SiO_2$ film 202 is formed on the entire surface of a spherical silicon 201 shown in FIG. 45A. Thereafter, in order to form an opening 203 in a part of the $SiO_2$ film 202 as shown in FIGS. 45A to 45G, patterning is performed using a photolithography process.

Figure 45D:
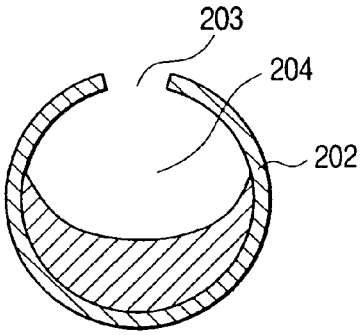
Figure 45E:
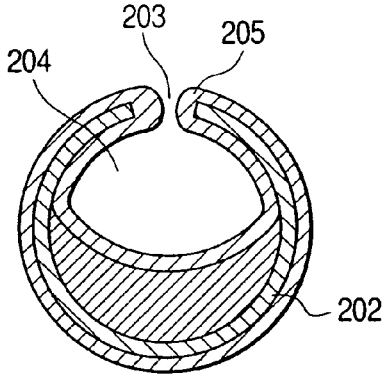

Then, as shown in FIG. 45D, an upper half of the spherical silicon 201 is removed by anisotropic etching using a KOH solution through the opening 203, and a hollow part 204 is formed. Thereafter, as shown in FIG. 45E, the entire exposed surfaces of the spherical silicon 201 and the $SiO_2$ film 202 including the internal surface of the hollow part 204 are coated with an SiN film 205 using an LPCVD method.

Figure 45F:
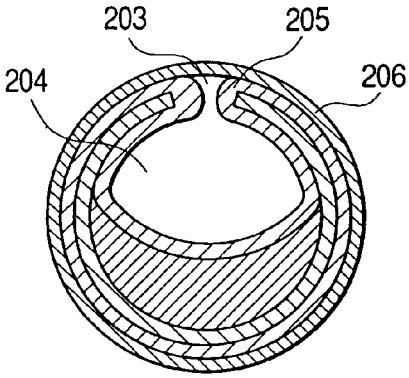
Figure 45G:
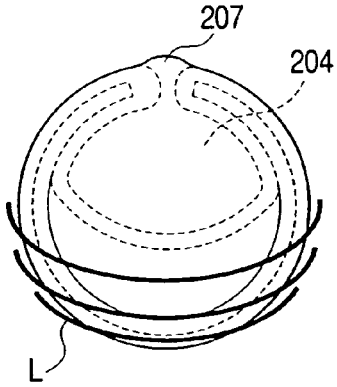

Moreover, as shown in FIG. 45F, a Cu film 206 s formed on the external surface of the SiN film 205 using a metal CVD method. Then, as shown in FIG. 45G, the Cu film 206 is patterned using the well-known photolithography process, and the electric conductor coil L being a part of the oscillating circuit 102 is formed with the number of turns N. Thereafter, the solid semiconductor element, in which the electric conductor coil L is formed, is forced out into the air from a vacuum apparatus, the opening 203 in the upper part is plugged by a sealing member 207 such as resin or a plug, and the hollow part 204 inside the sphere is placed in a closed state. If the element is manufactured in this way, the element itself formed of silicon can be given buoyance force.

(Stabilization of a Floating Type Solid Semiconductor Element on a Liquid Level)

If a solid semiconductor element is configured to have a hollow part, and supply of electricity to the solid semiconductor element is performed by the above-mentioned oscillating circuit and external oscillating circuit, a stable magnetic flux (magnetic field) is required to work between the oscillating circuit formed in the element and the external oscillating circuit in the outside, whatever state an ink tank is placed. That is, the direction of the element with respect to the external oscillating circuit is required to be stable. However, if the element is floating in liquid such as ink, the liquid level may be oscillated by external oscillation to vary the direction of the element. Even in such a case, the center of gravity of a floating type solid semiconductor element is determined as follows such that the element holds a stable posture in the liquid.

Figure 46B:
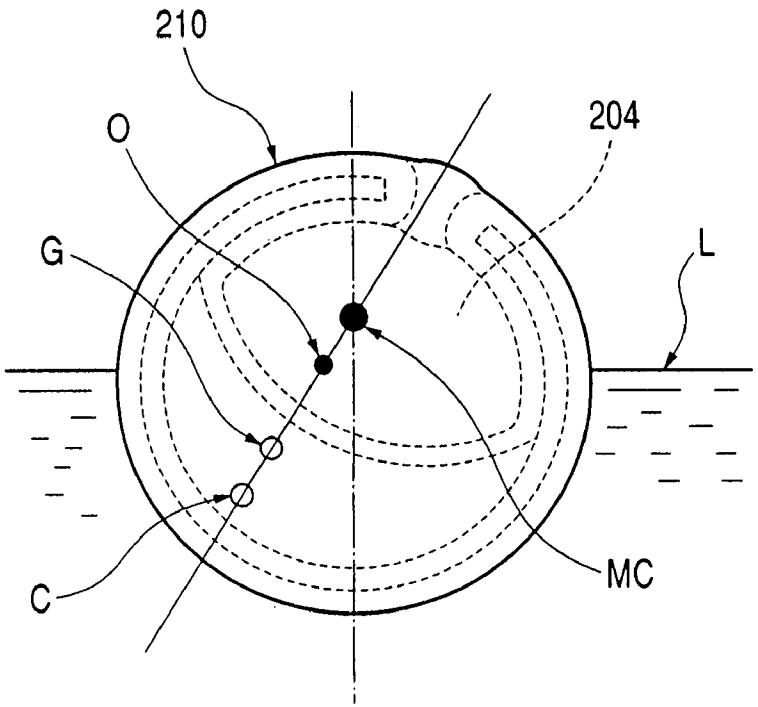
FIGS. 46A and 46B are views for illustrating conditions for a solid semiconductor element to hold a stable state in liquid.
Figure 46A:
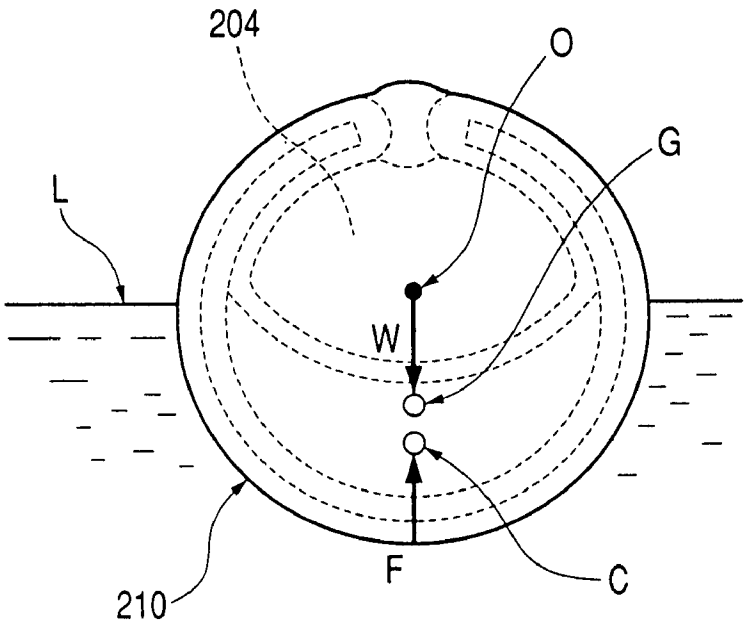

As shown in FIGS. 46A and 46B, if a solid semiconductor element 210 formed as a sphere is floated in liquid, the following relations are required to be realized such that the solid semiconductor element 210 is in a balanced state as shown in FIG. 46A:

(1) Buoyance force F=Weight W of an object, and (2) A line of action of buoyance force and a line of action of weight (a line passing through a center of gravity G) coincide with each other.

Then, as shown in FIG. 46B, when liquid oscillates by an external force and the solid semiconductor element 210 slants from the balanced state, the center C of buoyance force moves and the buoyance force and the weight make a couple.

Here, an intersection of a line of action of weight in a balanced state (an alternate long and short dash line in FIG. 46B) and a line of action of buoyance force when slanted (a solid line in FIG. 46B) is referred to as a meta-center (MC). A distance h between the meta-center and the center of gravity G is referred to as a height of the meta-center. Further, a symbol V in the figure denotes a liquid level of ink.

The meta-center of the solid semiconductor element 210 is in a position higher than the center of gravity G, whereby the couple (restoring force) acts in the direction of returning the solid semiconductor element to the original balanced position. This restoring force T is represented as:

$$T = Wh\sin\theta = Fh\sin\theta$$

$$= \rho gVh\sin\theta \ (>0)$$

Here, V is a volume of liquid removed by the solid semiconductor element 210, and ρg is a specific weight of the solid semiconductor element 210.

Thus, in order to make this restoring force T positive, h>0 is a necessary and sufficient condition.

Then, from FIG. 46B, the following expression is found:

$$h=(I/V)-\overline{CG}$$

Here, I is an inertia moment around an ○ axis. Thus, $$(I/V)>\overline{CG}$$

is a necessary and sufficient condition for the solid semiconductor element 210 steadily floating in ink, and supplying inductive electromotive force from an external oscillating circuit and bidirectionally communicating with communicating means outside the element.

Figure 42:
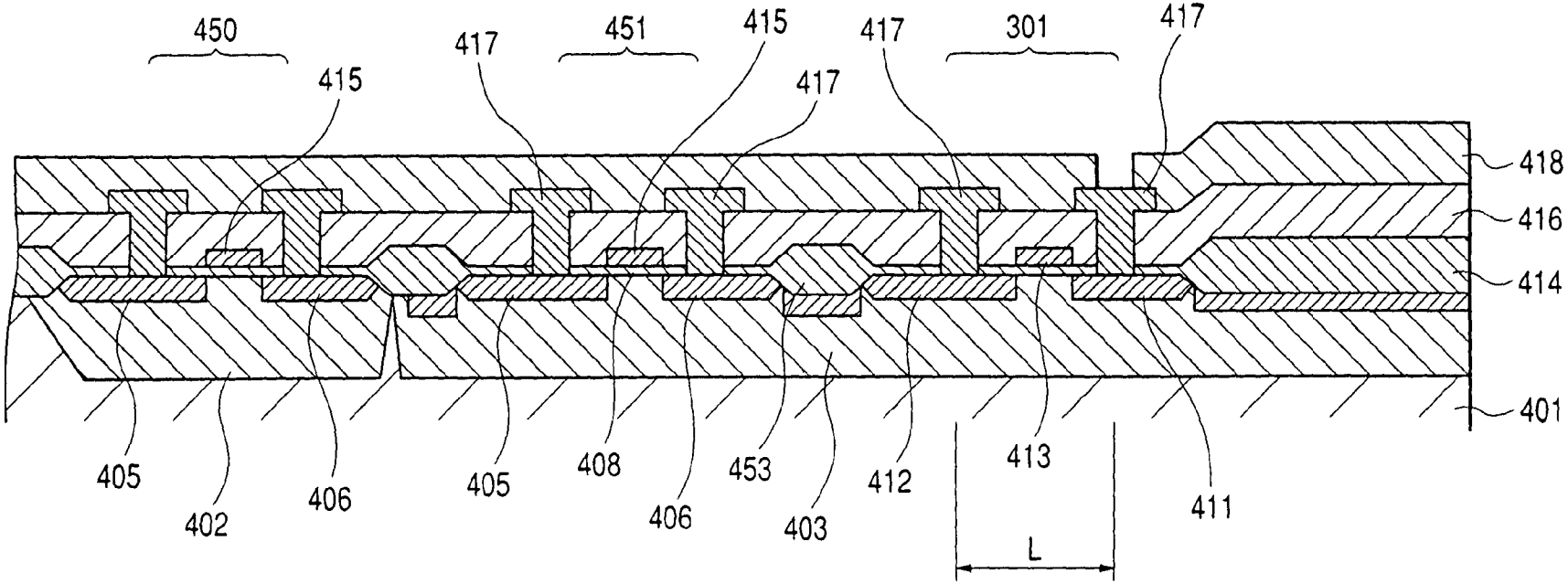
FIG. 42 is a schematic vertical sectional view of an N-MOS circuit element of the solid semiconductor element used in the ink tank of the present invention.

In order to manufacture a driving circuit of such a solid semiconductor element, an N-MOS circuit element is used. FIG. 42 shows a schematic sectional view of an N-MOS circuit element that is cut vertically.

According to FIG. 42, a P-Mos 450 is formed in an N-type well region 402 and an N-Mos 451 is formed in a P-type well region 403 by introduction and diffusion of an impurity such as ion implantation using a general Mos process in an Si substrate 401 of a P electric conductor. The P-Mos 450 and the N-Mos 451 are respectively composed of, via a gate insulation film 408 of a thickness of several hundred angstroms, a gate wiring 415 by poly-Si appplied by a CVD method in the thickness of 4,000 angstroms or more to 5,000 angstroms or less and a source region 405, a drain region 406 or the like to which an N-type or P-type impurity is introduced. A C-Mos logic is formed of the P-Mos 450 and the N-Mos 451.

An N-Mos transistor 301 for driving an element is composed of a drain region 411, a source region 412, a gate wiring 413 and the like on the P-type well substrate 403 also by the steps of introduction, diffusion or the like of an impurity.

Here, if the N-Mos transistor 301 is used as an element driver, a distance L between drain gates forming one transistor is approximately 10 μm at the minimum. A part of the distance L of 10 μm is a width of a contact 417 between a source and a drain, which is 2×2 μm. However, since a half of the width is shared with a neighboring transistor, an actual width is 2 μm. The distance L also consists of 4 μm that is 2×2 μm equivalent to a distance between the contact 417 and the gate 413 and 4 μm that is a width of the gate 413. These make the total distance 10 μm.

An oxide film separating region 453 is formed by field oxidation of the thickness of 5,000 angstroms or more to 10,000 angstroms or less between each element, and the element is separated. This field oxide film acts as a heat reserve layer 414 of the first layer.

After each element is formed, a layer insulating film 416 is formed of a PSG film, a BPSG film or the like by the CVD method in the thickness of approximately 7,000 angstroms, and is subject to a leveling processing or the like by thermal processing. Then, wiring is set to the layer insulating film 416 by an AI electrode 417 to be a first wiring layer via a contact hole. Thereafter, a layer insulating film 418 of an $SiO_2$ film or the like by the plasm CVD method is deposited in the thickness of 10,000 angstroms or more to 15,000 angstroms or less to further form a through hole.

The N-Mos circuit is formed as described above, and is connected to an oscillating circuit as the energy generating means of the present invention, a sensor portion as the information acquiring means or the like via the above-mentioned through hole.

As a method of bidirectionally communicating with an external communicating means of the solid semiconductor element formed as described above, an wireless LAN system using a microwave band frequency or a wireless access system utilizing a submillimeter wave/millimeter wave band frequency can be applied.

An outline of transmission and reception by the wireless LAN system will now be described. Data transmission from a solid semiconductor element to a recording apparatus will be described below. Further, if data is transmitted from the recording apparatus side to the solid semiconductor element to the contrary, a data ID is given to each side, and a transmitting side and a receiving side are determined by the IDs.

The solid semiconductor element on the transmission side has a line monitoring portion, a data handling portion, an acknowledge checking portion and an error processing portion. The recording apparatus on the receiving side is provided with a data handling portion, an acknowledging portion, an error processing portion, a display portion and the like.

Figure 43:
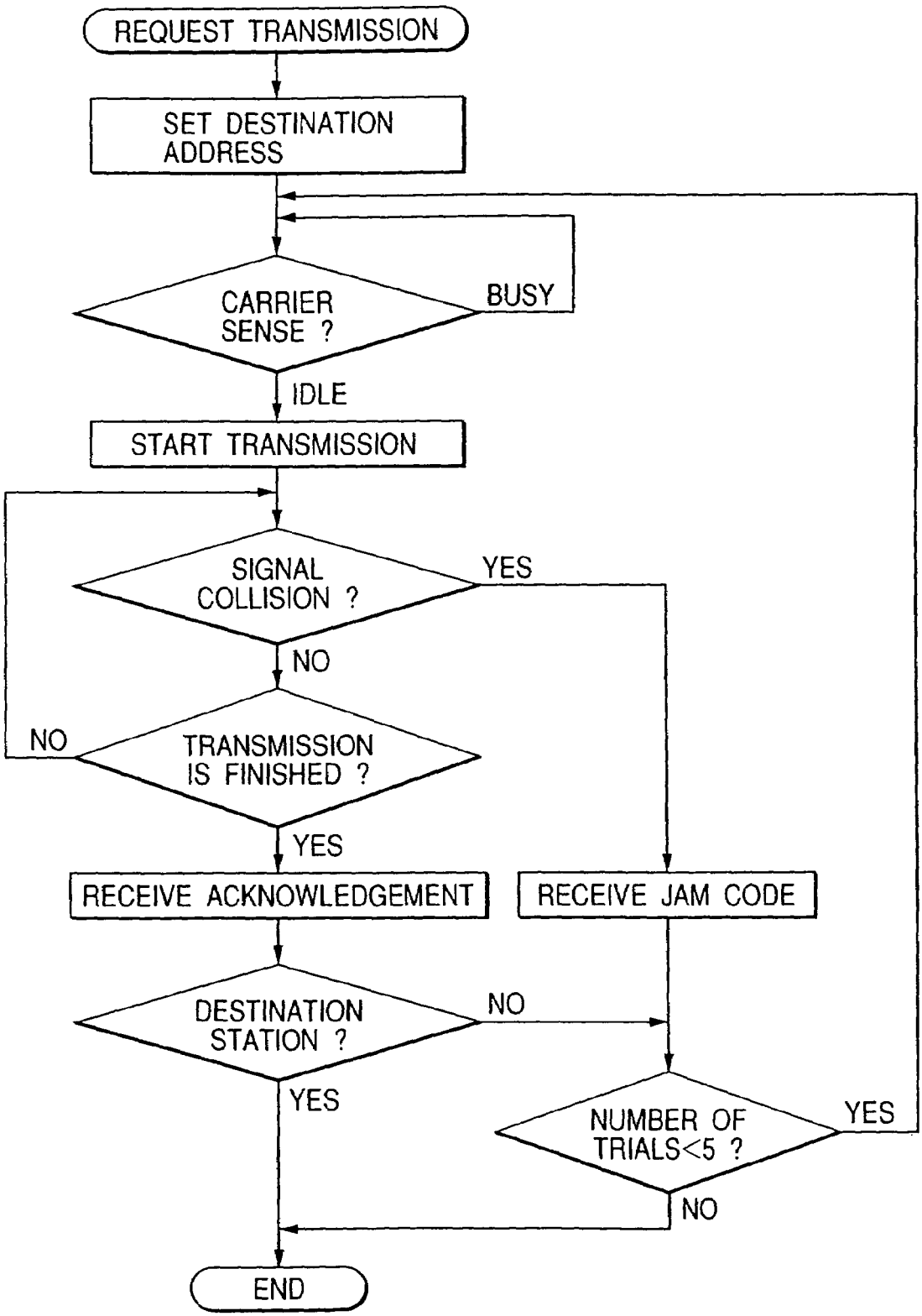
FIG. 43 is a flow chart of operations in a solid semiconductor element on a transmitting side in the case in which a bidirectional communication is performed between a solid semiconductor element and a recording apparatus according to the ink tank of the present invention.

FIG. 43 shows a flow chart of operations in the solid semiconductor element on the transmission side. When data transmission is executed, an initial setting is performed and then an address on the receiving side is set by a defined transmission protocol to transmit data. If a collision of signals occurs during transmission or an acknowledgment is not returned from a designated apparatus on the receiving side, the data is transmitted again. During an operation, a state of a line or presence of an acknowledgment is displayed on the display portion provided in the recording apparatus on the receiving side to urge a user to make an appropriate determination.

Figure 44:
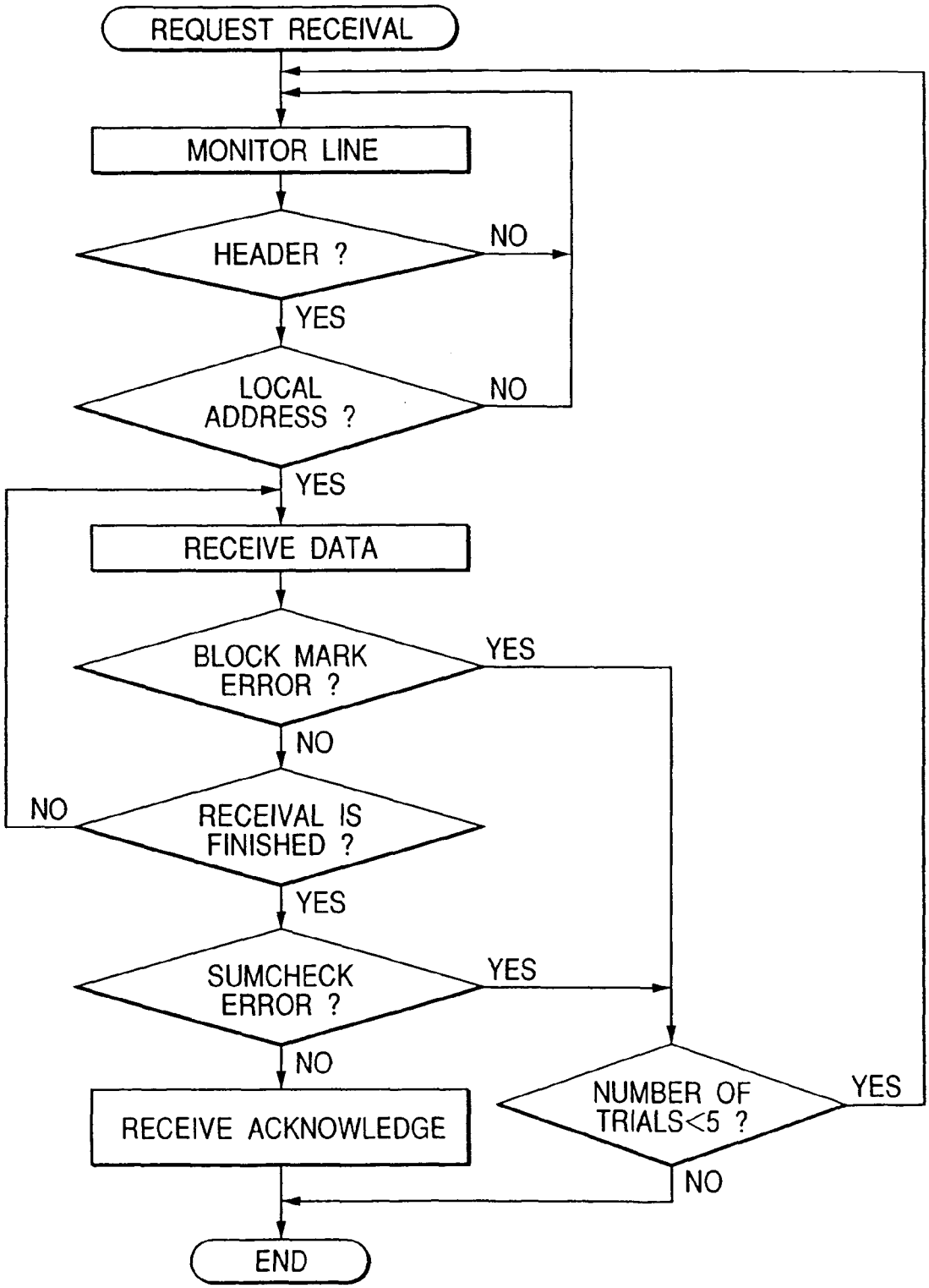
FIG. 44 is a flow chart of operations in a recording apparatus on a receiving side in the case in which a bidirectional communication is performed between a solid semiconductor element and a recording apparatus according to the ink tank of the present invention.

FIG. 44 shows a flow chart of operations in the recording apparatus on the receiving side. In this receiving side, the recording apparatus always monitors a line and, when confirming its own address, takes in data from a line and accumulate the data in a buffer on a main memory. During reception, if a block mark for each 16 bites cannot be confirmed or a check sum does not match in an error detection processing after completing the reception, the recording apparatus determines that a reception error has occurred to stop the reception and monitors the line again to wait for arrival of a header. If the reception is finished without an error, the recording apparatus displays received contents on the display portion.

In the solid semiconductor element of the example as described above, electromagnetic induction by a coil is used as external energy for supplying electricity for activating the element. However, light may be used as the external energy. When contrast of the light is converted into an electric signal, electricity can be generated by a photoconductive effect using a material whose resistance value changes by irradiation of light (e.g., photoconductor). As a photoconductor, for example, a binary alloy/a ternary alloy such as CdS, InSb, $Hg_{0.8}Cd_{0.2}Te$ or the like, GaAs, Si, Va-Si or the like are used. Moreover, if heat is used as electromotive force, electricity can be generated from radiant energy of a material by a quantum effect.

Further, an exterior of the ink jet recording apparatus is not shown in this example. However, if a translucent cover is used through which a state of the inside is visible and a translucent ink tank is used, a user can see light in the tank. Thus, the user can easily recognize that "replacement of a tank is required" and is urged to replace the tank. (Conventionally, although a button on an apparatus main body flashes, since the button performs several display functions, it is difficult for a user to know what the flashing button means.)

As described above, according to the present invention, a solid semiconductor element is embedded in an outer wall or an inner wall of an ink tank to be exposed from the outer wall or the inner wall such that it contacts ink, which is provided with acquiring means for acquiring environmental information, information storing means, discriminating means for comparing acquired information and stored information to make a determination and information communicating means for displaying the acquired information or communicating the acquired information to the outside. Thus, a state of the ink can be simply and accurately grasped on a real time basis. In addition, if the solid semiconductor element is exposed to the outside of the ink tank and an electric contact is disposed in an exposed part, since there is nothing to block the element, ink information can be communicated efficiently. Moreover, the solid semiconductor element can supply its operation energy or exchange signals in a non-contact state or in connection with a terminal that is directly provided in a supporting portion or the like of the ink tank. Thus, the solid semiconductor element can acquire information such as an ink residual amount efficiently and communicate it to the outside with a simple configuration without drawing around wiring. In doing so, the information acquiring means can be preferably provided in a part exposed from the outer wall or the inner wall to a side contacting the ink of the solid semiconductor element such that information in the ink tank can be acquired.

Moreover, the solid semiconductor element is provided with communicating means for receiving a signal from the outside and acquires information in response to a received signal to communicate a result of comparison of the acquired information with stored information to the outside together with the acquired information. Thus, it is also possible to bidirectionally exchange signals with an external apparatus.

For example, if activation energy of the element is used as electricity, an electric conductor coil of an oscillating circuit is formed as external energy converting means to be wound around the external surface of the solid semiconductor element. Thus, electricity is generated in the electric conductor coil by electromagnetic induction between the coil and the external oscillating circuit, whereby the supply of operation energy in a non-contact state can be executed.

In this case, since the coil is wound around the external surface of the element, a magnitude of the inductance of the coil changes in response to, for example, a residual amount of ink, an ink concentration and ink pH in the ink tank. Therefore, since the oscillating circuit changes an oscillating frequency in response to the change in the inductance, it is possible to detect the residual amount of ink in the ink tank based on variations of the oscillating frequency to be changed.

As described above, with the communicating method of the present invention, a plurality of solid semiconductor elements are disposed in a predetermined container, and in communicating with a plurality of groups of elements with two or more solid semiconductor elements among the plurality of solid semiconductor elements in the predetermined container forming one group, communication is performed with a communication condition different for each of the groups of elements. Thus, it becomes possible to efficiently discriminate or select a pair of elements among a plurality of pairs of elements, or to perform communication and control among the elements. Alternatively, each of the plurality of solid semiconductor elements provided in the predetermined container has information for distinction or a memory, and communication is performed by recognizing the information for distinction or distinguishing information by the memory. Thus, it also becomes possible to efficiently discriminate or select a pair of elements among a plurality of pairs of elements, or to perform communication and control among the elements.

In addition, with the ink tank of the present invention, two or more solid semiconductor elements are disposed in the ink tank, and environmental information around the solid semiconductor elements is detected by mutually communicating between the two or more solid semiconductor elements to communicate the environmental information to the outside or display the environmental information. Thus, it becomes easy to communicate information on ink contained in the ink tank, a pressure in the tank or the like to, for example, an ink jet recording apparatus in the outside on a real time basis. This is advantageous in, for example, controlling an amount of negative pressure in the tank which changes every moment in accordance with ink consumption to stabilize ink jet discharge.

Moreover, since the ink tank has a configuration for supplying, in a non-contact state, external energy for operating an solid semiconductor element, it is not necessary to cause the ink tank have an energy source for activating the element or connecting wiring for supplying energy to the element. Thus, the ink tank can be used in a part where it is difficult to set wiring directly to the outside.

For example, if activation energy of the element is used as electricity, an electric conductor coil of an oscillating circuit is formed as external energy converting means to be wound around the external surface of the solid semiconductor element. Thus, electricity is generated in the electric conductor coil by electromagnetic induction between the coil and the external oscillating circuit, whereby the supply of operation energy in a non-contact state can be executed.

In this case, since the coil is wound around the external surface of the element, a magnitude of the inductance of the coil changes in response to, for example, a residual amount of ink, an ink concentration and ink pH in the ink tank. Therefore, since the oscillating circuit changes an oscillating frequency in response to the change in the inductance, it is possible to detect the residual amount of ink in the ink tank based on variations of the oscillating frequency to be changed.

In addition, the solid semiconductor element has a hollow part for floating in liquid, and is formed so that the center of gravity of the element is positioned lower than the center of the element. Thus, for example, even if the recording head and the ink tank amounted on then ink jet recording apparatus operate serially and ink in the ink tank rocks up and down or left and right, the solid semiconductor element can accurately detect information on the ink or a pressure in the tank while steadily floating in the ink in the ink tank. Moreover, the solid semiconductor element holds the above-mentioned coil of the oscillating circuit formed in the element in a stable position with respect to the coil of the external oscillating circuit, thereby also allowing stable bidirectional communication at all times.

Further, detection concerning a type of ink accumulated in an ink tank will now be described as an example of a configuration utilizing the solid semiconductor element described above.

Figure 47:
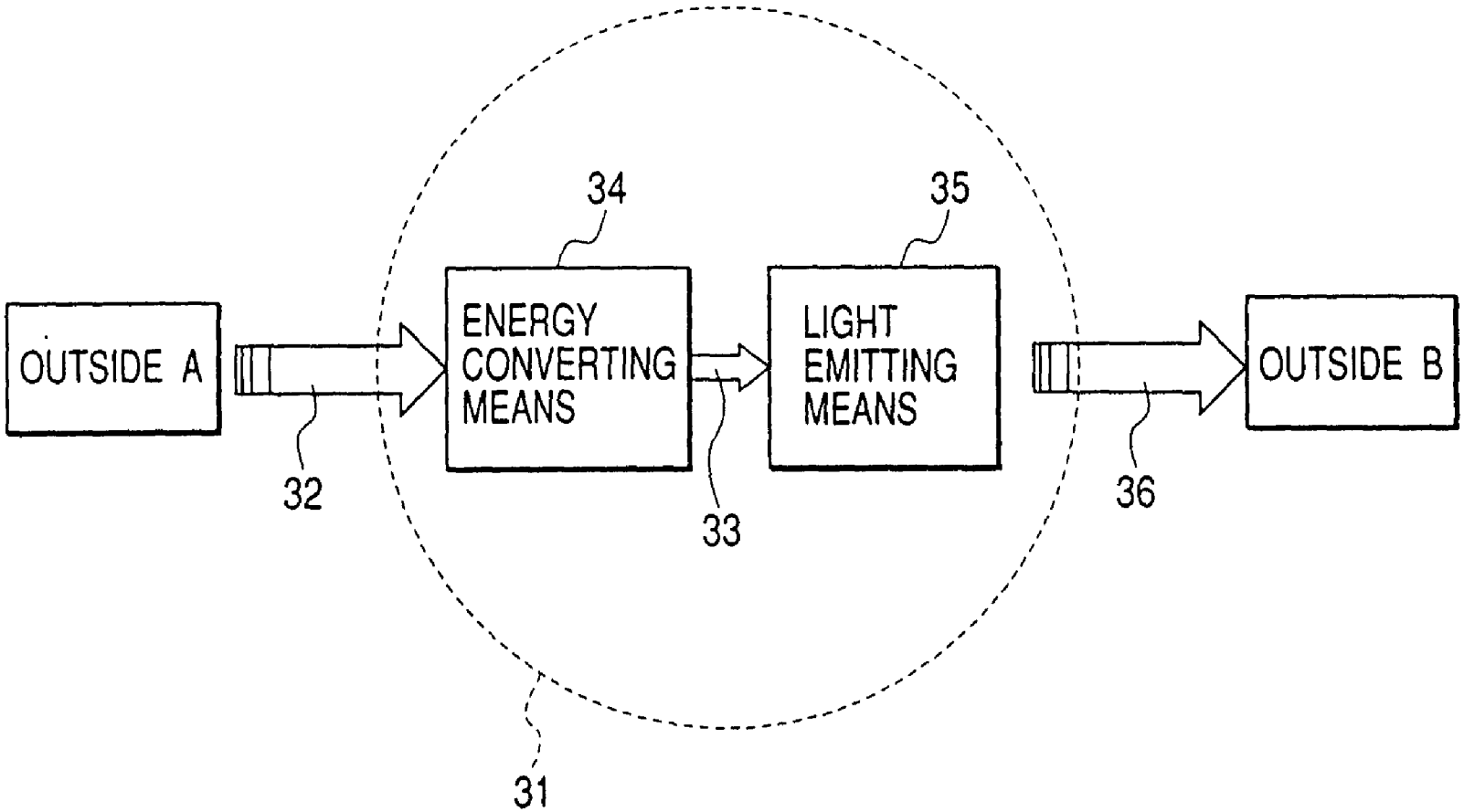
FIG. 47 is a block diagram illustrating an internal configuration and exchanges of information with the outside of a solid semiconductor element according to an embodiment of the present invention.

FIG. 47 is a block diagram illustrating an internal configuration and exchanges of information with the outside of an solid semiconductor element according to an embodiment of the present invention. A solid semiconductor element 91 of a form shown in this figure is provided with energy converting means 94 for converting electromotive force 92 being external energy supplied from the outside A toward the element 91 in a non-contact state into electricity 93 and light emitting means 95 for emitting light using the electricity acquired by the energy converting means 94, and is disposed in ink contained in an ink tank. The light emitting means 95 is composed of a photodiode or the like.

Further, as electromotive force to be supplied for operating the element, electromagnetic induction, heat, light, radiation or the like can be applied. In addition, the energy converting means 94 and the light emitting means 95 are preferably formed on the surface of the element or in the vicinity of the surface.

With such a form, when the electromotive force 92 is given from the outside A toward the element 91, the energy converting means 94 converts the electromotive force 92 into the electricity 93, and the light emitting means 95 emits light 96 using the electricity 93. Intensity of the light 96 emitted from the light emitting means 95 is detected by the outside B.

In addition, as a method of supplying external energy, it is sufficient to provide means for supplying electromotive force to the element as external energy in a recovery position, a return position, a carriage, a recording head or the like if it is used in an ink jet recording apparatus. Besides, if an apparatus having means for supplying electromotive force is used, a state inside an ink tank can be found without an ink jet recording apparatus, and if it is used, for example, in a factory or a sales shop, it can be used for inspection or the like (guarantee of quality).

Figure 48:
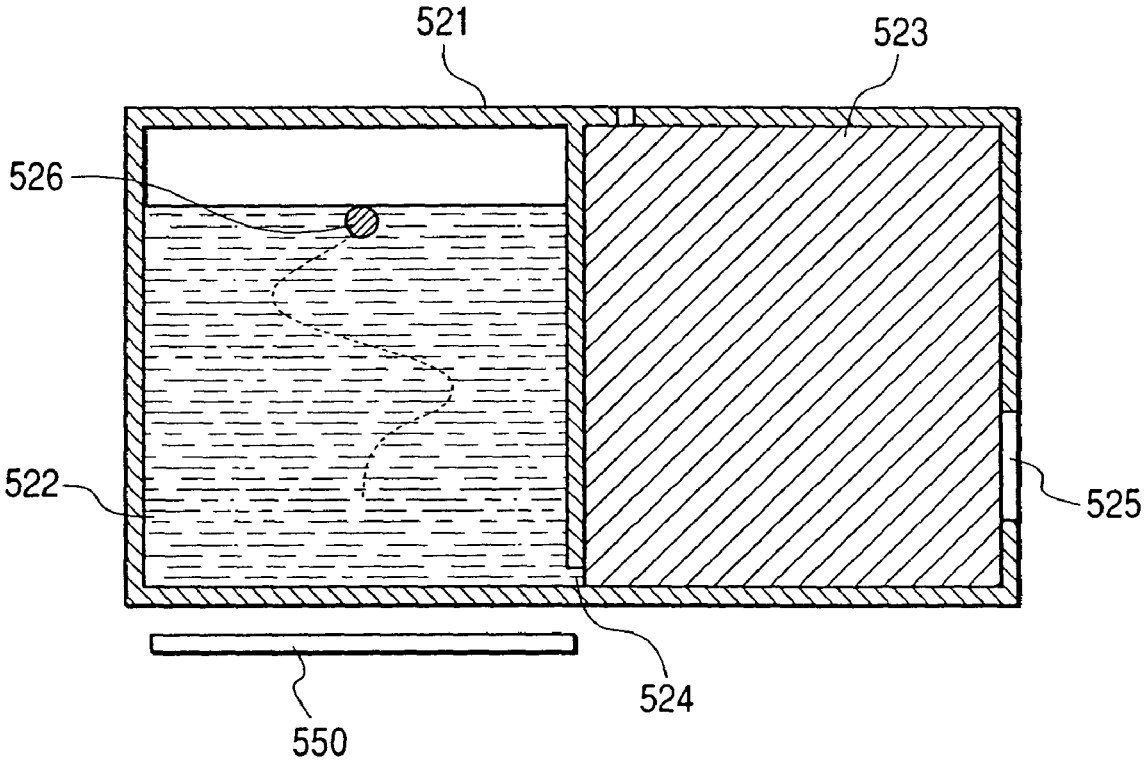
FIG. 48 is a schematic view of an ink tank using the solid semiconductor element of the present invention.

FIG. 48 is a schematic view of an ink tank using the solid semiconductor element of the present invention. A solid semiconductor element 526 shown in this figure floats in the vicinity of a liquid level of raw ink 522 in an ink tank 521. Electromotive force due to electromagnetic induction is induced by an external oscillating circuit (not shown) outside the ink tank 521, and a photodiode disposed in the vicinity of the surface of the solid semiconductor element 526 is driven, whereby the solid semiconductor element 526 emits light. The light penetrates through the ink 522 and received by an optical sensor 550 outside the ink tank 521.

Figure 49:
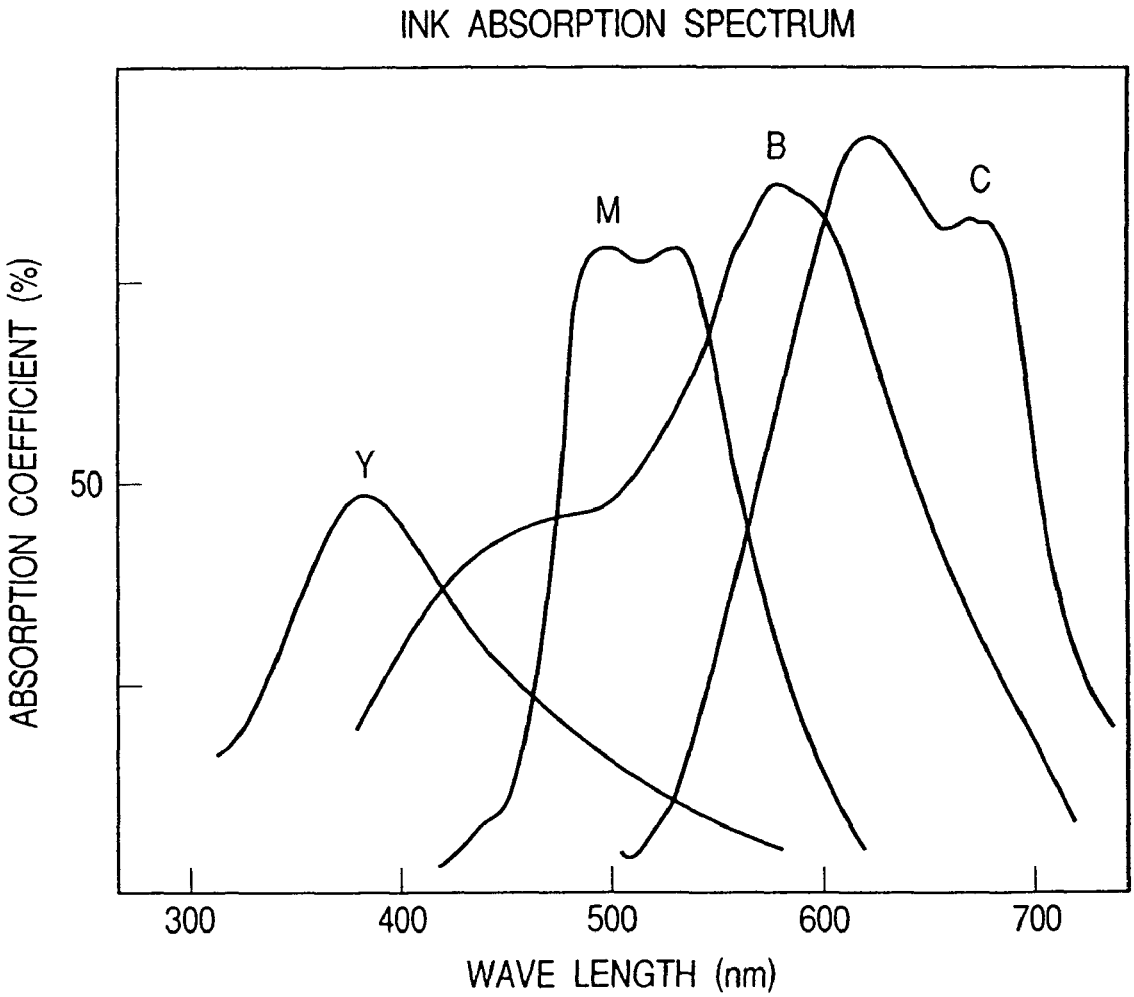
FIG. 49 is a graph showing absorption wave lengths of representative ink (yellow (Y), magenta (M), cyan (C) and black (B)).

FIG. 49 shows absorption wave lengths of representative ink (yellow, magenta, cyan and black). As it is seen from FIG. 49, ink of each color of yellow, magenta, cyan and black has a peak of an absorption coefficient dispersed in wavelength bands of 300 to 700 nm. The peak of an absorption coefficient of each color ink is approximately 390 nm for yellow, approximately 500 nm for magenta, approximately 590 nm for black and approximately 620 nm for cyan. Therefore, light including a wavelength in the range of 300 to 700 nm is emitted from an solid semiconductor element, caused to penetrate through the ink and received by the optical sensor 550 (see FIG. 40) in the outside of the ink tank to detect which wavelength of light is absorbed most. Thus, it is possible to determine which color among the above-mentioned colors is a color of the ink through which the light penetrates.

In addition, as it is seen from FIG. 49, the ink of each color of yellow, magenta, cyan and black has a clearly different absorption coefficient each other in the wave length of 500 nm. The absorption coefficient of the ink of each color in the wave length of 500 nm is approximately 80% for magenta, approximately 50% for black, approximately 20% for yellow and approximately 5% for cyan. Therefore, it is possible to determine, concerning the light with the wave length of 500 nm, which color among the above-mentioned colors is a color of the ink through which the light penetrates by detecting a ratio of an intensity of the light penetrating through the ink with respect to an intensity of the light emitted by the solid semiconductor element.

Further, in any of the above-mentioned cases, it is possible to dispose one kind of solid semiconductor element in different ink tanks, respectively, to discriminate a plurality of ink types.

In addition, in an ink jet recording apparatus that is configured such that each of a plurality of ink tanks is mounted in a predetermined position in accordance with a type of ink contained in each ink tank, means may be provided which gives warning to a user when the optical sensor 550 that receives light penetrating through ink in the ink tank detects that an ink tank is mounted in an inappropriate position. As the warning means in this case, light emitting means such as a lamp, sounding means such as a buzzer, or the like can be used. The user can learn that the ink tank is mounted in a wrong position by the warning given by the warning means, and can mount the ink tank in an appropriate position again.

Alternatively, in such an ink jet recording apparatus, controlling means may be provided which controls a recording head, to which ink is supplied from a mounted ink tank, according to the type of the ink when it is detected that the ink tank is mounted in an inappropriate position by an optical sensor receiving light that penetrates through the ink in the ink tank. With this controlling means, since appropriate image recording is automatically performed even if a user mounts an ink tank in a wrong position, the user is not required to pay special attention to a mounting position of an ink tank.

As described above, in the present invention, an solid semiconductor element has energy converting means for converting energy from the outside into energy of a different type and light emitting means for emitting light by the energy converted by the energy converting means. Thus, it is possible to cause light emitted from the solid semiconductor element to penetrate through ink and detect an intensity of the penetrating light in a certain wave length, thereby discriminating the type of the ink.

As many apparently widely different embodiments of the present invention can be made without departing from the spirit and scope thereof, it is to be understood that the invention is not limited to the specific embodiments thereof except as defined in the appended claims.

What is claimed is:

1. An ink tank for holding ink, which is supplied to a recording head for recording information by applying the ink on a medium for recording information thereon, in an ink containing chamber substantially surrounded by a wall, wherein said ink tank includes a solid semiconductor element, comprising:

information acquiring means for acquiring environmental information of the outside of said solid semiconductor element;

information storing means for storing information to be compared with the information acquired by said information acquiring means;

discriminating means for comparing the information acquired by said information acquiring means and information stored in said information storing means, which corresponds to the acquired information, to determine the necessity of communicating information; and information communicating means for displaying the information acquired by said information acquiring means or communicating the information to the outside of said ink tank if said discriminating means determines that it is necessary to communicate information, and wherein said solid semiconductor element is embedded in said wall such that a part of said solid semiconductor element is exposed from a side of said wall contacting the ink so that said exposed part directly contacts the ink, and said information acquiring means is disposed in the exposed part which directly contacts the ink.

2. An ink tank according to claim 1, wherein said solid semiconductor element is exposed from both sides of said wall.

3. An ink tank according to claim 2, wherein said wall is an outer wall forming a contour of said ink tank and has an electric contact in a part of said solid semiconductor element exposed to the outside of said solid semiconductor element.

4. An ink tank according to claim 2, wherein said wall is an outer wall forming a contour of said ink tank, and said information communicating means is disposed in a part of said solid semiconductor element exposed to the outside of said ink tank.

5. An ink tank according to claim 4, wherein said solid semiconductor element is disposed such that said information acquiring means can be seen from the outside of said ink tank, and said information acquiring means communicates information to the outside of said ink tank with a visually recognizable method.

6. An ink tank according to claim 1, including a first solid semiconductor element having a part exposed from one side of said wall and a second solid semiconductor element having a part exposed from the other side of said wall, wherein said first solid semiconductor element and said second solid semiconductor element communicate information between them.

7. An ink tank according to claim 1, wherein said solid semiconductor element further comprising:

receiving means for receiving a signal from the outside of said solid semiconductor element, wherein environmental information inside said ink containing chambers is acquired by said information acquiring means in response to the signal received by said receiving means.

8. An ink tank according claim 7, wherein said wall is an outer wall forming a contour, and said receiving means is disposed in a part of said solid semiconductor element exposed to the outside of said ink tank from said outer wall.

9. An ink tank according to claim 1, wherein said solid semiconductor element further comprises energy converting means for converting energy from the outside of said solid semiconductor element into energy of a different kind, wherein said information acquiring means, said information storing means, said discriminating means and said information communicating means are activated by the energy converted by said energy converting means.

10. An ink tank according to claim 9, wherein said wall is an outer wall forming a contour, and said energy converting means is disposed in a part of said solid semiconductor element exposed to the outside of said ink tank from said outer wall.

11. An ink tank according to claim 9, wherein said energy converting means has an electric conductor coil for generating electricity by electromagnetic induction between the electric conductor coil and an external oscillating circuit and an oscillating circuit.

12. A recording apparatus including an ink tank according to any one of claim 1 to 5, 6, or 7, to 11.

13. A recording apparatus according to claim 12, comprising means for supplying an electromotive force to said solid semiconductor element in said ink tank as external energy to be converted by said energy converting means.

14. A recording apparatus according to claim 13, wherein said electromotive force is electromagnetic induction, heat, light or radiation.

15. A recording apparatus according to claim 12, further comprising means for receiving a signal communicated from said solid semiconductor element.

16. A method of communicating with a plurality of groups of elements with two or more solid semiconductor elements among a plurality of solid semiconductor elements disposed in a predetermined container forming one group, wherein said plurality of solid semiconductor elements comprising:

information acquiring means for acquiring information;

information communicating means for displaying or communicating the information acquired by said information acquiring means; and energy converting means for converting energy given from the outside of said solid semiconductor elements into energy of a kind for operating said information acquiring means and said information communicating means, which is different from said energy given from the outside, wherein said method of communicating comprises communication with a communication condition different for each of said groups of elements.

17. A communication method according to claim 16, wherein said solid semiconductor elements comprise:

discriminating means for making determination based on the information acquired from said information acquiring means and a data table stored in advance; and information communicating means for displaying or communicating information determined by said discriminating means, wherein said energy converting means converts energy given from the outside of said solid semiconductor element into energy of a kind for operating said information acquiring means, said discriminating means and said information communicating means, which is different from said energy given from the outside.

18. A communication method according to claim 16, wherein each of said solid semiconductor elements has information for distinction or a memory, and communication is performed by recognizing said information for distinction or distinguishing information by said memory.

* * * * *